US006129631A

United States Patent [19]

Hundal et al.

[11] Patent Number: 6,129,631

[45] Date of Patent: Oct. 10, 2000

[54] METHOD AND APPARATUS FOR GENERATING CARD PLAYING STRATEGIES

[76] Inventors: Hein Hundal, 1981 N. Oak La., State College, Pa. 16803; Robert R. Reitzen, 1504 N. Kenter Ave., Los Angeles, Calif. 90049

[21] Appl. No.: 09/030,668

[22] Filed: Feb. 25, 1998

[51] Int. Cl.[7] ..... A63F 7/06

[52] U.S. Cl. ..... 463/11; 463/13; 463/26; 273/292

[58] Field of Search ..... 463/1.9–13; 700/91–93; 273/292

[56] References Cited

U.S. PATENT DOCUMENTS

| | | | |
|---|---|---|---|
| 5,076,588 | 12/1991 | Minh | 273/292 |
| 5,332,228 | 7/1994 | Schultz | 273/292 |
| 5,769,417 | 6/1998 | Richer et al. | 273/148 R |
| 5,941,770 | 8/1999 | Miers et al. | 463/13 |

*Primary Examiner*—Valencia Martin-Wallace
*Assistant Examiner*—John M Hotaling, II
*Attorney, Agent, or Firm*—Sierra Patent Group, Ltd.

[57] ABSTRACT

The present invention comprises a method and apparatus for generating improved card playing strategies. The present invention may be implemented by means of software programming on a computer system. In one embodiment, a multi-dimensional model is used to represent possible strategies that may be used by each player participating in a card game. Each axis (dimension) of the model represents a distribution of a player's possible hands. Points along a player's distribution axis divide each axis into a number of segments. Each segment has associated with it an action sequence to be undertaken by the player with hands that fall within the segment. The dividing points delineate dividing points between different action sequences. The model is divided into separate portions each corresponding to an outcome determined by the action sequences and hand strengths for each player applicable to the portion. An expected return expression is generated by multiplying the outcome for each portion by the size of the portion, and adding together the resulting products. The location of the dividing points that result in the maximum expected return is determined by taking partial derivatives of the expected return function with respect to each variable, and setting them equal to zero. The result is a set of simultaneous equations that are solved to obtain values for each dividing point. The values for the optimized dividing points define optimized card playing strategies.

33 Claims, 32 Drawing Sheets

METHOD AND APPARATUS FOR GENERATING CARD PLAYING STRATEGIES

BACKGROUND OF THE INVENTION

1. Field of the Invention

The present invention relates to the field of card playing, and more particularly to a method and apparatus for generating improved card playing strategies.

2. Background Art

The game of poker has long been popular, both among card players and game theorists. A large number of books and papers have been written on poker playing strategies. Examples include "Winning Poker Systems" and "Computation of Optimal Poker Strategies" by Norman Zadeh (Wilshire Book Company, 1974 and Operations Research, Vol. 25, No. 4, July–August, 1977, respectively), "Poker Strategy" by Nesmith C. Ankeny (Perigee Books, 1981.), "An Optimal Strategy for Pot-Limit Poker" by William H. Cutler (American Math Monthly, Vol. 82, April 1975), and "Theory of Games and Economic Behavior" by Von Neiman and Morgtern (Princeton University Press, 1944). While the strategies described in the prior art attempt to generate strategies leading to improved returns for players, the methods used to generate the strategies are based on inexact empirical observations or serious analytic simplifications and approximations. As a result, the prior art strategies produce insatisfactory real world results.

Poker Basics

In one popular version of poker, hands consist of five cards from a 52 card deck, resulting in 2,598,960 different hands. The hands are linearly ordered in strength or "rank." There are nine general categories of hands, ranked as shown in Table 1.

TABLE 1

Ranking by Categories

| Rank | Name | Example |
|---|---|---|
| 1 | Straight flush | J♣ 10♣ 9♣ 8♣ 7♣ |
| 2 | Four of a kind | K♣ K♦ K♥ K♠ 9♣ |
| 3 | Full house | J♦ J♥ J♠ 3♣ 3♥ |
| 4 | Flush | A♣ 10♣ 9♣ 5♣ 2♣ |
| 5 | Straight | 6♦ 5♥ 4♠ 3♣ 2♥ |
| 6 | Three of a kind | 10♠ 10♣ 10♦ 9♥ 7♣ |
| 7 | Two pair | A♥ A♠ 4♣ 4♦ 9♣ |
| 8 | One pair | 9♦ 9♥ K♠ 8♣ 6♥ |
| 9 | No pair | 3♣ 5♦ 6♥J♠ Q♣ |

Within each category, hands are ranked according to the rank of individual cards, with an ace being the highest card and a 2 being the lowest card. There is no difference in rank between the four suits of cards. Table 2 shows the ranking of some example hands within the two-pair category. Because the suits of the individual cards do not matter for two pair hands (the suits become relevant only for flushes and straight flushes, since all cards in these hands must be of the same suit), no suits are shown in Table 2.

TABLE 2

Relative Ranking of Some Two Pair Hands

| | |
|---|---|
| Highest | AAKKQ |
| | AAKKJ |
| | AAKK10 |
| | AAKK9 |
| | * * * |
| | AAQQ2 |
| | AAJJK |
| | AAJJQ |
| | * * * |
| | JJ223 |
| | 101099A |
| | 101099K |
| | * * * |
| | 33226 |
| | 33225 |
| Lowest | 33224 |

All hands can be ranked in a linear ranking from highest to lowest. Because suits are all of the same value, however, there are multiple hands that have identical rankings. For example, there are four equivalent hands for each type of straight flush, four of a kind, or flush; there are over a hundred equivalent hands for each two pair variation, and there are over 1000 equivalent hands for each type of no pair hand. Accordingly, although there are over 2,000,000 possible hands, there are significantly fewer possible rankings.

Poker is characterized by rounds of card dealing and betting. Numerous variations of poker exist, including "five card draw," "five card stud," and "seven card stud." The variations generally differ in the manner in which cards are dealt and in the manner in which bets are placed.

Typically, a game starts when each player has placed an initial bet, called the "ante," into the "pot." A player must ante to be permitted to play that game. The term "pot" refers to the total accumulation of bets made during a game. Each player that has "anted" is dealt an initial set of cards. The number of cards depends on the particular variation of poker being played. In five card draw, each player is initially dealt five cards.

After the deal, the players have the opportunity to place bets. If a player places a bet, that bet must be matched ("called") or "raised" by each player that wants to remain in the game. A player who does not match a bet drops out of the game or "folds."

Each game may have several "rounds" of betting. If two or more players remain after a round of betting, either more cards are dealt, or there is a "showdown," depending on the game variation being played. A "showdown" occurs when two or more players remain in a game after the last round of betting for a game has been completed. A player wins a game of poker (also sometimes called a "hand of poker") either by having the highest ranking hand when a "showdown" occurs, or by being the last remaining player in the game after all other players have dropped out, or "folded." At a showdown, each player displays the player's hand to the other players. The player showing the hand with the highest ranking wins the pot.

FIG. 1 illustrates the sequence of events that occur in a game of five card draw poker. As shown in FIG. 1, the game begins with each player paying an ante into the pot at step 100. At step 105, each player is dealt five cards by one of the players who is referred to as the dealer. Players take turns being the dealer.

After each player has been dealt the initial set of five cards, the first round of betting occurs at step 110. In a round of betting, each player is successively given the opportunity to either "pass" (i.e. to place no bet, allowed only if no one has previously placed a bet during the round), to "bet" (i.e.

to place the first bet of the betting round), to "call" (i.e. to pay an amount into the pot equal to the total amount paid by the immediately preceding bettor), to "raise" (i.e. to pay an amount into the pot greater than the amount.paid by the immediately preceding bettor), or to "fold" (i.e. to not pay anything into the pot and thereby to drop out of the game). The betting sequence typically starts with the player to the immediate left of the dealer, and then progresses in a clockwise direction.

FIG. 2 illustrates an example of a first round of betting that may occur at step 110 of FIG. 1. In the example of FIG. 2 there are three players: player A 200, player B 205, and player C 210. Player A is the dealer. In FIG. 2, the cards dealt to each player are shown under the player's name. Thus, after the deal, player A's hand is AA762, player B's hand is KK225, and player C's hand is JJ843.

Since player B is the player to the immediate left of the dealer (player A), player B begins the betting round. Player B may pass (bet nothing), or place a bet. Player B's hand contains two pairs, which player B considers to be a good first round hand. Accordingly, as shown in FIG. 2, player B bets one "bet" at step 215. In this example, betting "one bet" means that the bettor bets the maximum betting limit allowed by the rules of the particular variation of poker game being played. Two types of betting are "limit" betting and "pot limit" betting. In limit betting, the maximum betting limit is a predetermined amount. For example, a betting limit may be $2. In pot limit betting, the maximum amount that a player may bet is the total amount in the pot at the time the bet is made, including the amount, if any, that the bettor would need to put into the pot if the bettor were calling.

After player B has bet, it is player C's turn to act. Since player B has bet one bet, player C's choices are to match player B's bet ("call"), to raise, or to fold. Player C has a pair of jacks, which player C considers to be good enough to call but not good enough to raise. Accordingly, as shown in FIG. 2, player C calls at step 220 by placing an amount equal to player B's bet into the pot.

After player C has bet, it's player A's turn. Player A has a pair of aces, which player A considers to be good enough for not just calling, but raising. Player A therefore decides to raise player B's bet by one bet at step 225. Player A thus places a total of two bets into the pot—one to meet B's bet, and one to raise by one bet.

After player A raises one bet, the betting proceeds back to player B. Player B considers his two pair hand to be good enough to call player A's bet, but not good enough to reraise. Accordingly, player B calls at step 230 by putting one bet (the amount of player A's raise) into the pot so that the total amount bet by player B equals the total amount bet by player A.

After player B bets, the betting returns to player C. To stay in the game, player C must place one bet into the pot to match player A's raise. However, player C doesn't believe that player C's hand of two jacks is good enough to call player A's raise. Accordingly, player C decides to drop out of the game by folding at step 235.

After player C folds, there are no remaining un-called raises or bets. Accordingly, the first round of betting ends at step 240. Thus, after the first round of betting, there are two remaining players, player A and player B.

The size of the pot in the example of FIG. 2 after the first round of betting depends on the size of the initial ante and the betting limit of the game. Table 3 illustrates the growth in the size of the pot during the round of betting illustrated in FIG. 2 for a betting limit of $1 and for a pot limit. In both cases, it is assumed that the total ante of all three players is $1.

TABLE 3

Size of Pot for Limit and Pot Limit Poker For Example of FIG. 2

| Betting Step | Action | Resulting Pot ($1 Limit) | Resulting Pot (Pot Limit) |
|---|---|---|---|
| 0 | Ante | $1 | $1 |
| 1 | B bets 1 bet | $2 | $2 |
| 2 | C calls B's bet | $3 | $3 |
| 3 | A raises by 1 bet | $5 | $8 |
| 4 | B calls A's raise | $6 | $12 |
| 5 | C folds | $6 | $12 |

Thus, at the end of the first round of betting illustrated in FIG. 2, the resulting pot is $6 for $1 limit poker and $12 for pot limit poker.

Referring again to FIG. 1, at the end of the first round of betting at step 110, a determination is made as to whether more than one player is left in the game at step 115. If only one player is left, that player wins the pot at step 120. If more than one player is left, play continues to step 125.

At step 125, the players remaining in the game have the opportunity to discard cards from their hands and replace them with newly dealt cards. A player may discard and replace (or "draw") from 0 to 5 cards.

After the "draw" at step 125, the second round of betting takes place at step 130. The second round of betting proceeds in the same manner as the first round of betting. FIG. 3 illustrates an example of a second round of betting that occurs after the first round of betting of FIG. 2. In the example game of FIG. 3, player A and player B each drew 1 card during the draw. Player A could have drawn more cards, but player A chose to draw only one card to make it appear that player A had a better hand than player A's pair of aces. Player A discarded the lowest card of player A's hand (a 2), and was dealt a 9. Player A's resulting hand as shown in FIG. 3 is AA976.

Player B, starting off with four good cards (two pairs), also drew one card, discarding a 5 and being dealt a 7. Player B's resulting hand as shown in FIG. 3 is KK227.

The betting, in round 2, as in round 1, commences with player B. As shown in FIG. 3, even though player B has a fairly good two pair hand, player B chooses to "check" ("check" is another way to say "pass") at step 300. A check is equivalent to a pass, or to betting zero. The betting then proceeds to player A. Although player A's hand is not particularly strong, player A decides to bet 1 bet at step 305, hoping that player B will believe that player A has a strong hand and therefore fold. Making a bet with a weak hand that probably will not win in a showdown is referred to as "bluffing."

Player B does not fold, but instead raises player A by one bet at step 310. Player B thus pays two bets into the pot: one to meet player A's bet, and one to raise player A one bet. Player A, believing that player B's raise is a bluff, decides to reraise player B at step 315. Player A thus pays two more bets into the pot, one to match player B's raise and one for the reraise. Player B, not having bluffed, calls player A's reraise at step 320 by paying a bet into the pot to match player A's one bet reraise.

Player B's call of player A's reraise ends the second round of betting, leading to a showdown at step 325. The amount of money in the pot at the end of the second round of betting depends on whether the game is a limit game or a pot limit game. Table 4 shows the growth in the pot in the second round of betting for limit and pot limit games given the first round pot shown in table 3.

TABLE 4

Size of Pot for Limit and Pot Limit Poker For Example of FIG. 3

| Betting Step | Action | Resulting Pot ($1 Limit) | Resulting Pot (Pot Limit) |
|---|---|---|---|
| 0 | Beginning pot | $6 | $12 |
| 1 | B checks | $6 | $12 |
| 2 | A bets 1 bet | $7 | $24 |
| 3 | B raises 1 bet | $9 | $72 |
| 4 | A reraises 1 bet | $11 | $216 |
| 5 | B calls | $12 | $324 |

As shown in Table 4, in a pot limit game, the size of the pot increases dramatically with each pot limit bet, while the increase of the pot in a limit game is more moderate.

Referring again to FIG. 1, after the second round of betting at step 130, a determination is made as to whether more than one player is left in the game at step 135. If only one player is left, the remaining player wins the pot at step 140. If more than one player remains in the game, there is a showdown at step 145. The remaining players shown their hands, and the highest ranking hand wins the pot at step 150. In the example of FIG. 3, player B's hand of two pairs has a higher ranking than player A's hand of a pair of aces. Accordingly, player A's bluffing strategy proves unsuccessful, and player B wins the pot.

Prior Art Attempts to Generate Optimal Poker Playing Strategies

Attempts have been made in the prior art to generate optimal poker playing strategies that will provide a player with the best average economic return for any given hand dealt to the player. Many of these attempts have focused on a player's average "expected return" for taking actions such as passing, calling, betting, raising and bluffing given a particular hand of cards.

The expected return for a given action, given a particular hand of cards in a particular game circumstance, is the average return to a player for taking the action if the action were repeated many times. The expected return is the sum of the actual returns for each repetition divided by the number of repetitions. A player's overall actual return for a particular game of poker is the player's winnings (if any) from the game minus the player's investment in the game (i.e. the amount the player pays into the pot over the course of the game). For example, Table 5 shows the investment, winnings, and the net actual return for each of the players A, B, and C in the game of FIGS. 2 and 3, assuming the game is a limit game in which the limit is $1 and the initial ante is $0.33. In Table 5 bets are indicated by minus signs, and winnings by plus signs.

TABLE 5

Overall Actual Returns for Players A, B, and C For Example of FIGS. 2 and 3 (in dollars)

| Action | A | B | C | Total Pot |
|---|---|---|---|---|
| First Round | | | | |
| Ante | −0.33 | −0.33 | −0.33 | 1 |
| B bets 1 bet | 0 | −1 | 0 | 2 |
| C calls B's bet | 0 | 0 | −1 | 3 |

TABLE 5-continued

Overall Actual Returns for Players A, B, and C For Example of FIGS. 2 and 3 (in dollars)

| Action | A | B | C | Total Pot |
|---|---|---|---|---|
| A raises by 1 bet | −2 | 0 | 0 | 5 |
| B calls A's raise | 0 | −1 | 0 | 6 |
| C folds | 0 | 0 | 0 | 6 |
| Second Round | | | | |
| B checks | 0 | 0 | 0 | 6 |
| A bets 1 bet | −1 | 0 | 0 | 7 |
| B raises 1 bet | 0 | −2 | 0 | 9 |
| A reraises 1 bet | −2 | 0 | 0 | 11 |
| B calls | 0 | −1 | 0 | 12 |
| Total bet | −5.33 | −5.33 | −1.33 | |
| Showdown | 0 | +12 | 0 | |
| Net return | −5.33 | +6.67 | −1.33 | |

For the example game of FIGS. 2 and 3 therefore, the actual overall return for player A is −$5.33, for player B +6.67, and for player C −$1.33.

The returns shown in Table 5 are the overall returns to each player for the entire game. Expected and actual returns may also be calculated for specific parts of the game. For example, returns may be calculated for the second round of play only. In calculating returns for the second round of play, the amounts invested by the players during the first round of play may or may not be taken into account. In the case where first round investments are not taken into account, returns for the second round of betting are calculated based on the size of the pot at the beginning of the round and the amounts invested by the players during the second round. Table 6 shows the returns for the second round for remaining players A and B in the example of FIGS. 2 and 3, neglecting first round investments made by the players.

TABLE 6

2nd Round Actual Returns for Playem A and B For Example of FIGS. 2 and 3 (in dollars)

| Action | A | B | Total Pot |
|---|---|---|---|
| Beginning Pot | | | 6 |
| B checks | 0 | 0 | 6 |
| A bets 1 bet | −1 | 0 | 7 |
| B raises 1 bet | 0 | −2 | 9 |
| A reraises 1 bet | −2 | 0 | 11 |
| Bcalls | 0 | −1 | 12 |
| Total bet | −3.00 | −3.00 | |
| Showdown | 0 | +12 | |
| Net return | −3.00 | +9.00 | |

The second round actual returns for players A and B for the example of FIGS. 2 and 3 are thus −$3 and +$9, respectively.

Since the payments made by players A and B into the pot are omitted when calculating the second round investments and returns in Table 5, the returns shown in Table 5 can be considered to be actual returns to players A and B for a two-player second round contest in which player A's hand is AA762 and player B's hand is CK227, and in which the beginning pot is $6. The actions that player B took in this second round of betting were to check, to raise, and to call player A's reraise. This sequence may be referred to as a "check-raise-call" sequence. Similarly, the actions that A took in the second round of betting were to bet and to reraise. This sequence may be referred to as a "bet-reraise" sequence.

More generically, from player A's point of view, the situation at the time player A first acts in round two of betting for the example of FIG. 3 is:

a) There is a certain amount in the pot, in this case, $6.

b) Player A has a hand that has a specific rank. In this case, A's hand is AA762. If hands are assigned relative hand strength rankings between 0 and 1 (1 being highest), then the rank of player A's hand will be some number S between 0 and 1. (See, for example, Von Neuman and Morgenstern, "Theory of Games and Economic Behavior," Princeton University Press 1944).

c) Player B has checked. Accordingly, the following sequence of actions are possible (assuming that the game is limited to one reraise):

a) Player A also checks, and there is an immediate showdown. The sequence of A's action under this option is "check."

b) Player A bets, and player B calls. The sequence of A's actions under this option is "bet."

c) Player A bets, and player B folds, in which case player A wins the pot. The sequence of A's actions under this option is "bet."

d) Player A bets, player B raises, and player A folds. The sequence of player A's actions under this option is "bet-fold." In some cases, a "bet-fold" sequence is the result of a "bluff bet." Player A hopes to cause player B to fold with the bet, but if player B answers with a raise, player A folds.

e) Player A bets, player B raises, player A reraises, and player B calls. The sequence of player A's actions under this option is "bet-reraise."

f) Player A bets, player B raises, player A reraises, and player B folds. The sequence of player A's actions under this option is "bet-reraise."

g) Player A bets, player B raises, and player A calls. The sequence of player A's actions under this option is "bet-call."

Although there are seven separate scenarios that may occur, there are only five possible sequences of actions for player A: i) check; ii) bet; iii) bet-fold; iv) bet-reraise; and v)bet call. Since the second sequence ("bet") is included in the third through fifth sequences, this list can further be reduced to four possible sequences of actions: i) check; ii) bet-fold; iii) bet-reraise; and iv) bet-call.

In the example of FIG. 3, the action sequence that player A chose to take was to "bet-reraise." As shown in FIG. 6, the resulting return to player A was a loss of $3 (−$3).

From FIG. 3, the returns to player A if player A had taken each of the other three action sequences can be calculated.

For the "check" sequence, the result would have been that player B would have won the pot in the showdown. A's investment in the second round would have been $0, and A's winnings would have been $0. Therefore A's net return for a "check" would have been $0.

For the "bet-fold" sequence bluff bet), A would have bet $1, B would have called, then A would have folded. A's investment would have been $1, and A's winnings would have been $0. A's net return for a bluff bet would have been −$1.

For the "bet-call" sequence, A would have bet $1, B would have raised, A would have called with a $1 bet, and B would have won the showdown. A's investment would have been $2, and A's winning $0. Thus A's net return for a "bet-call" sequence would have been −$2.

Table 7 summarizes the actual second round returns to Player A that would have resulted given the circumstances of FIG. 3 for each of Player A's four possible action sequences check, bet-fold, bet-call, and bet-reraise.

TABLE 7

Second Round Returns for Player A with Different Action Sequencesfor Example of FIG. 3

| Action Sequence | Return |
|---|---|
| Check | $0 |
| Bet-fold (bluff bet) | −$1 |
| Bet-call | −$2 |
| Bet-reraise | −$3 |

From Table 7, it can be seen that by choosing the "bet-reraise" sequence in the example game of FIG. 3, player A chose the action sequence that resulted in the lowest actual return for the particular game of FIG. 3. Player A would have obtained the best possible return by following the first action sequence option: Check. If player A had known the actual outcome of the game, player A would have selected the "Check" action sequence.

However, it is impossible for player A to know, ahead of time, what cards player B holds, or what the particular outcome of a game will be. What player A knows is player A's own hand, the size of the pot, and that player B has checked. Since the specific outcome of any action sequence chosen by player A will depend on what cards B holds and how player B plays, it will be impossible for player A to predict the actual return for each action sequence in any particular game. However, if player A were able to play a large number of games in each of which player A has a hand having the same ranking S as in the example of FIG. 3, in which B checks, but in which B has a variety of hands, and if A recorded the outcome of each action sequence for each of the games, A could obtain an average expected return for each of the action sequences for the situation of a second round betting round in which A has a hand of ranking S and player B bets first and checks. Player A would then be able to determine which action sequence, in the long run, will result in the highest return for a hand of ranking S if player B uses the check-raise-call sequence.

Theoretically, by playing a large number of games for each of player A's possible hands, and by keeping track of the outcomes for each action sequence, A could calculate the expected returns for each action sequence for each possible hand for each game situation. Player A would then know the best action sequence to choose for any hand. However, given there are over 2 million possible hands, such an endeavor is unfeasible.

Prior art attempts have been made to create mathematical models of poker that could be used to obtain optimal playing strategies. However, these prior art attempts have not been directly applicable to real world poker.

SUMMARY OF THE INVENTION

The present invention comprises a method and apparatus for generating improved card playing strategies. The present invention may be implemented by means of software programming on a computer system. In one embodiment, a multi-dimensional model is used to represent possible strategies that may be used by each player participating in a card game. Each axis (dimension) of the model represents a distribution of a player's possible hands. Points along a player's distribution axis divide each axis into a number of segments. Each segment has associated with it an action sequence to be undertaken by the player with hands that fall within the segment. The dividing points delineate dividing points between different action sequences. The model is divided into separate portions each corresponding to an outcome determined by the action sequences and hand strengths for each player applicable to the portion. An expected return expression is generated by multiplying the outcome for each portion by the size of the portion, and adding together the resulting products. The location of the dividing points that result in the maximum expected return is determined by taking partial derivatives of the expected return function with respect to each variable, and setting them equal to zero. The result is a set of simultaneous equations that are solved to obtain values for each dividing point. The values for the optimized dividing points define optimized card playing strategies.

DETAILED DESCRIPTION OF THE INVENTION

A method and apparatus for generating improved card playing strategies is presented. In the following description, numerous specific details are set forth in order to provide a thorough description of the present invention. It will be apparent, however, to one skilled in the art, that the present invention may be practiced without these specific details. In other instances, well-known features have not been described in detail so as not to obscure the present invention.

The present invention may be used with a variety of card games, including, without limitation, poker and variations of poker. The use of the invention with games of varying complexity is described below. The example games described include:

A two-player, one round game with no raising.

A two-player, one round game with raising but no check raising.

A two player, one round game with check raising.

Two-Player One Round Game with no Raising

Figure 1:
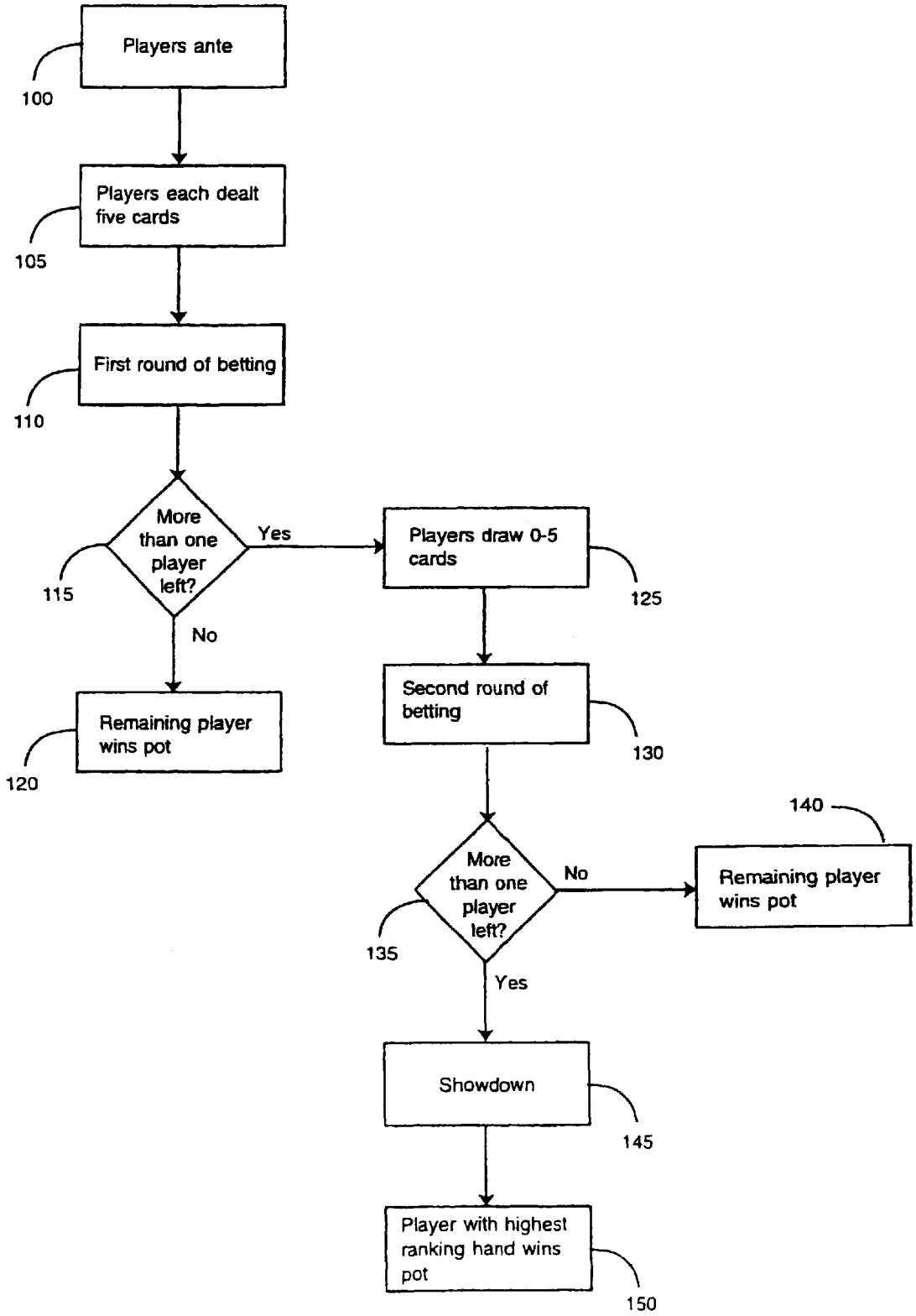
FIG. 1 is a flow chart illustrating a sequence of events in five card draw poker.
Figure 2:
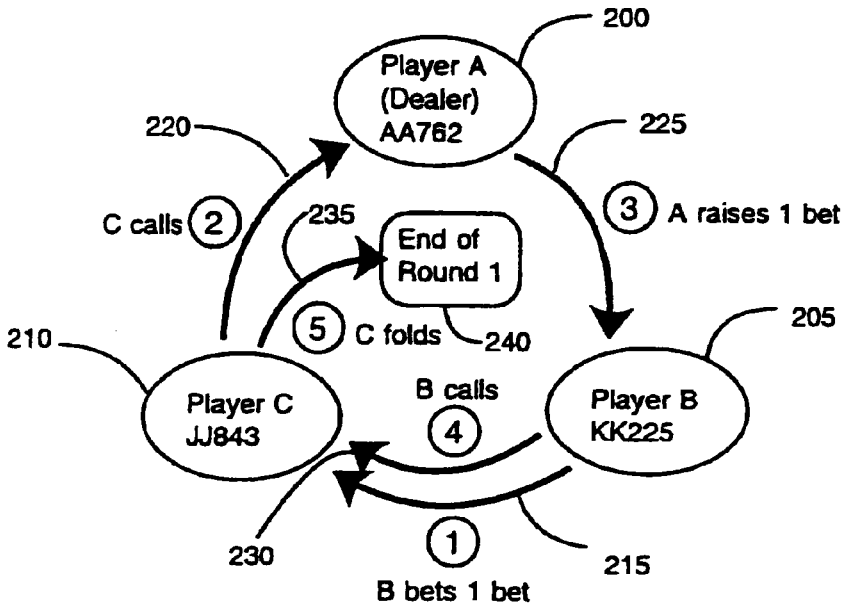
FIG. 2 is a schematic diagram illustrating a first round of betting.
Figure 3:
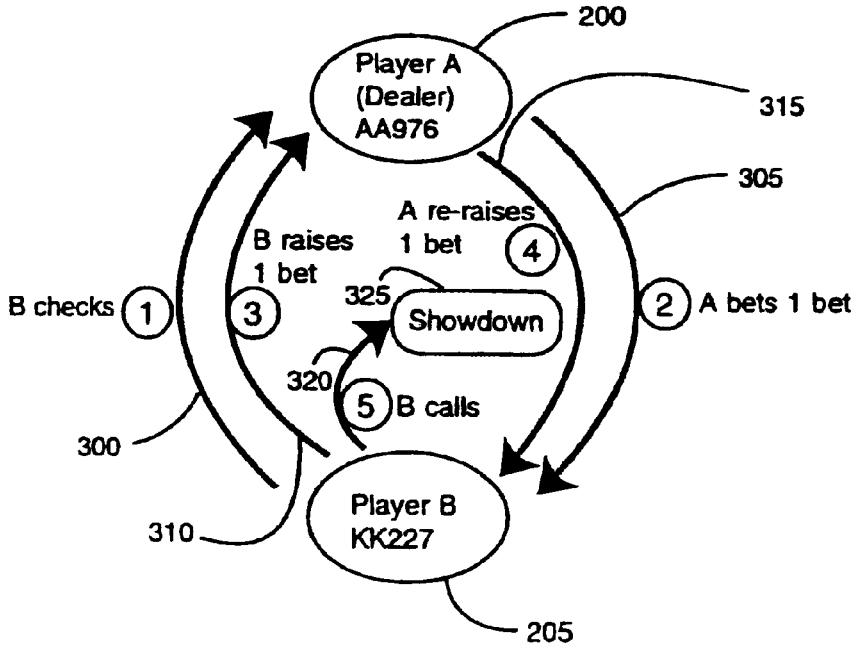
FIG. 3 is a schematic diagram illustrating a second round of betting.
Figure 4:
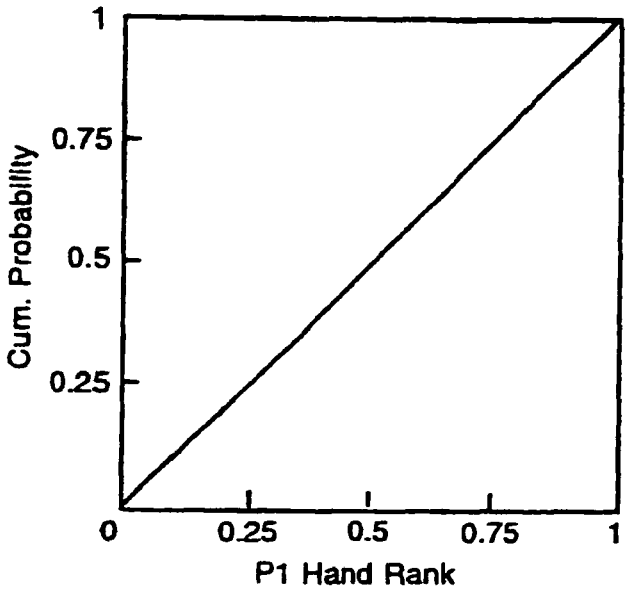
FIG. 4 illustrates a uniform cumulative distribution function for player P1.
Figure 5:
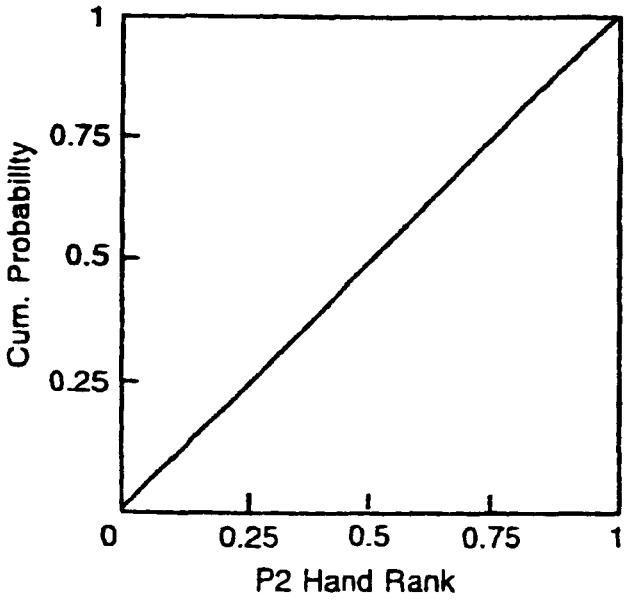
FIG. 5 illustrates a uniform cumulative distribution function for player P2.

A simple variation of the game of poker is a two-player, one-round game with no raising. In this game, there are two players. Each player is dealt a hand having a strength or ranking between 0 and 1. For each player, the probability of having any particular ranking x in this example is deemed to be uniform on the interval between 0 and 1. The resulting cumulative distribution functions for each of P1 and P2 is illustrated in FIGS. 4 and 5, respectively. Each player pays an ante in the amount of P/2, such that the total ante is amount P. Player 1 (P1) opens the betting, and has two choices: pass or bet P. If P1 passes, there is an immediate showdown. If P1 bets, Player 2 (P2) may either call by betting P or fold.

Figure 6:
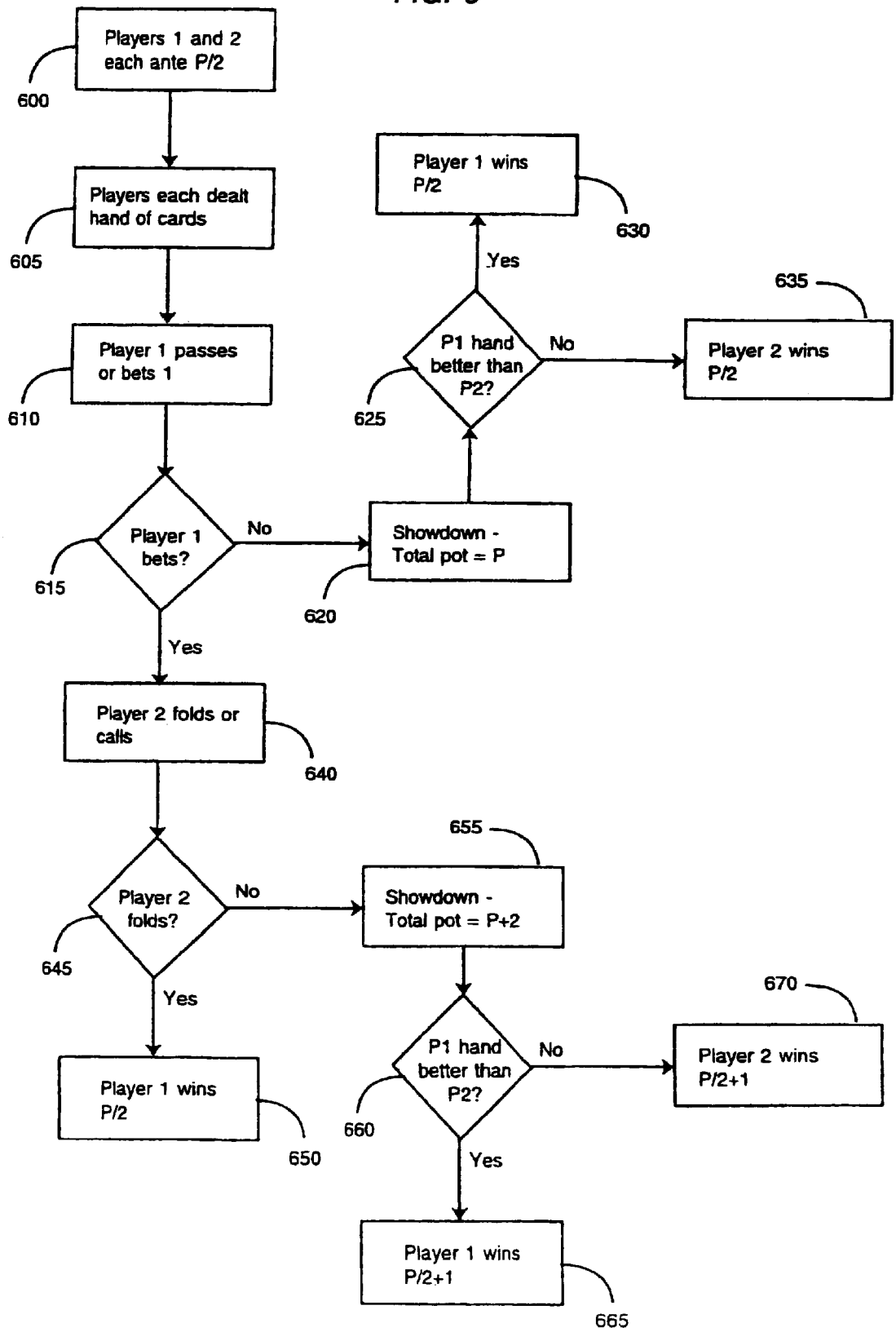
FIG. 6 is a flow chart illustrating a sequence of events in a two-player, one round game without raising.

FIG. 6 illustrates the sequence of events in this game. At step 600, P1 and P2 each pay an ante in the amount of P/2, such that the pot is amount P. At step 605, each player is dealt a hand whose value is between 0 and 1. According to the cumulative distribution functions shown in FIGS. 4 and 5, each of P1 and P2 have an equal chance of getting any hand value between 0 and 1.

At step 610, P1 either passes or bets. If player P1 passes, there is an immediate showdown at block 620. Since no bets have been added to the pot, the pot contains only the ante of total amount P. The highest hand wins the pot. If P1's hand is better than P2's hand, P1 wins P/2 (the size of the pot, P, minus the amount P1 put into the pot, P/2) at step 630. If P2's hand is better than P1's, P2 wins P/2 at step 635. In this case, P1 loses P/2.

If P1 bets 1 at step 610, the pot increases to P+1, and P2 either folds or calls at step 640. If P2 folds, P1 wins the pot at step 650, winning a net amount of P/2 (the size of the pot, P+1, minus the amount P1 put into the pot, P/2+1). It is worth noting that at step 650, because P1 bet and P2 folded, there is no showdown, and P1 wins regardless of the rank of P1's hand or the rank of P2's hand.

If P2 calls at step 640, the pot increases to P+2, and there is a showdown at step 655. If P1's hand is better than P2's, P1 wins the pot at step 665. P1's net winnings are P/2+1 (the size of the pot, P+2, minus the amount P1 put into the pot, P/2+1). If P2's hand is better than P1's, P2 wins the pot at step 670. P2's net winnings are P/2+1 (the size of the pot, P+2, minus the amount P2 put into the pot, P/2+1). P1 loses the amount P1 put into the pot, P/2+1.

The method of the invention may be used to generate strategies for maximizing the average expected return for both P1 and P2. In one embodiment, a multi-dimensional model of the game is created. The number of dimensions is equal to the number of players. Because there are two players in the game of FIG. 6, in this embodiment, the model is a two dimensional model.

Figure 7:
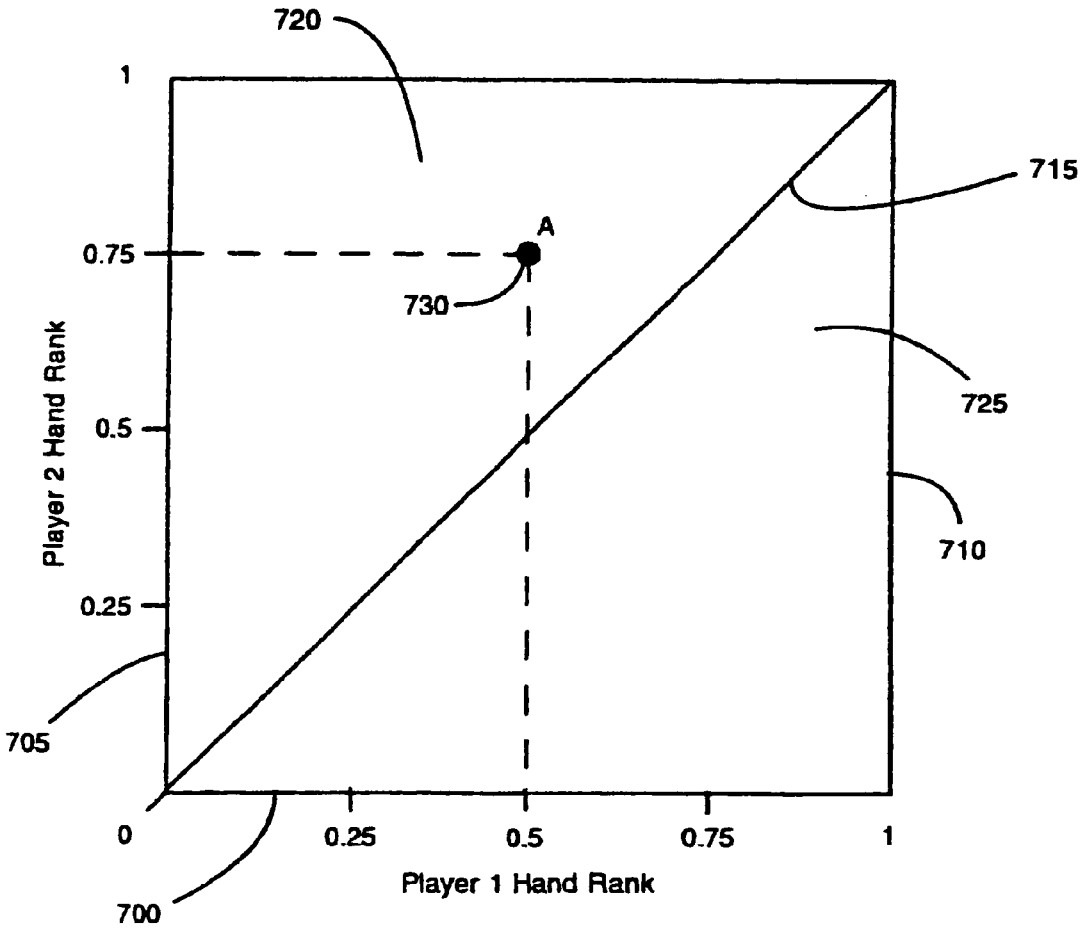
FIG. 7 illustrates an example of a two-dimensional model of one embodiment of the invention.

FIG. 7 shows a model for the game of FIG. 6 according to one embodiment of the invention. Axes 700 and 705, representing P1's and P2's possible hands, respectively, are arranged orthogonal to each other with a common origin, forming a resulting area 710. Each point in area 710 represents a possible pair of hands that may be dealt to P1 and P2 in a game. For example, point "A" 730 represents a game in which P1's hand is of rank 0.5 and P2's hand is of rank 0.75. If a showdown occurred in the game represented by point "A", Player 2 would win. Line 715 is the line representing games in which P1's and P2's hands are of equal rank. In the region 720 above line 715, P2's hand is of higher rank than P1's. In the region 725 below line 715, P1's hand is of higher rank than P2's. In general, in games in which showdowns occur, P1 wins in region 725 and P2 wins in region 720.

Figure 8:
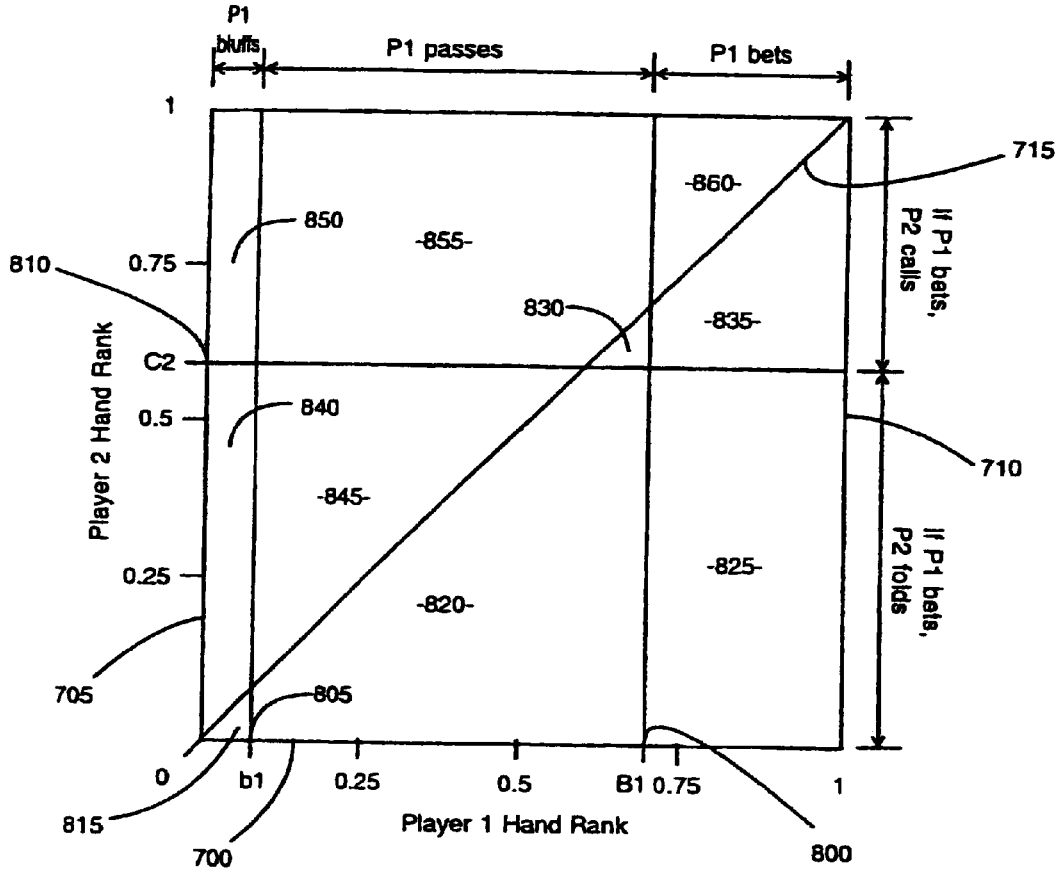
FIG. 8 illustrates further development of the two-dimensional model of FIG. 7.

FIG. 8 illustrates a further development of the model of FIG. 7 according to the invention. As shown in FIG. 6, after the players are dealt their hands at step 605, P1 must either pass or bet at step 610. It is initially assumed that P1's game playing strategy is to bet for those hands for which P1 has the better chance of beating P2's hands (namely P1's highest ranking hands) and pass with lower ranking hands. The lowest ranking hand for which P1 bets is designated "B1." Accordingly, in FIG. 8, point B1 is initially placed at an arbitrary point 800 in the upper half of P1's distribution axis 700.

However, as shown in FIG. 6, P1 not only wins games in which P1's hand proves to be of higher rank than P2's hand (i.e. at the showdowns that occur at steps 620 and 655), but also wins at step 650 when P2 folds, regardless of the respective rank of P1's and P2's hands. Accordingly, P1 can benefit by bluff betting with a certain portion of P1's worst hands, hands with which P1 would almost certainly lose in a showdown, but with which P1 can win if P2 folds in response to P1's bet. It is therefore assumed that P1 will bluff bet for all hands whose rank is below a certain value. This highest rank of hand for which P1 will bluff bet is designated "b1" (lower case indicating a bluff) and is initially placed at an arbitrary point 805 in the lower half of P1's distribution axis 700.

In a similar manner, it is assumed that P2's strategy is to call with P2's higher ranking hands and fold with P2's lower ranking hands. The lowest ranking hand with which P2 calls is designated "C2", and is located initially at a point 810 in the upper half of P2's distribution axis 705. It is assumed that P2 knows that P1 will occasionally bluff, and that to catch P1 bluffing, P2 must bet hands that of lower rank than hands with which P2 believes would be needed to win a showdown with P1. Accordingly, it is assumed that C2 is a lower value than B1.

Although B1, b1 and C2 are shown positioned at certain locations in FIG. 8, the locations themselves are arbitrary for purposes of using the method of the invention. The important factor is the relative positioning of the variables, namely B1>C2>b1.

As shown in FIG. 8, points b1, B1 and C2 along with dividing line 715 divide region 710 into a number of subregions 815, 820, 835, 830, 835, 840, 845, 850, and 855. These subregions correspond to alternative outcomes for games that fall in the subregions if P1 and P2 use the assumed strategies.

Subregions 815, 820, 825, 830, and 835 correspond to games in which P1's hand has a higher rank than P2's hand.

As shown in FIG. 8, subregion 815 corresponds games in which P1 bluff-bets and P2 folds. Accordingly, the outcome in these games corresponds to step 650 in FIG. 6. As shown in FIG. 6, PF wins P/2 at step 650.

Subregion 820 corresponds to games in which P1 passes and then wins the immediately following showdown. The outcome in these games corresponds to step 630 in FIG. 6. As shown in FIG. 6, P1 wins P/2 at step 630.

Subregion 825 corresponds to games in which P1 bets and then P2 folds. The outcome in these games, like the games in subregion 815, corresponds to step 650 in FIG. 6. Accordingly, P1 wins P/2 for these games.

Subregion 830, like subregion 820, corresponds to game in which P1 passes and then wins the immediately following showdown. P1 wins P/2 for these games.

Subregion 835 corresponds to games in which P1 bets, P2 calls, and then P1 wins in a showdown. The outcome in these games corresponds to step 665 in FIG. 6. In these games, P1 wins P/2+1.

The remaining subregions 840, 845, 850, 855, and 860 correspond to games in which P2's hand has a higher rank than P1's hand.

Subregion 840, like subregion 815, corresponds to games in which P1 bluff bets and P2 folds. In these games, P1 wins P/2.

Subregion 845 corresponds to games in which P1 passes and P2 wins the resulting immediate showdown. The outcome of these games corresponds to step 635 in FIG. 6. As shown in FIG. 6, in these games P2 wins P/2 (P1 loses P/2).

Subregion 850 corresponds to games in which P1 bluff bets, P2 calls, and P2 wins the resulting showdown. The outcome of these games corresponds to step 670 in FIG. 6. As shown in FIG. 6, in these games P2 wins P/2+1 (P1 loses P/2+1).

Subregion 855, like subregion 845, corresponds to games in which P1 passes and P2 wins the resulting showdown. P2 wins P/2 in these games (P1 loses P/2).

Subregion 860 corresponds to games in which P1 bets, P2 calls, and P2 wins the resulting showdown. Like subregion 850, the outcome of these games corresponds to step 670 in FIG. 6. P2 wins (and P1 loses) P/2+1 in these games.

Table 8 summarizes the outcomes for each of the players for each subregion of FIG. 8 in terms of the returns to the players for games in each subregion.

TABLE 8

Outcomes for Subregions of FIG. 8

| Region | Return to P1 | Return to P2 |
|---|---|---|
| 815 | +P/2 | −P/2 |
| 820 | +P/2 | −P/2 |
| 825 | +P/2 | −P/2 |
| 830 | +P/2 | −P/2 |
| 835 | +(P/2 + 1) | −(P/2 + 1) |
| 840 | +P/2 | −P/2 |
| 845 | −P/2 | +P/2 |
| 850 | −(P/2 + 1) | +(P/2 + 1) |
| 855 | −P/2 | +P/2 |
| 860 | −(P/2 + 1) | +(P/2 + 1) |

Because each of P1 and P2 have a uniform probability of being dealt any hand having a value between 0 and 1, the value of a hand as indicated along each of the card rank distribution axes 700 and 705 also represents the value of the cumulative distribution function for each of P1 and P2, respectively. Accordingly, the area of each subregion corresponds to the probability that games will occur in that subregion. The expected return to each player due to each subregion thus is the product of the area of the subregion multiplied by the outcome for games falling in that subregion. The total expected return for a player is the sum of those products for each area.

The areas of each of the subregions can be calculated from FIG. 8.

Subregion 815 is a triangle of base b1 and height b1 (since line 715 has a slope of 1). Accordingly, the area of Subregion 815 is:

$$\text{Area } 815 = \frac{b1^2}{2}$$

The area of subregion 820 is equal to the area of a triangle of base B1 and height B1, minus the area of subregions 815 and 830. Subregion 830 is a triangle of base (B1−C2) and height (B1−C2). The area of subregion 830 is therefore:

$$\text{Area } 830 = \frac{(B1 - C2)^2}{2} = \frac{B1^2}{2} - B1C2 + \frac{C2^2}{2}$$

Accordingly, the area of subregion 820 is equal to:

$$\text{Area } 820 = \frac{B1^2}{2} - \frac{b1^2}{2} - \left(\frac{B1^2}{2} - B1C2 + \frac{C2^2}{2}\right)$$

$$= B1C2 - \frac{b1^2}{2} - \frac{C2^2}{2}$$

Subregion 825 is a rectangle of base 1−B1 and of height C2. The area of subregion 825 is therefore equal to:

$$\text{Area } \mathbf{825} = (1 - B1)C2 = C2 - B1C2$$

The area of subregion 835 is equal to the area of a rectangle of base (1−B1) and of height (1−C2) minus the area of subregion 860. Subregion 860 is a triangle with base (1−B1) and height (1−B1). The area of subregion 860 is therefore:

$$\text{Area } 860 = \frac{(1 - B1)^2}{2} = \frac{1}{2} - B1 + \frac{B1^2}{2}$$

The area of subregion 835 is therefore:

$$\text{Area } 835 = (1 - B1)(1 - C2) - \left(\frac{1}{2} - B1 + \frac{B1^2}{2}\right)$$

$$= (1 - C2 - B1 + B1C2) - \left(\frac{1}{2} - B1 + \frac{B1^2}{2}\right)$$

$$= \frac{1}{2} - C2 + B1C2 - \frac{B1^2}{2}$$

The area of subregion 840 is equal to the area of a rectangle of base b1 and height C2 minus the area of subregion 815. The area of subregion 840 therefore is equal to:

$$\text{Area } 840 = b1C2 - \frac{b1^2}{2}$$

The area of subregion 845 is equal to the area of a triangle of base C2 and height C2 minus the area of subregion 840. The area of subregion 845 therefore is equal to:

$$\text{Area } 845 = \frac{C2^2}{2} - \left(b1C2 - \frac{b1^2}{2}\right) = \frac{C2^2}{2} - b1C2 + \frac{b1^2}{2}$$

The area of subregion 850 is equal to the area of a rectangle of base b1 and height 1−C2. The area of subregion 850 is therefore equal to:

$$\text{Area } \mathbf{850} = (b1)(1 - C2) = b1 - b1C2$$

Finally, the area of subregion 855 is equal to the area of a rectangle of base (B1−b1) and height (1−C2) minus the area of subregion 830. The area of subregion 855 is therefore equal to:

$$\text{Area } 855 = (B1 - b1)(1 - C2) - \left(\frac{B1^2}{2} - B1C2 + \frac{C2^2}{2}\right)$$

$$= B1 - B1C2 - b1 + b1C2 - \frac{B1^2}{2} + B1C2 - \frac{C2^2}{2}$$

$$= -\frac{B1^2}{2} + B1 - b1 + b1C2 - \frac{C2^2}{2}$$

Table 9 summarizes the returns to P1 for games in each subregion and the area of each subregion.

TABLE 9

Returns for P1 and Areas of Subregions

| Region | Return to P1 | Area(probability) |
|---|---|---|
| 815 | +P/2 | $\frac{b1^2}{2}$ |
| 820 | +P/2 | $B1C2 - \frac{b1^2}{2} - \frac{C2^2}{2}$ |

TABLE 9-continued

Returns for P1 and Areas of Subregions

| Region | Return to P1 | Area(probability) |
|---|---|---|
| 825 | +P/2 | C2 − B1C2 |
| 830 | +P/2 | $\frac{B1^2}{2} - B1C2 + \frac{C2^2}{2}$ |
| 835 | +(P/2 + 1) | $\frac{1}{2} - C2 + B1C2 - \frac{B1^2}{2}$ |
| 840 | +P/2 | $b1C2 - \frac{b1^2}{2}$ |
| 845 | −P/2 | $\frac{C2^2}{2} - b1C2 + \frac{b1^2}{2}$ |
| 850 | −(P/2 + 1) | b1 − b1C2 |
| 855 | −P/2 | $-\frac{B1^2}{2} + B1 - b1 + b1C2 - \frac{C2^2}{2}$ |
| 860 | −P/2 + 1) | $\frac{1}{2} - B1 + \frac{B1^2}{2}$ |

According to the invention, the expected return to P1 is the sum of the product of the return for each subregion multiplied by the probability (area) of each subregion. Letting E1 be the expected return to P1:

$$E1 = \frac{P}{2}\left[\left(\frac{b1^2}{2}\right) + \left(B1C2 - \frac{b1^2}{2} - \frac{C2^2}{2}\right) + (C2 - B1C2) + \left(\frac{B1^2}{2} - B1C2 + \frac{C2^2}{2}\right) + \left(b1C2 - \frac{b1^2}{2}\right) - \left(\frac{C2^2}{2} - b1C2 + \frac{b1^2}{2}\right) - \left(-\frac{B1^2}{2} + B1 - b1 + b1C2 - \frac{C2^2}{2}\right)\right] + \left(\frac{P}{2} + 1\right)\left[\left(\frac{1}{2} - C2 + B1C2 - \frac{B1^2}{2}\right) - (b1 - b1C2) - \left(\frac{1}{2} - B1 + \frac{B1^2}{2}\right)\right] \quad (0)$$

Equation (0) may be simplified and rewritten as:

$$E1 = b1C2P - \frac{b1^2P}{2} - C2 + B1C2 - B1^2 - b1 + b1C2 + B1 \quad (1)$$

Equation (1) is an expression for P1's expected return as a function of the pot P, and of variables b1, B2, and C2, resulting from application of the method of the invention.

Of the three variables, b1 and B1 are controlled by P1, while C2 is controlled by P2. The present invention assumes that P1 will seek values for b1 and B1 so as to maximize P1's return (E1), while P2 will seek a value for C2 so as to minimize E1. To find such values, according to the method of the present invention, the partial derivatives of E1 with respect to each of the variables b1, B2 and C2 are taken and each set equal to zero. The result is three simultaneous equations that are used to solve for b1, B2 and C2:

$$\frac{\partial E1}{\partial b1} = C2P - b1P - 1 + C2 = 0 \quad (2)$$

$$\frac{\partial E1}{\partial B1} = C2 - 2B1 + 1 = 0 \quad (3)$$

$$\frac{\partial E1}{\partial C2} = b1P - 1 + B1 + b1 = 0 \quad (4)$$

Solving equations (2), (3) and (4) simultaneously produces the following expressions for b1, B2 and C2 in terms of P:

$$b1 = \frac{P}{(2P+1)(P+2)} \quad (5)$$

$$B1 = \frac{P^2 + 4P + 2}{(2P+1)(P+2)} \quad (6)$$

$$C2 = \frac{3P + 2}{(2P+1)(P+2)} \quad (7)$$

For example, if P=1, from equations (5)–(7), b1=1/9, B2=7/9, and C2=5/9. Using these values in equation (1), the resulting expected return to P1 for the game is approximately 0.056 units/game.

GENERAL METHOD OF THE INVENTION

Figure 9:
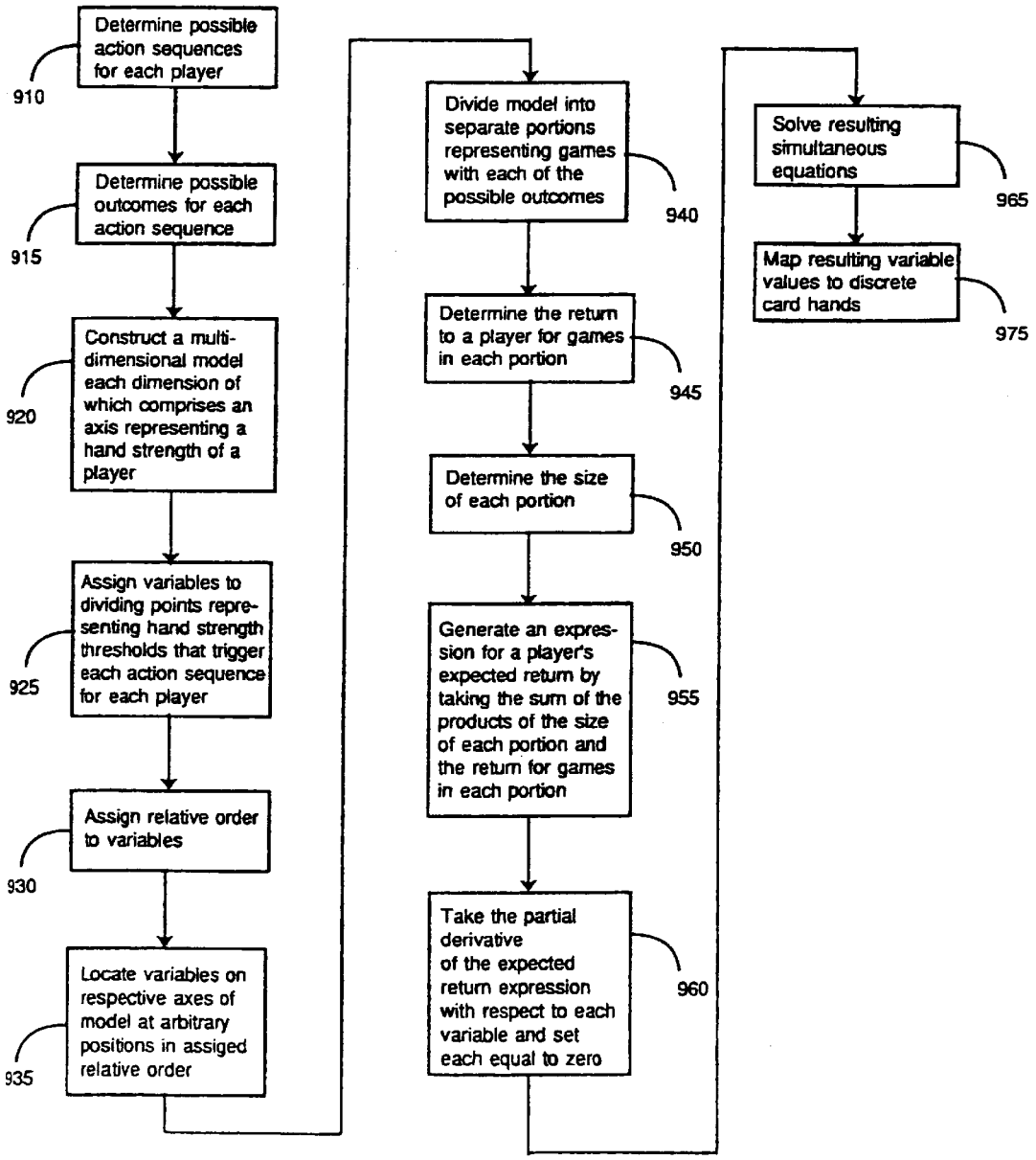
FIG. 9 is a flow chart of steps used in one embodiment of the invention to generate improved card playing strategies.

FIG. 9 is a flow chart illustrating steps used in one embodiment of the invention to generate card playing strategies. This method may be used, for example, for the one round equal contest embodied by the game of FIG. 6, as well as for other, more complex games.

As shown in FIG. 9, the possible action sequences for each player are determined at step 910. For example, in the game of FIG. 6, there are two possible action sequences for player 1 (pass or bet (bluffing or legitimately)) and two possible action sequences for player 2 (fold or call). In the example of FIG. 6, the action sequences consist of only a single action. In other games, action sequences may consist of multiple actions.

At step 920, the possible outcomes for each action choice are determined. For example, if P1 bets in the game of FIG. 6, the possible outcomes are that (i) P2 folds (P1 wins P/2); (ii) P2 calls and P1 wins showdown (P1 wins P/2+1); and (iii) P2 calls and P2 wins showdown (P1 loses P/2+1).

At step 920, a multidimensional model is created each dimension of which corresponds to an axis representing a hand strength of a player. For a two person game, an example of such a model is the two-dimensional area 720 shown in FIG. 7 consisting of player 1 and 2 hand strength axes 700 and 705 and dividing line 715. For a three-person game, a three dimensional model with three orthogonal axes is used.

At step 925, variables are assigned to dividing points representing hand strengths that trigger each action sequence for each player. Examples of these variables are the variables b1, B1 and C2 of the example of FIG. 8.

At step 930, a relative order is assigned to the variables. In the example of FIG. 8, the assigned order is B1>C2 >b1.

At step 935, the variables for each player are positioned on the axis representing that player's hand strength at arbitrary positions but in the assigned relative order. In the example of FIG. 8, b1 was placed on P1's axis at a hand strength smaller than the hand strength at which C2 was placed on P2's axis, which in turn was a value smaller than the hand strength at which B1 was placed on P1's axis.

At step 940, the model is divided into separate portions representing games with each of the possible outcomes. Examples of these portions are subregions 815, 820, 825, 830, 835, 840, 845, 850, 855 and 860 of FIG. 8.

At step 945, the return to a player for games in each portion are determined. Alternatively, these returns may be determined as part of determining the outcomes of the possible action sequences at step 915.

The size of each portion is determined at step 950. For a two-dimensional model (two players) the size of each portion is the area of the portion. For a three-dimensional model (three-players) the size of each portion is the volume of the portion.

At step 955, an expression for a player's expected return is generated by taking the sum of the products of the size of each portion multiplied by the return for games in each portion. Equation (1) is an example of such an expression.

At step 960, a set of simultaneous equations is generated by taking the partial derivative of the expected return expression generated in step 955 with respect to each action sequence triggering variable, and setting the result of each partial derivation equal to zero. Equations (2), (3) and (4) are examples of simultaneous equations generated according to step 960.

The resulting simultaneous equations are solved, either algebraically or numerically, at step 965, generating values for the action sequence triggering variables that define optimized card playing strategies for each player.

In certain embodiments, numerical hand strength values for the action sequence triggering variables obtained in step 965 are mapped to corresponding discrete card hands at step 975. In one embodiment, a sequence triggering variable is mapped to the discrete card hand having a hand ranking closest to the value obtained for the action sequence triggering variable. In other embodiments, a sequence triggering variable is mapped to the hand whose rank is immediately above or immediately below the value of the sequence triggering variable.

Two Player, One Round Game with Raising/No Check Raising

A second example of a game to which the method of the present invention may be applied is a modification to the two player, one round game of FIG. 6 in which raising, but not "check-raising", is allowed. "Check raising" is an action sequence in which, for example, player 1 initially checks or passes, player 2 bets, and then player 1 raises. In the present example, if player 1 checks, and player 2 bets, player 1 can only either fold or call. In addition, in this example game, only 2 raises (one by each player) are allowed per game.

Figure 10A:
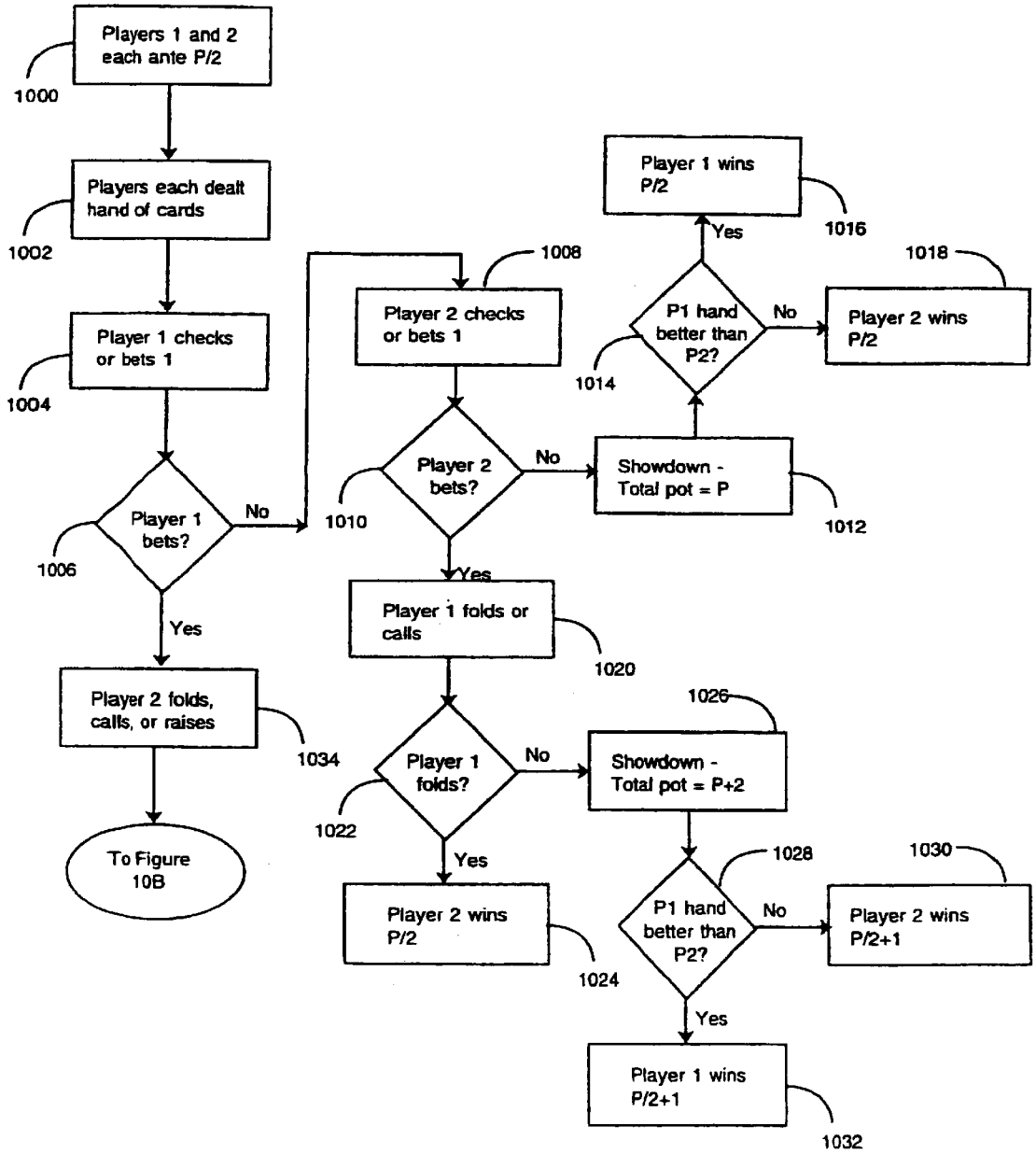
FIGS. 10A and 10B comprise a flow chart illustrating a sequence of events in a two-player, one round game with raising but no check-raising.
Figure 10B:
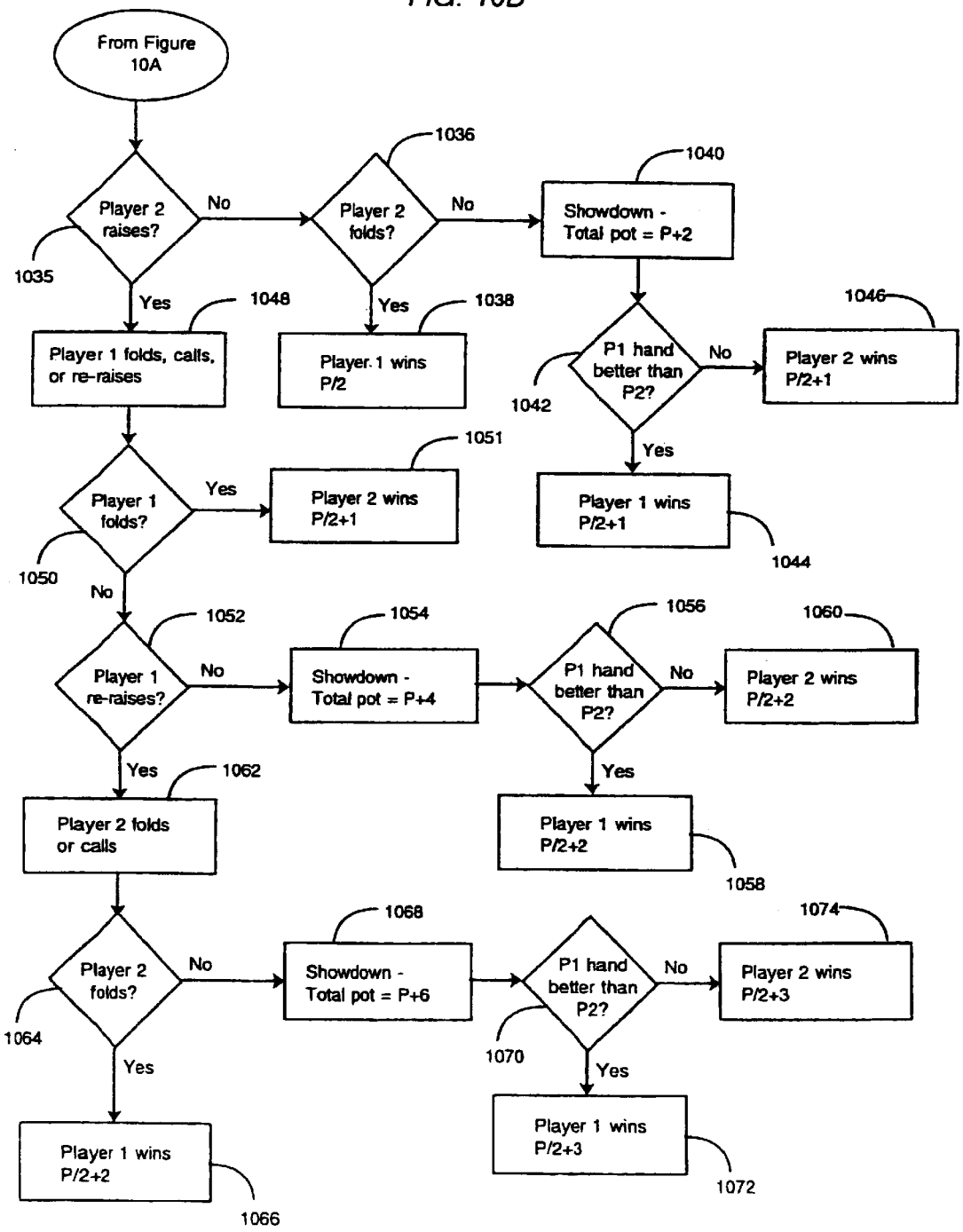

FIGS. 10A and 10B comprise a flow chart illustrating a sequence of events in a two-player, one round game with raising but no check-raising. As shown in FIG. 10A, the game starts at step 1000 with players 1 and 2 each paying an ante of P/2 (for a total ante of P). At step 1002, each player is dealt a hand of cards. At step 1004, player 1 (P1) checks (passes) or bets one. At step 1006, a determination is made as to whether P1 has bet or checked. If P1 has checked (not bet), player 2 (P2) may either check or bet 1 at step 1008. At step 1010, a determination is made as to whether P2 has checked or bet. If P2 has checked (not bet), there is a showdown at step 1012. The pot at this showdown contains only the total ante, P. At step 1014, a determination is made as to whether P1's hand is better than P2's. If P1's hand is better, P1 wins P/2 (total pot of P minus P1's investment of P/2) at step 1016. If P2's hand is better than P1's, P2 wins P/2 at step 1018.

If P2 bets instead of checks at step 1008, P1 may fold or call at block 1020. Because check raising is not allowed in this game, P1 may not raise here. At step 1022, a determination is made as to whether P1 folds. If P1 does fold, P2 wins P/2 at step 1024 (total pot of P+1 minus P2's investment of P/2+1).

If P1 calls (by putting a bet of 1 into the pot to match P2's bet) at step 1020, there is a showdown at step 1026. The total pot at this point is P+2 (each player has ante'd P/2 and bet one). At step 1028, a determination is made as to whether P1's hand is better than P2's. If P1's hand is better, P1 wins P/2+1 (total pot of P+2 minus P1's investment of P/2+1) at step 1032. If P2's hand is better, P2 wins P/2+1 at step 1030.

If P1 bets one instead of checking at step 1004, P2 may either fold, call, or raise at step 1034. From step 1034, the flow chart continues in FIG. 10B.

Referring to FIG. 10B, at steps 1035 and 1036, a determination is made as to whether P2 folds, calls, or raises at step 1032. If P2 folds, P1 wins P/2 (total ante of P plus P1's bet of one minus P1's investment of P/2+1) at step 1038. If P2 calls (by placing a bet of one into the pot to match P1's bet of one), there is a showdown at step 1040. At this point, the total pot is P+2 (total ante of P plus a bet of one by each of P1 and P2). At step 1042, a determination is made as to whether P1's hand is better than P2's. If P1's hand is better, P1 wins P/2+1 (total pot of P+2 minus P1's investment of P/2+1) at step 1044. If P2's hand is better, P2 wins P/2+1 at step 1046.

If P2 raises at block 1032 (by placing a total bet of two into the pot: one bet to match P1's bet of one and one bet to raise) P1 may either fold, call, or reraise at step 1048. At steps 1050 and 1052, a determination is made as to whether P1 folds, calls, or raises at step 1048. If P1 folds, P2 wins P/2+1 (total ante of P plus P1's bet of one plus P2's bet of two minus P2's investment of P/2+2) at step 1051.

If P1 calls (by placing a bet of one into the pot to match P2's raise of one) at step 1048, there is a showdown at step 1054. At this point, the total pot is P+4 (each player has ante'd P/2 and bet two). At step 1056, a determination is made as to whether P1's hand is better than P2's. If P1's hand is better, P1 wins P/2+2 (total pot of P+4 minus P1's investment of P/2+2) at step 1058. If P2's hand is better, P2 wins P/2+2 at step 1060.

If P1 reraises (by placing a total bet of two into the pot: one to match P2's raise of one and one to reraise by one) at step 1048, P2 may either fold or call at step 1062. At step 1064, a determination is made as to whether P2 folds or calls. If P2 folds, P1 wins P/2+2 (total ante of P plus P1's total bet of three plus P2's total bet of two minus P1's investment of P/2+3) at step 1066.

If P2 calls (by placing a bet of one into the pot to match P1's reraise) at step 1062, there is a showdown at step 1068. At this point, the total pot is P+6 (each player has ante'd P/2 and bet three). At step 1070, a determination is made as to whether P1's hand is better than P2's. If P1's hand is better, P1 wins P/2+3 (total pot of P+6 minus P1's investment of P/2+3) at step 1072. If P2's hand is better, P2 wins P/2+3 at step 1074.

The method of FIG. 9 may be applied to the game of FIGS. 10A and B as follows.

According to step 910 of FIG. 9, the possible action sequences of each player are determined for the game of FIGS. 10A and 10B. These action sequences may be obtained by following the flow chart from step 1000 to each of the different resolutions of the game and noting the actions that each player takes leading to each resolution.

In FIGS. 10A and 10B, the resolutions that occur consist of either a player folding (with the result that the other player wins) or a showdown (with the result that the player with the better hand wins). In the game of FIGS. 10A and 10B, a resolution by folding occurs at steps 1024, 1038, 1051, and 1066. A resolution by showdown occurs at steps 1012, 1026, 1040, 1054, and 1068.

The action sequences for each player that lead to the resolution by folding 2 at step 1024 are: (i) P1 checks, then folds; and (ii) P2 bets. For the resolution by folding at step 1038, the action sequences are: (i) P1 bets; and (ii) P2 folds. For the resolution by folding at step 1051, the action sequences are: (i) P1 bets, then folds; and (ii) P2 raises. For the resolution by folding at step 1066, the action sequences are: (i) P1 bets, then reraises; and (ii) P2 raises, then folds.

The action sequences for each player leading to the showdown at step 1012 are: (i) P1 checks; and (ii) P2 checks. The action sequences leading to the showdown at step 1026 are: (i) P1 checks, then calls; and (ii) P2 bets. The action sequences leading to the showdown at step 1040 are: (i) P1 bets; and (ii) P2 calls.

The action sequences leading to the showdown at step 1054 are: (i) P1 bets, then calls; and (ii) P2 raises. The action sequences leading to the showdown at step 1068 are: (i) P1 bets, then reraises; and (ii) P2 raises, then calls.

The possible action sequences for each player and the resulting outcomes obtained according to steps 910 and 915 of FIG. 9 for the game of FIGS. 10A and 10B are summarized in Table 10. In Table 10, the equivalent term "pass" is used instead of "check."

TABLE 10

Action Sequences and Outcomes

| Resolution Step | P1 Action Seq. | P2 Action Sq. | Outcome |
|---|---|---|---|
| By folding | | | |
| 1024 | pass-fold | bet | P2 win P/2 |
| 1038 | bet | fold | P1 wins P/2 |
| 1051 | bet-fold | raise | P2 wins P/2 + 1 |
| 1066 | bet-reraise | raise-fold | P1 wins P/2 + 2 |
| By showdown | | | |
| 1012 | pass | pass | High hand wins P/2 |
| 1026 | pass-call | bet | High hand wins P/2 + 1 |
| 1040 | bet | call | High hand win P/2 + 1 |
| 1054 | bet-call | raise | High hand wins P/2 + 2 |
| 1068 | bet-reraise | raise-call | High hand wins P/2 + 3 |

Figure 11:
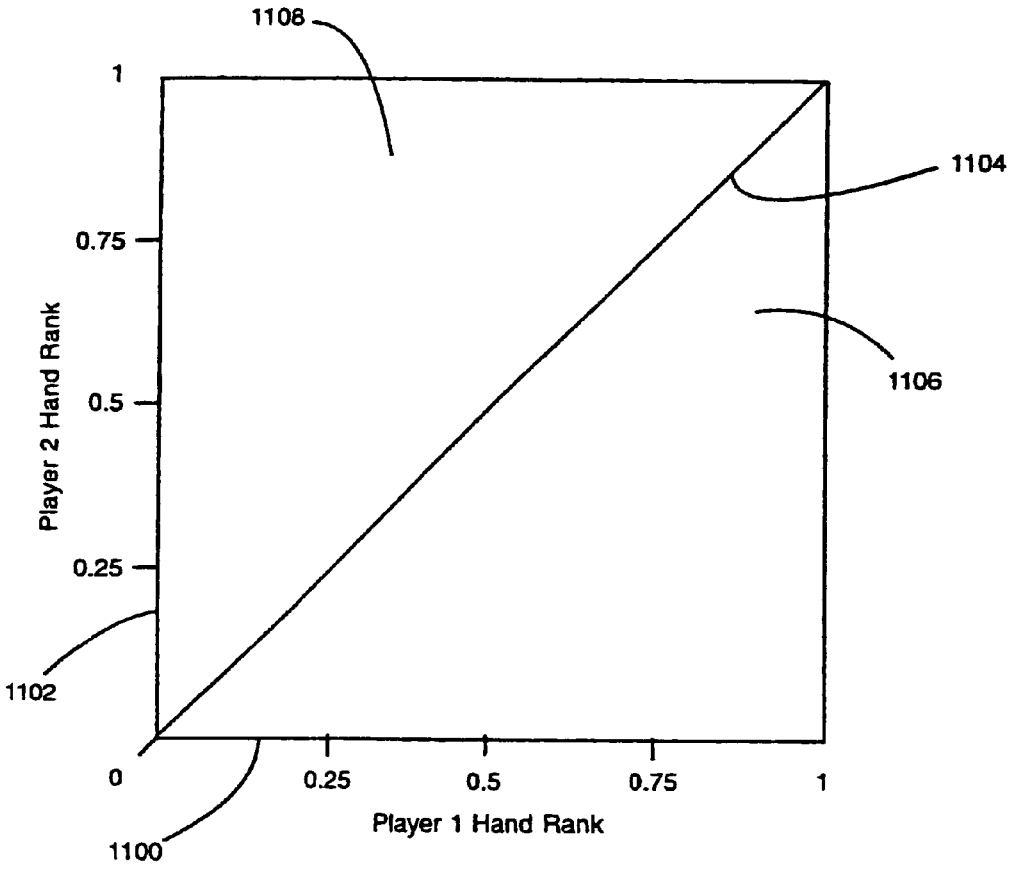
FIG. 11 is an example of a two-dimensional model of the present invention.

At step 920 in FIG. 9, a model is constructed comprising an axis representing the hand strength of each of P1 and P2. This model is shown in FIG. 11. The model includes hand strength axes 1100 and 1102 for P1 and P2, respectively, and dividing line 1104 that separates the model into region 1106 in representing games in which P1's hands are better than P2's and region 1108 representing games in which P2's hands are better than P1's.

According to step 925 in FIG. 9, variables are assigned to dividing points representing hand strength thresholds that trigger each of the action sequences for each player identified in step 910. Looking first at P1, as shown in Table 10, the possible action sequences for P1 are pass, pass-fold, or pass-call, and bet, bet-fold, bet-call or bet-reraise.

Figure 12:
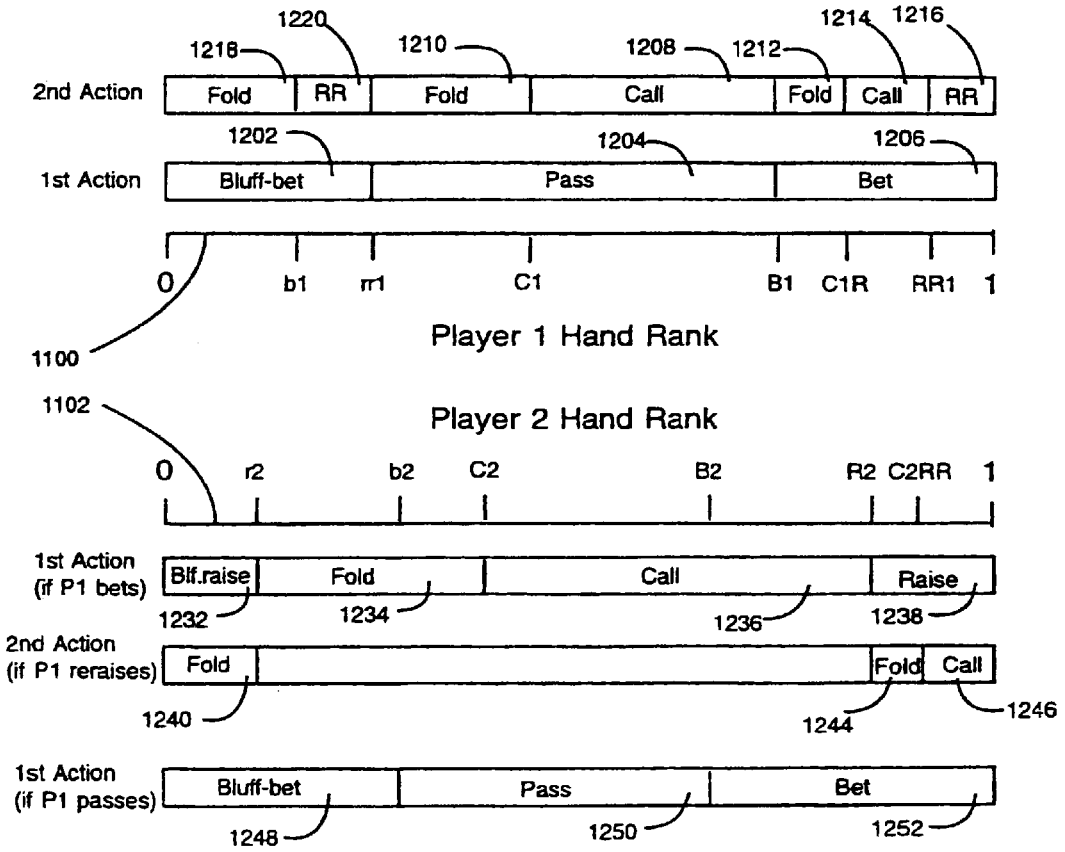
FIG. 12 illustrates action sequences corresponding to different hand ranks in one embodiment of the invention.

P1's first action choice is to pass or bet (either legitimately or as a bluff-bet). A first variable, for example "B1," is assigned to the hand strength that is the lowest hand strength with which P1 will bet legitimately. A second variable, for example "rr1," is assigned to the highest hand strength with which P1 will bluff bet. FIG. 12 shows P1's hand strength axis 1100 from FIG. 11. As shown in FIG. 12, variable B1 is initially placed at a location towards the high end of axis 1100, and variable rr1 is placed at a location towards the low end of axis 1100. As shown in FIG. 12, the hands 1202 between zero and rr1 represent hands with which P1 bluff-bets. The hands 1204 between rr1 and B1 represent hands with which P1 passes (or checks). The hands 1206 between B1 and 1 represent hands with which P1 bets.

P1's second action choices depend on P1's first action choice, and in certain cases also on P2's first action choice.

If P1's first action is to pass, a second action choice for P1 arises only if P2's first action is to bet (if P2's first action after a pass by P1 is to check, there is an immediate showdown. P1 has no further action choices). In this situation, P1's second action choice is to fold or call. If P1 calls, P1 may call either with the intention of beating a legitimate bet by P2 or to call a potential bluff-bet by P2.

Using the method of the invention, a variable, for example "C1," is assigned to the lowest of P1's passing hands 1204 with which P1 will call. As shown in FIG. 12, the hands 1210 between b1 and C1 represent the portion of P1's passing hands with which P1 will fold, while the hands 1208 between C1 and B1 represent the portion of P1's passing hands 1204 with which P1 will call (the upper part of this portion represents hands with which P1 calls with the intent of beating a legitimate bet by P2, while the lower part represents hand with which P1 calls to beat a potential bluff-bet by P2). The interval between b1 and C1 thus represents hands that trigger a "pass-fold" action sequence, while the interval between C1 and B1 represents hands that trigger a "pass-call" action sequence.

If P1's first action is to bet, a second action choice for P1 arises only if P2 raises. (If P2 folds or calls, there is an immediate resolution: P1 wins if P2 folds, or there is a showdown if P2 calls). In this situation, P1 may fold, call, or reraise. Further, if P1 reraises, P1 may legitimately reraise or bluff-reraise.

According to the invention, a variable, for example "C1R," is assigned to the lowest of P1's legitimate betting hands 1206 with which P1 will call a raise by P2, while another variable, for example "RR1," is assigned to the lowest of P1's betting hands 1206 with which P1 will reraise a raise by P2. In this example, it is assumed that P1 will reraise with better hands than hands with which P1 calls. As shown in FIG. 12, the variables C1R and RR1 are placed on P1's hand strength axis 1100 within the interval 1206 representing P1's betting hands such that RR1>C1R. Accordingly hands 1212 between B1 and C1R represent hands that trigger a "bet-fold" sequence. Hands 1214 between C1R and RR1 represent hands that trigger a "bet-call" sequence. Hands 1216 between RR1 and 1 represent hands that trigger a "bet-reraise" sequence.

With respect to P1's bluff-betting hands 1202, P1 will also reraise with a portion of these hands and fold with the remainder. In this embodiments it is assumed that P1 bluff-reraises with the higher of P1's bluff-betting hands. In other embodiments, it is assumed that P1 bluff-reraises with the lower, or some other portion, of P1's bluff-betting hands.

A variable, for example "b1," is assigned to the lowest of P1's bluff-betting hands 1202 with which P1 will bluff-reraise. As shown in FIG. 12, hands 1218 between 0 and b1 accordingly represent hands that trigger a "(bluff) bet-fold" sequence, while hands 1220 between b1 and rr1 represent hands that trigger a "(bluff) bet-reraise" sequence.

Turning to P2, P2's action choices depend on whether P1's first action choice is to pass or to bet. If P1's first action choice is to bet, P2 may either fold, call, or raise. When P2 raises, P2 may either legitimately raise or bluff-raise. According to the invention, a first variable, for example "R2," is assigned to the lowest ranking hand with which P2 will legitimately raise if P1's first action is to bet. A second variable, for example "C2," is assigned to the lowest ranking hand with which P2 will call if P1's first action is to bet. A third variable, for example "r2," is assigned to the highest ranking hand with which P2 will bluff-raise. As shown in FIG. 6, these variables are assigned to relative positions on P2's hand rank axis 1102 in FIG. 12 such that R2>C2>r2. Accordingly, hands 1232 between 0 and r2 represent hands with which P2 bluff raises if P1 bets. Hands 1234 between r2 and C2 represent hands with which P2 folds if P1 bets. Hands 1236 between C2 and R2 represent hands with which P2 calls if P1 bets. Hands 1238 between R2 and 1 represent hands with which R2 raises if P1 bets.

P2 will have second action choices only for the case where P1 bets, P2 raises (bluff or legitimate), and P1 reraises. For all other cases, there will be an immediate resolution, either by folding or showdown, after P2's first action. Thus P2's second action choices are limited to those hands 1232 and 1238 with which P2 initially raised after P1 bet. P2's choices for these hands is to either fold or call (since P2 has already raised once, no further raising by P2 is allowed). P2 has little chance of winning a showdown with the hands 1232 with which P2 bluff-raised. So P2 folds with these hands if P1 reraises. P2 will call P1's reraise with the better of P2's legitimate raising hands 1238. According to the invention, a variable, for example "C2RR," is assigned to the lowest of P2's raising hands 1238 with which P2 will call a reraise by P1. As shown in FIG. 12, hands 1240 and 1244 between 0 and r2, and R2 and C2RR, respectively, represent hands with which P2 initially raises if P1 bets and folds if P1 reraises. These hands therefore represent a "raise-fold" action sequence. Hands 1246 between C2RR and 1 represent hands with which P2 initially raises if P1 bets and calls if P1 reraises. These hands therefore represent a "raise-call" action sequence.

If P1's first action choice is to pass, P2's action choices are either to pass or to bet (legitimately and as a bluff). According to the invention, a first variable, for example "b2," is assigned to the highest ranking hand with which P2 will bluff bet after P1 passes. A second variable, for example "B2," is assigned to the lowest ranking hand with which P2 will legitimately bet. As shown in FIG. 12, b2 is placed on P2's hand rank axis 1102 between r2 and C2, while B2 is placed between C2 and R2. Hands 1248 between 0 and b2 thus represent hands with which P2 will bluff bet if P1 passes. Hands 1250 between b2 and B2 represent hands with which P2 will pass if P1 passes. Hands 1252 represent hands with which P2 will legitimately bet if P1 passes.

According to step 930, a relative order is assigned to the variables assigned to the hand strengths that trigger the different action sequences for each of P1 and P2. During the assignment process described above for assigning the variables shown on FIG. 12, the relative orders for the variables for P1 and the relative order for the variables for P2 were already determined. The relative order of the variables for P1 and P2 with respect to each other must also be determined. For the example embodiment of FIG. 12, the relative order for all variables is: 0<r2<b1<rr1<b2<C2<=C1<B2<B1<C1R<R2<C2RR<RR1.

Figure 13:
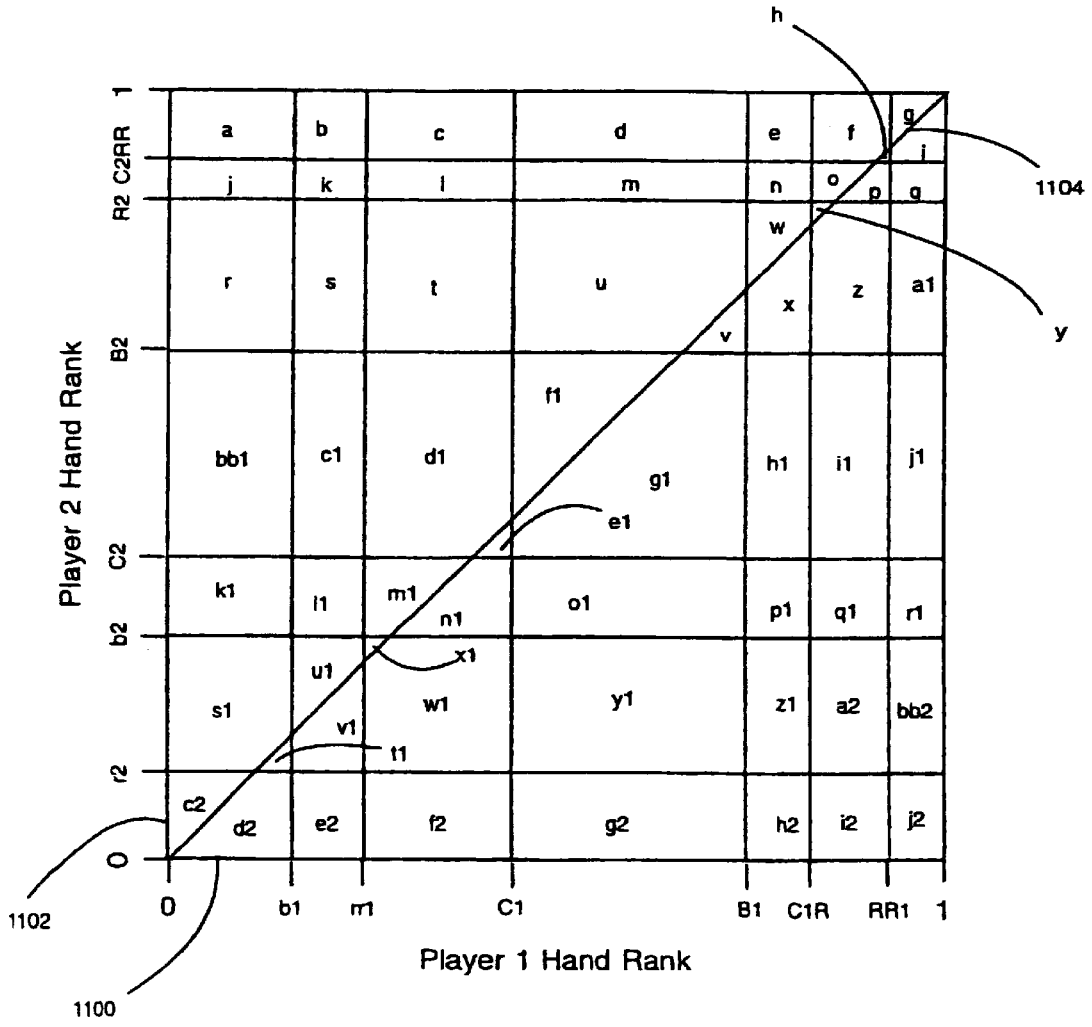
FIG. 13 shows the model of FIG. 11 divided into regions using the action sequence triggering variables of FIG. 12.

According to step 935 of FIG. 9, the variables are located on the respective axes of P1 and P2 in arbitrary positions in the assigned relative order. FIG. 13 shows the respective variables for P1 and P2 assigned to their respective axes 1100 and 1102 in the assigned relative order.

According to steps 940,945, and 950 of FIG. 9, the model is divided into separate portions representing each of the possible outcomes, and the size and the return to a player for each outcome region is determined.

In this example, steps 940–950 are performed as follows. First, the model of FIG. 13 is divided into regions as shown in FIG. 13 by drawing lines perpendicular to each axis 1100 and 1102 at each variable location. The resulting regions are identified in FIG. 13 by the letters a–z, a1, bb1, c1–z1, a2, bb2, and c2–j2, respectively.

Next, the regions representing each outcome listed in Table 10 are identified using the action triggering intervals shown in FIG. 12.

Figure 14:
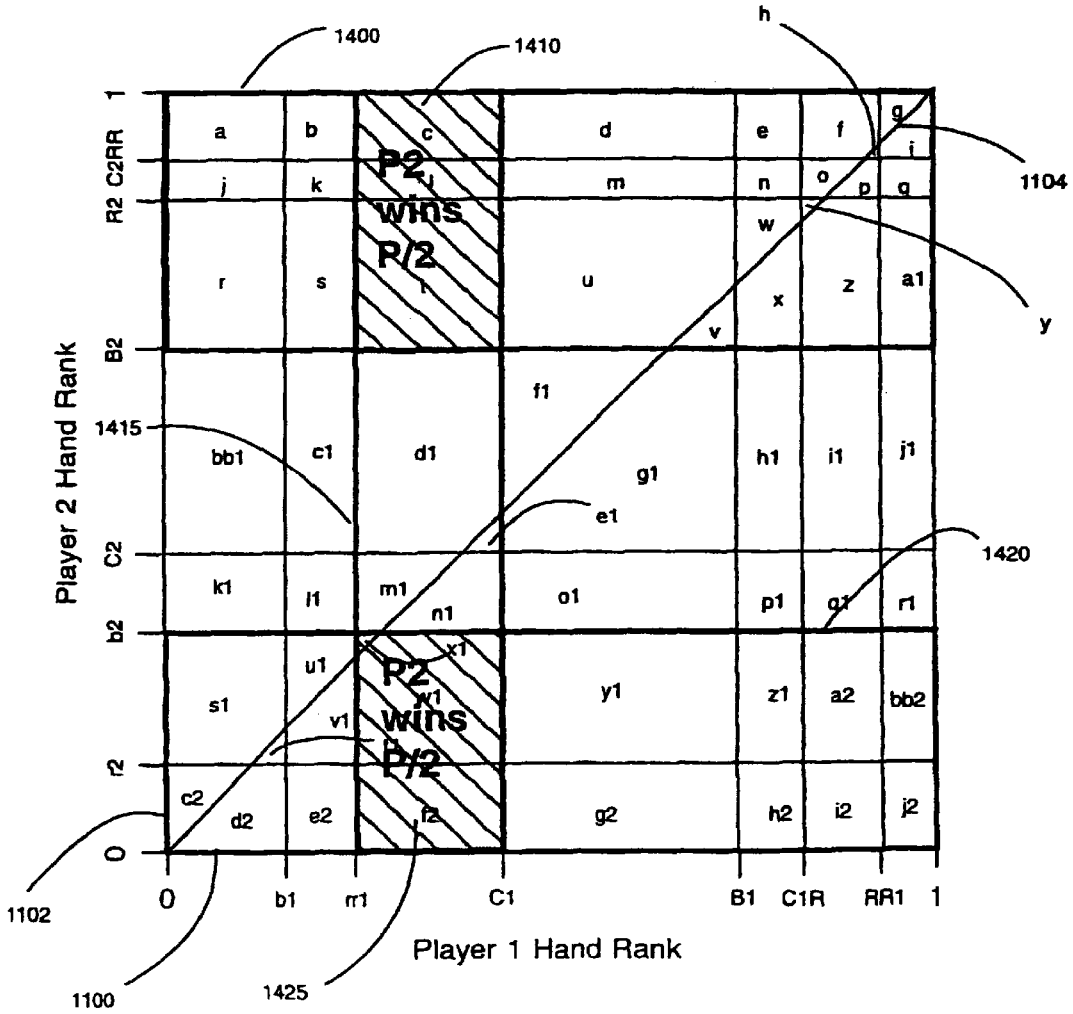
FIG. 14 illustrates games in the model of FIG. 13 that correspond to resolution step 1024 of Table 10.

The first outcome listed in Table 10 occurs at resolution step 1024 for games in which P1 pass-folds and P2 bets. Referring to FIG. 12, P1 pass-folds with hands 1210 between rr1 and C1. These hands are indicated by rectangle 1415 in FIG. 14. P2's betting hands, after P1 passes, according to FIG. 12, are bluff-bet hands 1248 between 0 and b2 (indicated by rectangle 1420 in FIG. 14) and legitimate betting hands 1252 between B2 and 1 (indicated by rectangle 1400 in FIG. 14). The games for which P1 pass-folds and P2 bets are indicated in FIG. 14 by the rectangles 1410 and 1425 formed where rectangle 1415 intersects with rectangles 1400 and 1420. According to Table 10, and as indicated in FIG. 14, P2 wins P/2 for the games in rectangles 1410 and 1425. The return to P1 in rectangles 1410 and 1425 is thus −P/2. The expected return to P1 ("E1") due to games resolved at step 1024 is the area of rectangles 1410 and 1425 multiplied by −P/2:

$$E1_{1024} = -\frac{P}{2}[(C1 - rr1)(b2) + (C1 - rr1)(1 - B2)]$$

Figure 15:
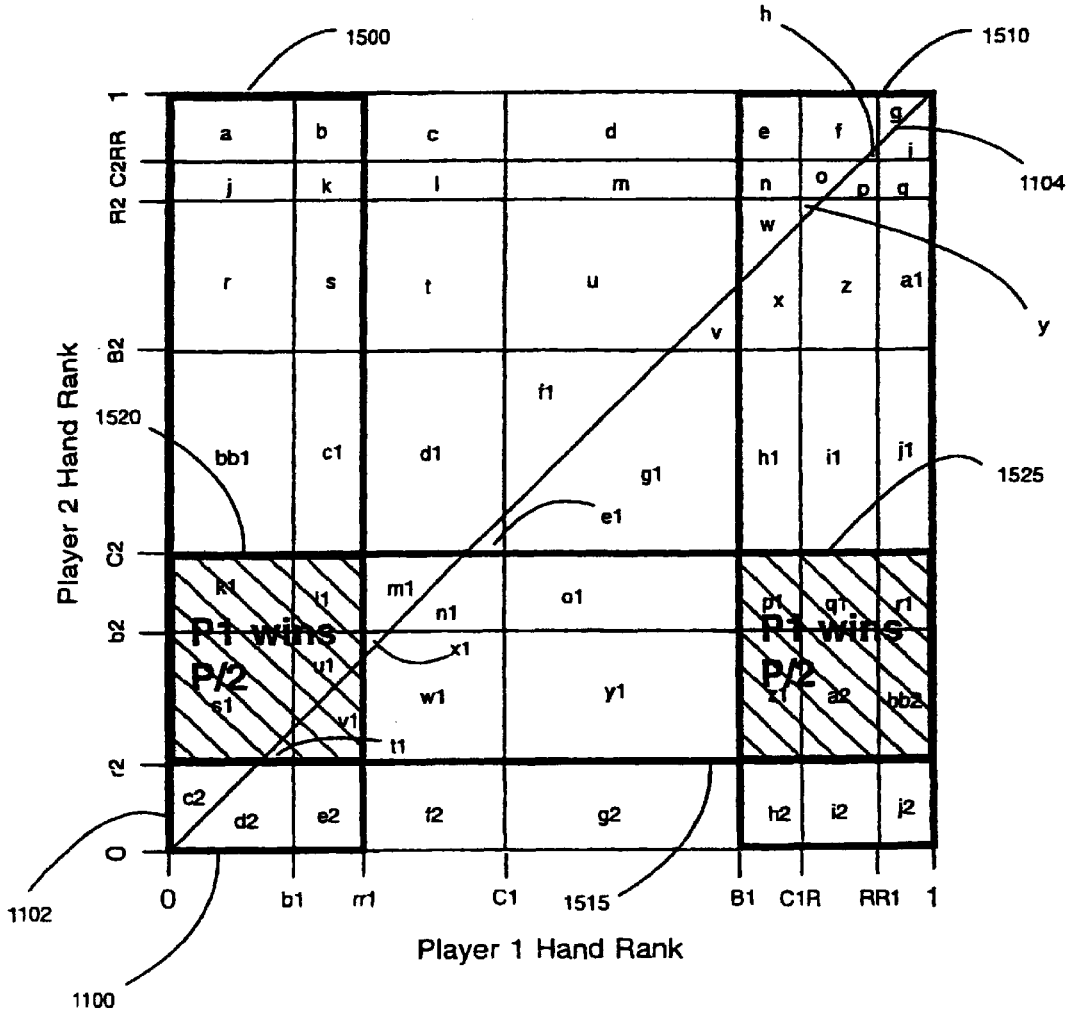
FIG. 15 illustrates games in the model of FIG. 13 that correspond to resolution step 1038 of Table 10.

The second outcome listed in Table 10 occurs at resolution step 1038 for games in which P1 bets and P2 folds. Referring to FIG. 12, P1 bluff-bets with hands 1202 between 0 and rr1 (indicated by rectangle 1500 in FIG. 15) and legitimately bets with hands 1206 between B1 and 1 (indicated by rectangle 1510 in FIG. 15). P2's folding hands, after P1 bets, according to FIG. 12, are hands 1234 between r2 and C2 (indicated by rectangle 1515 in FIG. 15). The games for which P1 bets and P2 folds are indicated in FIG. 15 by rectangles 1520 and 1525 formed where rectangle 1515 intersects with rectangles 1500 and 1510, respectively. According to Table 10, and as indicated in FIG. 15, P1 wins P/2 for the games in rectangles 1520 and 1525. The expected return to P1 due to games resolved at step 1038 is the area of rectangles 1520 and 1525 multiplied by P/2:

$$E1_{1038} = \frac{P}{2}[rr1(C2 - r2) + (1 - B1)(C2 - r2)]$$

Figure 16:
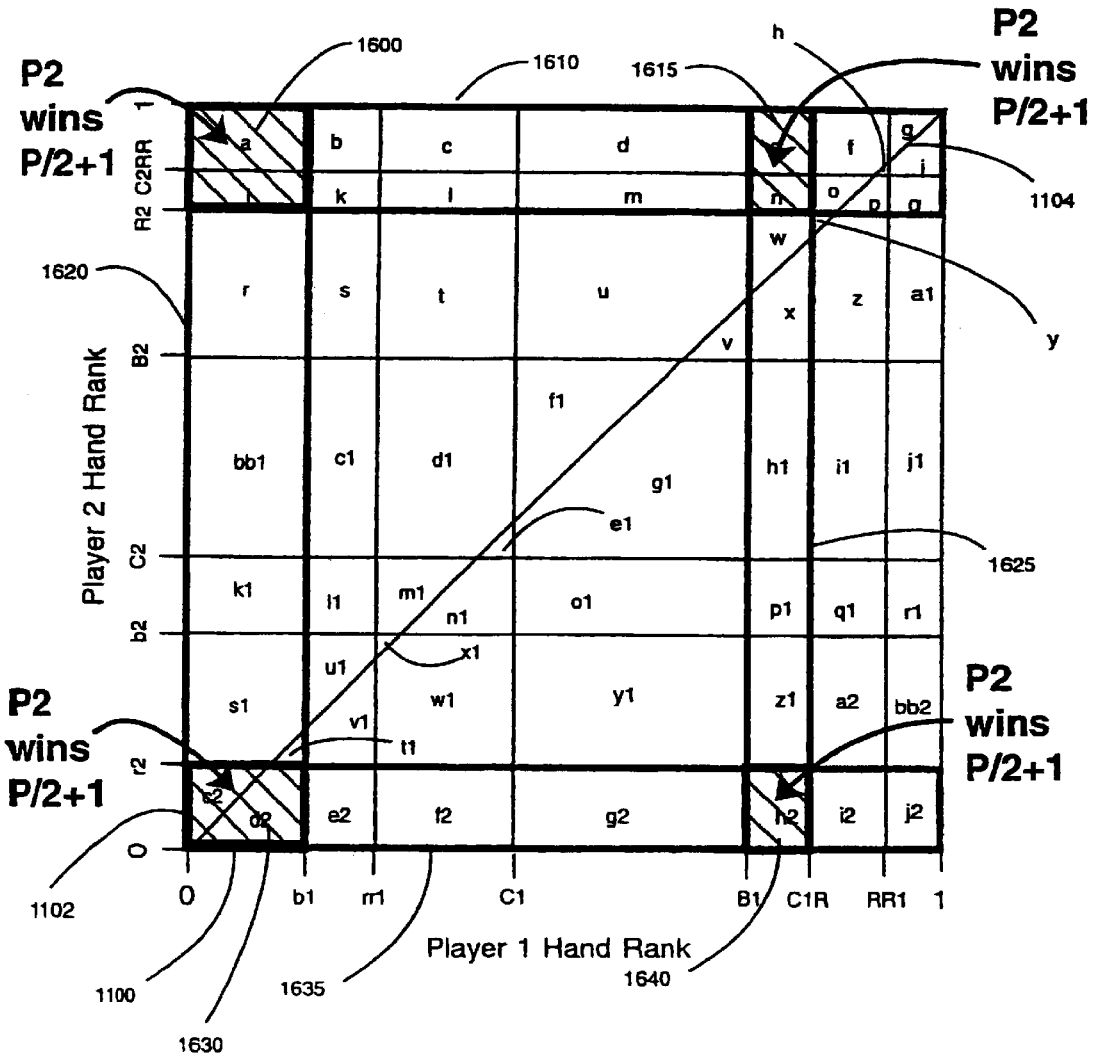
FIG. 16 illustrates games in the model of FIG. 13 that correspond to resolution step 1051 of Table 10.

The third outcome listed in Table 10 occurs at resolution step 1051 for games in which P1 bet-folds and P2 raises. Referring to FIG. 12, P1 bet-folds with hands 1218 between 0 and b1 (indicated by rectangle 1620 in FIG. 16) and with hands 1212 between B1 and C1R (indicated by rectangle 1625 in FIG. 16). P2 raises, after P1 bets, with hands 1232 between 0 and r2 (indicated by rectangle 1635 in FIG. 16) and with hands 1238 between R2 and 1. The games in which P1 bet-folds and P2 raises are indicated in FIG. 16 by rectangles 1600, 1615, 1630 and 1640. According to Table 10, and as indicated in FIG. 16, P2 wins (P1 loses) P/2+1 for games in rectangles 1600, 1615, 1630 and 1640. The expected return to P1 due to games resolved at step 1051 is the area of rectangles 1600, 1615, 1630 and 1640 multiplied by −(P/2+1):

$$EI_{1051} = -\left(\frac{P}{2}+1\right)[(bI)(1-R2)+(C1R-B1)(1-R2)+(b1)(r2)+(C1R-B1)(r2)]$$

Figure 17:
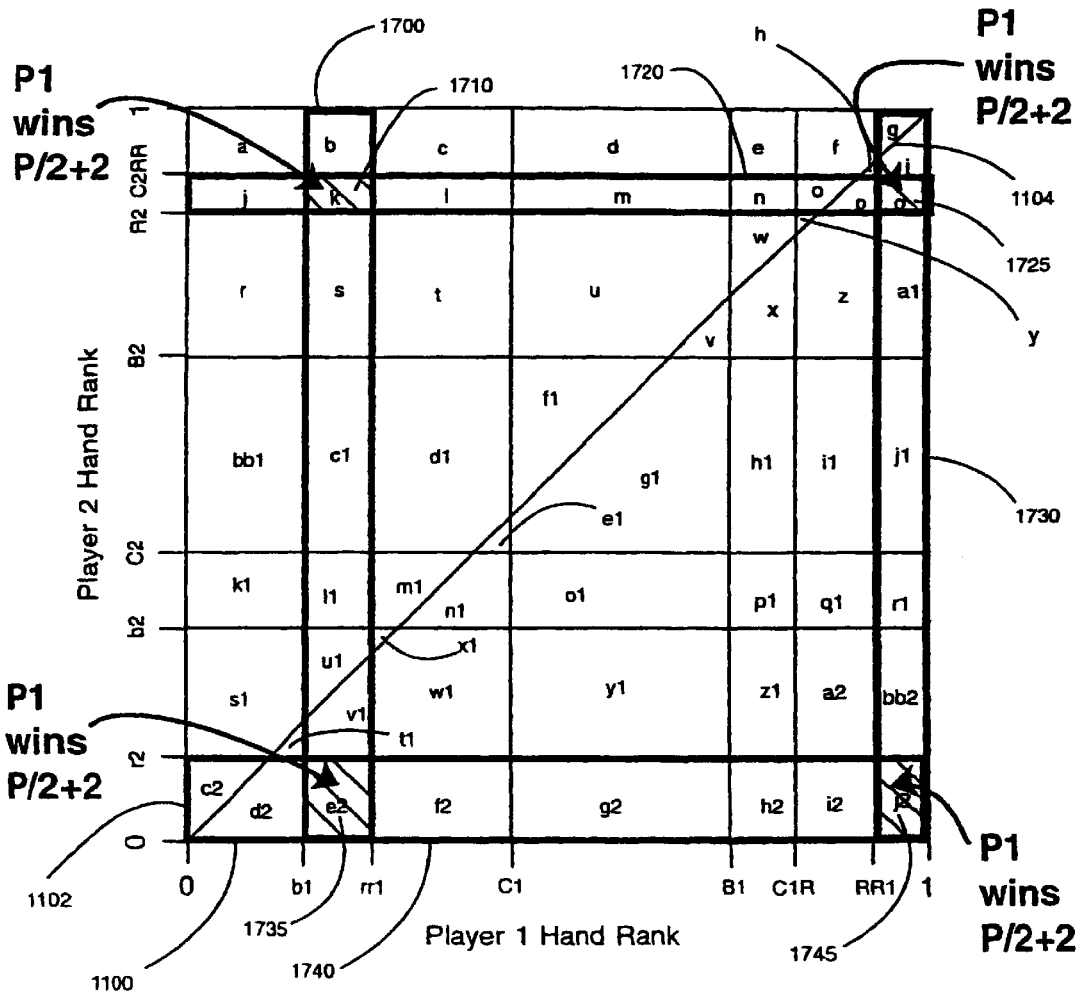
FIG. 17 illustrates games in the model of FIG. 13 that correspond to resolution step 1066 of Table 10.

The fourth outcome listed in Table 10 occurs at resolution step 1066 for games in which P1 bet-reraises and P2 raise-folds. Referring to FIG. 12, P1 bet-reraises with hands 1220 between b1 and rr1 (indicated by rectangle 1700 in FIG. 17) and with hands 1216 between RR1 and 1 (indicated by rectangle 1730 in FIG. 17). P2 raise-folds with hands 1240 between 0 and r2 (indicated by rectangle 1740 in FIG. 17) and with hands 1244 between R2 and C2RR. The games in which P1 bet-reraises and P2 raise-folds are indicated in FIG. 17 by rectangles 1710, 1725, 1735 and 1745. According to Table 10, and as indicated in FIG. 17, P1 wins P/2+2 for games in rectangles 1710, 1725, 1735 and 1745. The expected return to P1 due to games resolved at step 1066 is the area of rectangles 1710, 1725, 1735 and 1745 multiplied by P/2+2:

$$EI_{1066} = \left(\frac{P}{2}+2\right)[(rr1-b1)(C2RR-R2)+(1-RR1)(C2RR-R2)+(rr1-b1)(r2)+(1-RR1)(r2)]$$

Figure 18:
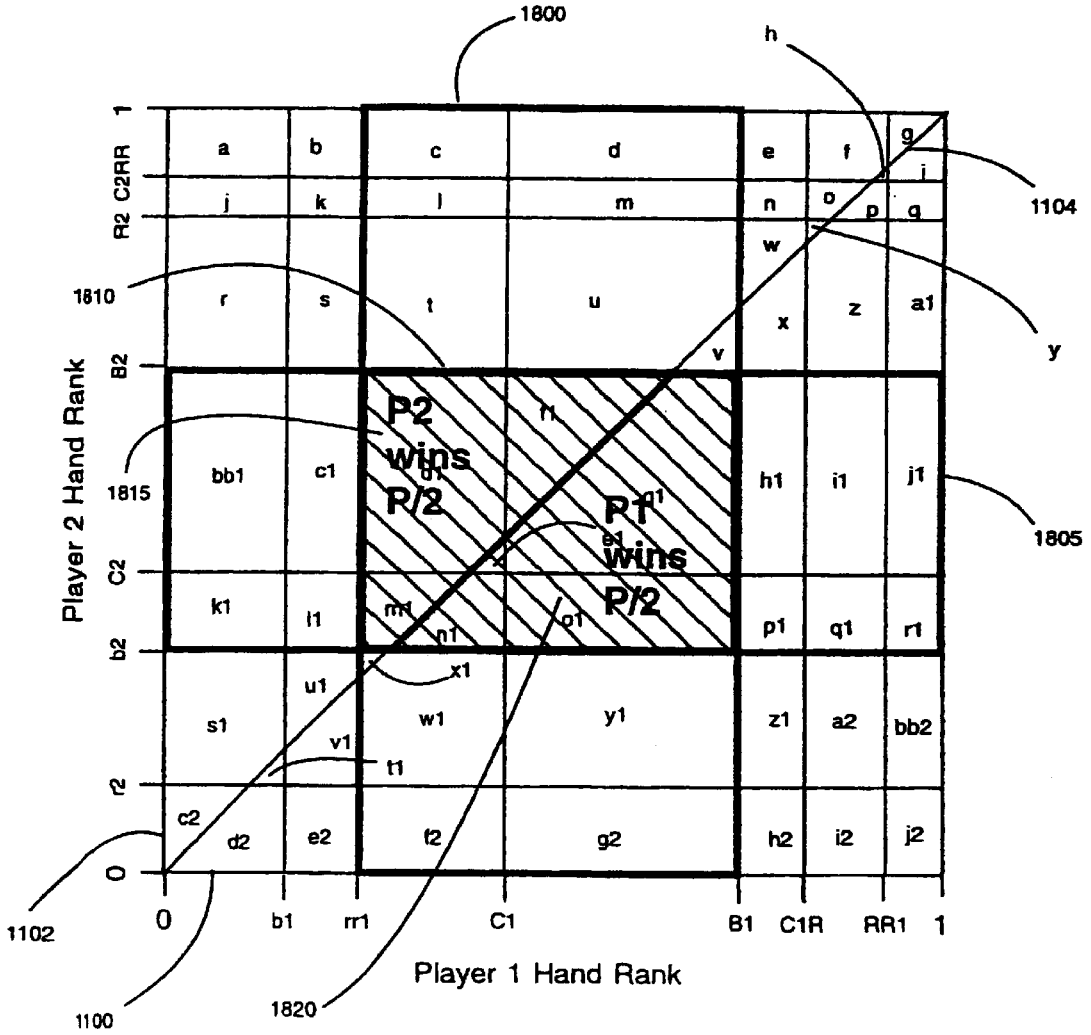
FIG. 18 illustrates games in the model of FIG. 13 that correspond to resolution step 1012 of Table 10.

The fifth outcome listed in Table 10 occurs at resolution step 1012 for games in which P1 passes and P2 passes. Referring to FIG. 12, P1 passes with hands 1204 between rr1 and B1 (indicated by rectangle 1800 in FIG. 18). P2 passes, after P1 passes, with hands 1250 between b2 and B2 (indicated by rectangle 1805 in FIG. 18). The games in which P1 passes and P2 passes are indicated in FIG. 18 by rectangle 1810. According to Table 10, the player with the higher hand wins P/2 for games in rectangle 1810. In FIG. 18, P2 has the higher hand for games above dividing line 1104, and P1 has the higher hands below dividing line 1104. P2 wins (P1 loses) P/2 in portion 1815 of rectangle 1810 that includes regions d1, f1 and m1. P1 wins P/2 in the remaining portion 1820 of rectangle 1810 that includes regions e1, g1, n1 and o1. The expected return to P1 due to games resolved at step 1012 is the area of portion 1815 of rectangle 1810 multiplied by −(P/2) plus the area of portion 1820 of rectangle 1810 multiplied by P/2:

$$EI_{1012} = -\left(\frac{P}{2}\right)\left[(b2-rr1)(B2-b2)+\frac{(B2-b2)^2}{2}\right]+\frac{P}{2}\left[(B1-B2)(B2-b2)+\frac{(B2-b2)^2}{2}\right]$$

Figure 19:
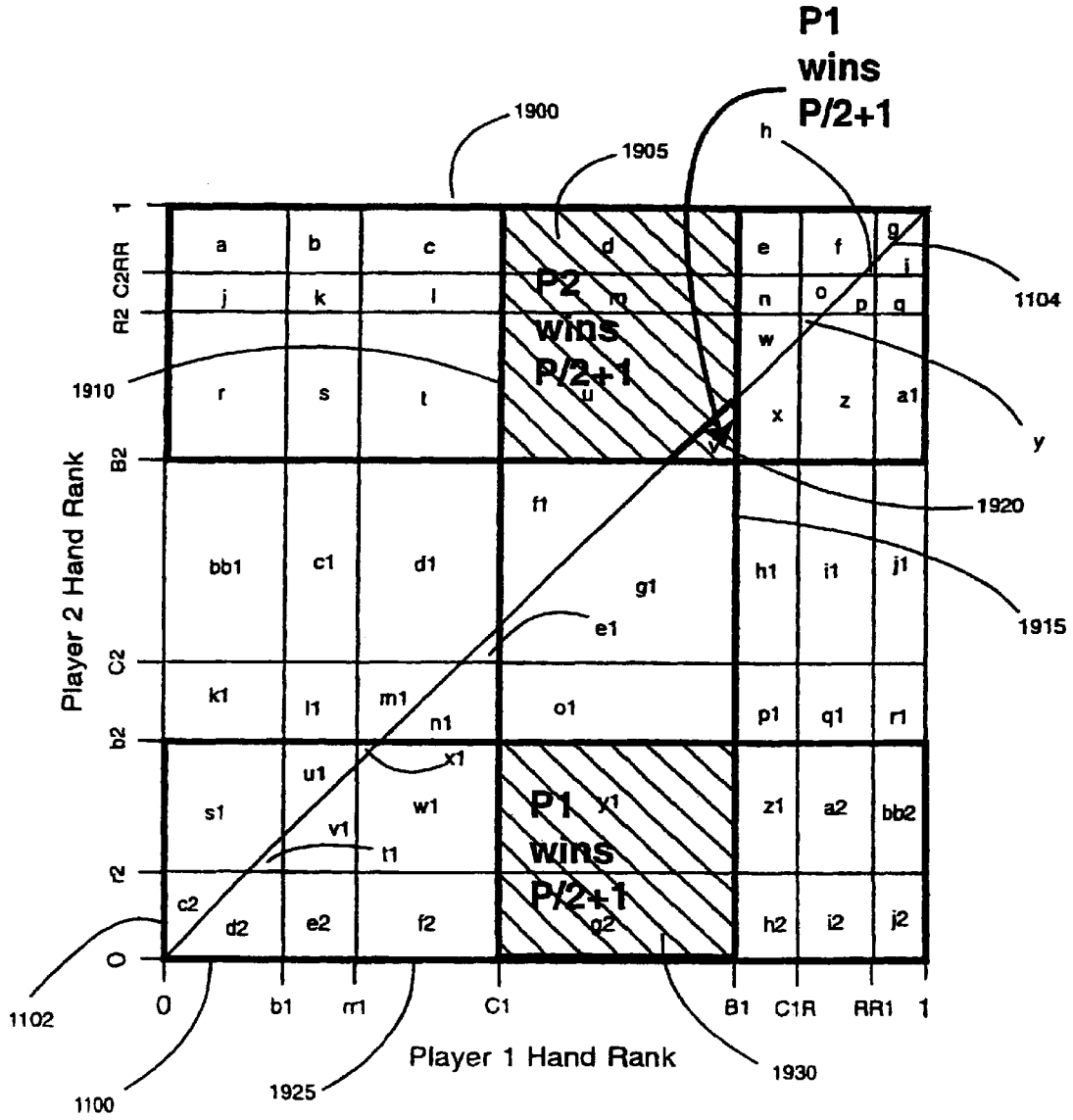
FIG. 19 illustrates games in the model of FIG. 13 that correspond to resolution step 1026 of Table 10.

The sixth outcome listed in Table 10 occurs at resolution step 1026 for games in which P1 pass-calls and P2 bets. Referring to FIG. 12, P1 pass-calls with hands 1208 between C1 and B1 (indicated by rectangle 1915 in FIG. 19). P2 bets, after P1 passes, with hands 1248 between 0 and b2 (indicated by rectangle 1925 in FIG. 19) and hands 1252 between B2 and 1 (indicated by rectangle 1900 in FIG. 19). The games in which P1 pass-calls and P2 bets are indicated in FIG. 19 by rectangles 1910 and 1930. According to Table 10, the player with the higher hand wins P/2+1 for games in rectangles 1910 and 1930. In FIG. 19, P2 has the higher hand for games above dividing line 1104, and P1 has the higher hands below dividing line 1104. P2 wins (P1 loses) P/2+1 in portion 1905 of rectangle 1910 that includes regions d, m and u. P1 wins P/2+1 in the remaining portion 1920 of rectangle 1910 that includes region v and in all of rectangle 1930. The expected return to P1 due to games resolved at step 1026 is the area of portion 1905 of rectangle 1910 multiplied by −(P/2+1) plus the area of portion 1920 of rectangle 1910 multiplied by P/2+1 plus the area of rectangle 1930 multiplied by P/2+1:

$$EI_{1026} = -\left(\frac{P}{2}+1\right)\left[(B1-C1)(1-B2)-\frac{(B1-B2)^2}{2}\right]+\left(\frac{P}{2}+1\right)\left[\frac{(B1-B2)^2}{2}+(B1-C1)(b2)\right]$$

Figure 20:
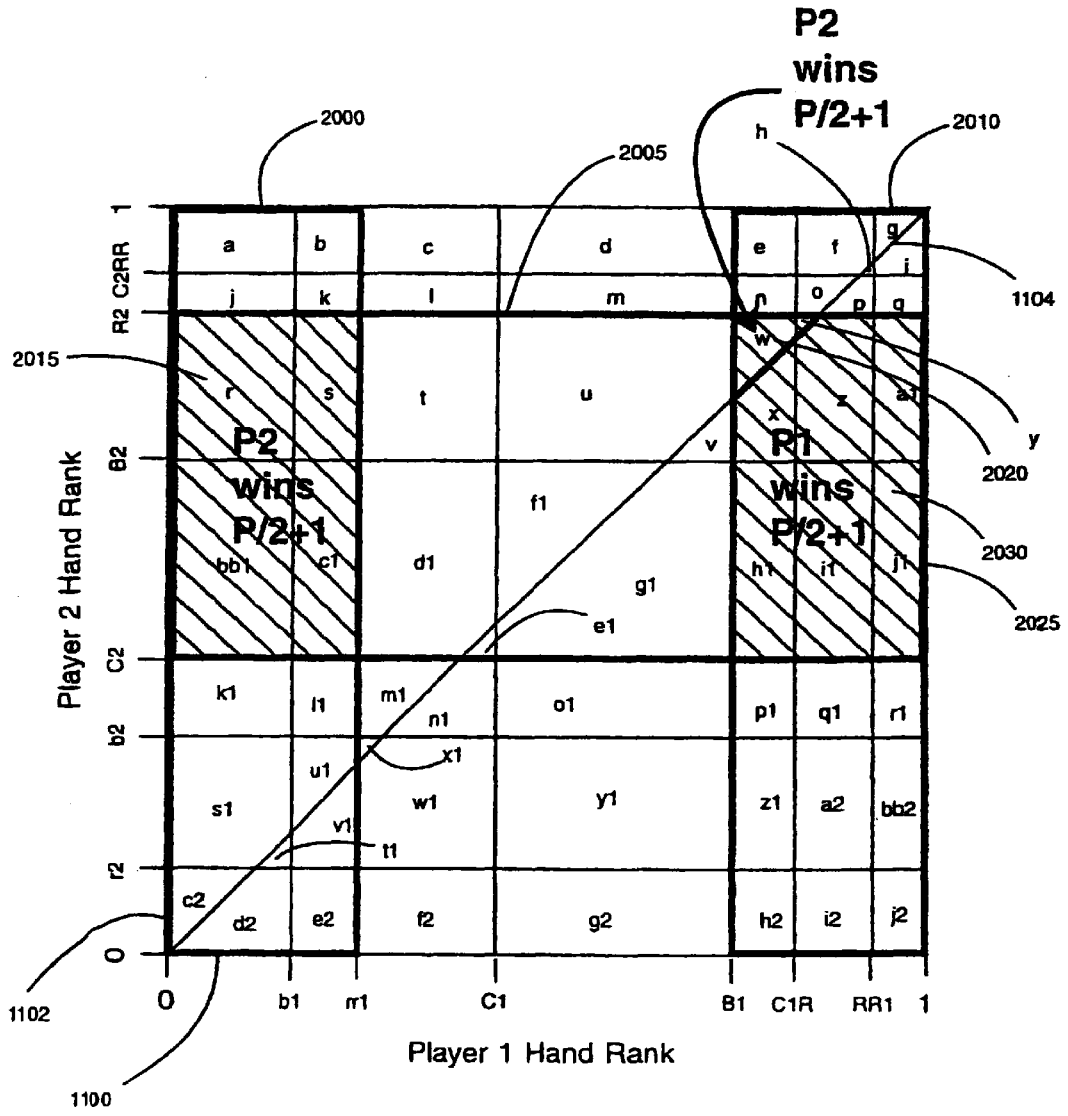
FIG. 20 illustrates games in the model of FIG. 13 that correspond to resolution step 1040 of Table 10.

The seventh outcome listed in Table 10 occurs at resolution step 1040 for games in which P1 bets and P2 calls. Referring to FIG. 12, P1 bets with hands 1202 between 0 and rr1 (indicated by rectangle 2000 in FIG. 20) and with hands 1206 between B1 and 1 (indicated by rectangle 2010 in FIG. 20). P2 calls, after P1 bets, with hands 1236 between C2 and R2 (indicated by rectangle 2005 in FIG. 20). The games in which P1 bets and P2 calls aie indicated in FIG. 20 by rectangles 2015 and 2025. According to Table 10, the player with the higher hand wins P/2+1 for games in rectangles 2015 and 2025. In FIG. 20, P2 has the higher hand for games above dividing line 1104, and P1 has the higher hands below dividing line 1104. P2 wins (P1 loses) P/2+1 in rectangle 2015 and in portion 2020 of rectangle 2015 that includes regions w and y. P1 wins P/2+1 in the remaining portion 2030 of rectangle 2025 that includes regions x, z, a1, h1, i1 and j1. The expected return to P1 due to games resolved at step 1040 is the area of rectangle 2015 and of portion 2020 of rectangle 2025 multiplied by −(P/2+1) plus the area of portion 2030 of rectangle 2025 multiplied by P/2+1;

$$EI_{1040} = -\left(\frac{P}{2}+1\right)\left[(rr1)(R2-C2)+\frac{(R2-B1)^2}{2}\right]+\left(\frac{P}{2}+1\right)\left[(1-B1)(R2-C2)-\frac{(R2-B1)^2}{2}\right]$$

Figure 21:
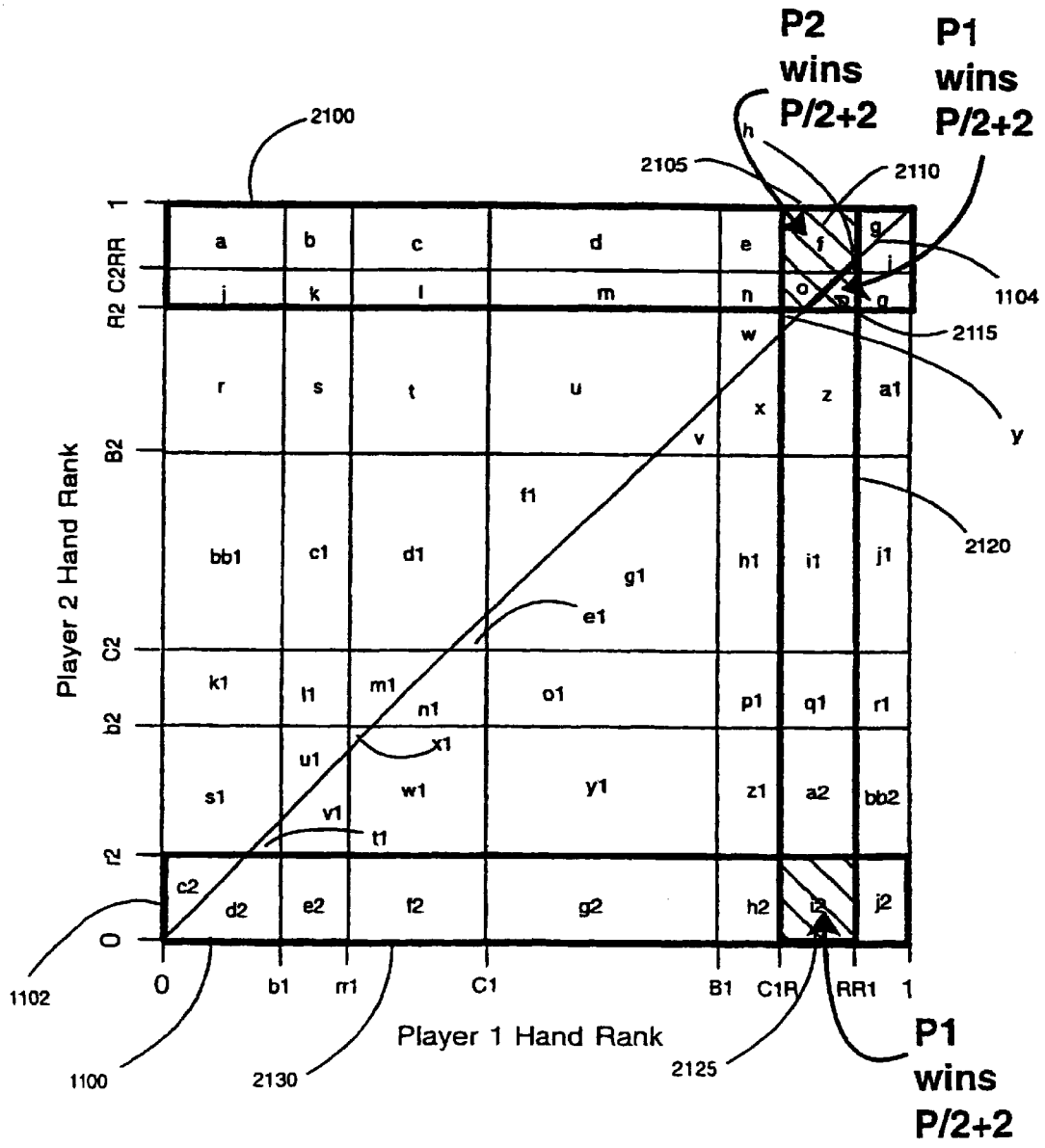
FIG. 21 illustrates games in the model of FIG. 13 that correspond to resolution step 1054 of Table 10.

The eighth outcome listed in Table 10 occurs at resolution step 1054 for games in which P1 bet-calls and P2 raises. Referring to FIG. 12, P1 bet-calls with hands 1214 between C1R and RR1 (indicated by rectangle 2120 in FIG. 21). P2 raises, after P1. bets, with hands 1232 between 0 and r2 (indicated by rectangle 2130 in FIG. 21) and with hands 1238 between R2 and 1 (indicated by rectangle 2100 in FIG. 21). The games in which P1 betcalls and P2 raises are indicated in FIG. 21 by rectangles 2105 and 2125. According to Table 10, the player with the higher hand wins P/2+2 for games in rectangles 2105 and 2125. In FIG. 21, P2 has the higher hand for games above dividing line 1104, and P1 has the higher hands below dividing line 1104. P2 wins (P1 loses) P/2+2 in portion 2110 of rectangle 2105 that includes regions f and o. P1 wins P/2+2 in the remaining portion 2115 of rectangle 2105 that includes regions p and h and in all of rectangle 2125. The expected return to P1 due to games resolved at step 1054 is the area of portion 2110 of rectangle 2105 multiplied by −(P/2+2) plus the area of portion 2115 of rectangle 2105 and of rectangle 2125 multiplied by P/2+2:

$$E1_{1054} = -\left(\frac{P}{2}+2\right)\left[(RR1 - C1R)(1 - R2) - \frac{(RR1 - R2)^2}{2}\right] + \left(\frac{P}{2}+2\right)\left[\frac{(RR1 - R2)^2}{2} + (RR1 - C1R)(r2)\right]$$

Figure 22:
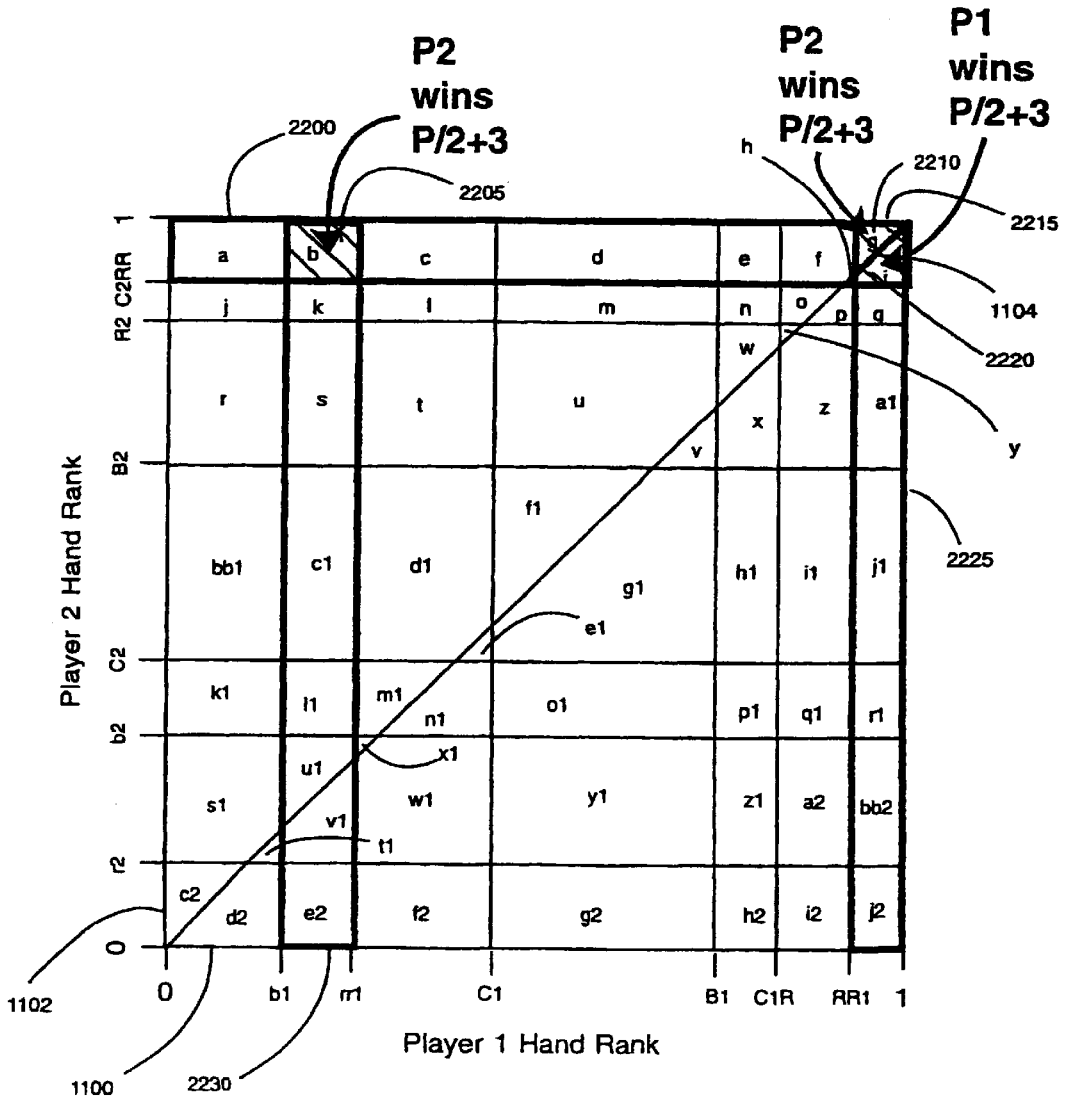
FIG. 22 illustrates games in the model of FIG. 13 that correspond to resolution step 1068 of Table 10.

The ninth and final outcome listed in Table 10 occurs at resolution step 1068 for games in which P1 bet-reraises and P2 raise-calls. Referring to FIG. 12, P1 bet-reraises with hands 1220 between b1 and rr1 (indicated by rectangle 2230 in FIG. 22) and with hands 1216 between RR1 and 1 (indicated by rectangle 2225 in FIG. 22). P2 raise-calls with hands 1246 between C2RR and 1 (indicated by rectangle 2200 in FIG. 22). The games in which P1 bet-reraises and P2 raise-calls are indicated in FIG. 22 by rectangles 2205 and 2215. According to Table 10, the player with the higher hand wins P/2+3 for games in rectangles 2205 and 2215. In FIG. 22, P2 has the higher hand for games above dividing line 1104, and P1 has the higher hands below dividing line 1104. P2 wins (P1 loses) P/2+3 in portion 2210 of rectangle 2215 that includes region g and in rectangle 2205. P1 wins P/2+3 in the remaining portion 2220 of rectangle 2215 that includes region i. The expected return to P1 due to games resolved at step 1068 is the area of rectangle 2205 and of portion 2210 of rectangle 2215 multiplied by –(P/2+3) plus the area of portion 2220 of rectangle 2215 multiplied by P/2+3:

$$E1_{1068} = -\left(\frac{P}{2}+3\right)\left[(rr1 - b1)(1 - C2RR) + \frac{(1 - RR1)^2}{2}\right] + \left(\frac{P}{2}+3\right)\left[(1 - RR1)(1 - C2RR) - \frac{(1 - RR1)^2}{2}\right]$$

According to step 955 of FIG. 9, an expression for a player's expected return is generated by taking the sum of the expected return due to games in each of the portions representing the different outcomes. The total expected return for P1 is thus:

$$E1 = E1_{1024} + E1_{1038} + E1_{1051} + E1_{1066} + E1_{1012} + E1_{1026} + E1_{1040} + E1_{1054} E1_{1068}$$

Inserting the expressions for the expected returns due to games in each of the different portions, and rearranging, results is the following form of an equation for E1:

$$\begin{aligned} E1 = {} & B2^2 + C1 - b2C1 - B2C1 - C1R - C2 - C2RR + 2r2 - \\ & 3C1Rr2 + B1b2 - B1B2 + B1C2 + B1r2 - R2 - C1RR2 + \\ & R2^2 + 2b1 - 5b1C2RR - 3b1r2 + 3b1R2 - 3rr1 + C2rr1 + \\ & 5C2RRrr1 + 2r2rr1 - 3R2rr1 + RR1 + C2RRRR1 - RR1^2 + \\ & P\left(\frac{1}{2}b2^2 - b2C1 - C1Rr2 + B1r2 - b1C2RR - b1r2 + \right. \\ & \left. b1R2 + C2rr1 + C2RRrr1 - R2rr1\right) \end{aligned}$$

According to step 960, the partial derivative of the expression for E1 is taken with respect to each sequence triggering variable (i.e. all of the variables in E1 except P), and each partial derivative is set equal to zero:

$$\frac{\partial E1}{\partial b1} = 2 - 5C2RR - 3r2 + 3R2 + P(-C2RR - r2 + R2) = 0 \quad (8)$$

$$\frac{\partial E1}{\partial B1} = b2 - B2 + C2 + r2 + r2P = 0 \quad (9)$$

$$\frac{\partial E1}{\partial b2} = -C1 + B1 + P(b2 - C1) = 0 \quad (10)$$

$$\frac{\partial E1}{\partial B2} = 2B2 - C1 - B1 = 0 \quad (11)$$

$$\frac{\partial E1}{\partial C1} = 1 - b2 - B2 - b2P = 0 \quad (12)$$

$$\frac{\partial E1}{\partial C1R} = 1 - 3r2 - R2 - r2P = 0 \quad (13)$$

$$\frac{\partial E1}{\partial C2} = -1 + B1 + rr1 + rr1P = 0 \quad (14)$$

$$\frac{\partial E1}{\partial C2RR} = -1 - 5b1 + 5rr1 + RR1 + P(-b1 + rr1) = 0 \quad (15)$$

$$\frac{\partial E1}{\partial r2} = 2 - 3C1R + B1 - 3b1 + 2rr1 + P(-C1R + B1 - b1) = 0 \quad (16)$$

$$\frac{\partial E1}{\partial R2} = -1 - C1R + 2R2 + 3b1 - 3rr1 + P(b1 - rr1) = 0 \quad (17)$$

$$\frac{\partial E1}{\partial rr1} = -3 + C2 + 5C2RR + 2r2 - 3R2 + P(C2 + C2RR - R2) = 0 \quad (18)$$

$$\frac{\partial E1}{\partial RR1} = 1 + C2RR - 2RR1 = 0 \quad (19)$$

For any particular value of P, equations (8)–(19) are solved simultaneously (according to step 965 of FIG. 9) to obtain values for the action sequence triggering variables. The solution may be performed by analytical and/or numerical techniques. The resulting action sequence triggering values may be mapped to corresponding actual card hands (according to step 975 of FIG. 9), thereby generating card playing strategies by identifying subsets of hands for each player with which to play the different possible action sequences.

Two Player, One Round Game with Check Raising

Another example of a game with which the method of the present invention may be used is a two-player one round game such as the game of FIGS. 10A–B in which check-raising is allowed. A flow chart for one embodiment of a two-player one-round game with check-raising is shown in FIGS. 23A–C.

Figure 23A:
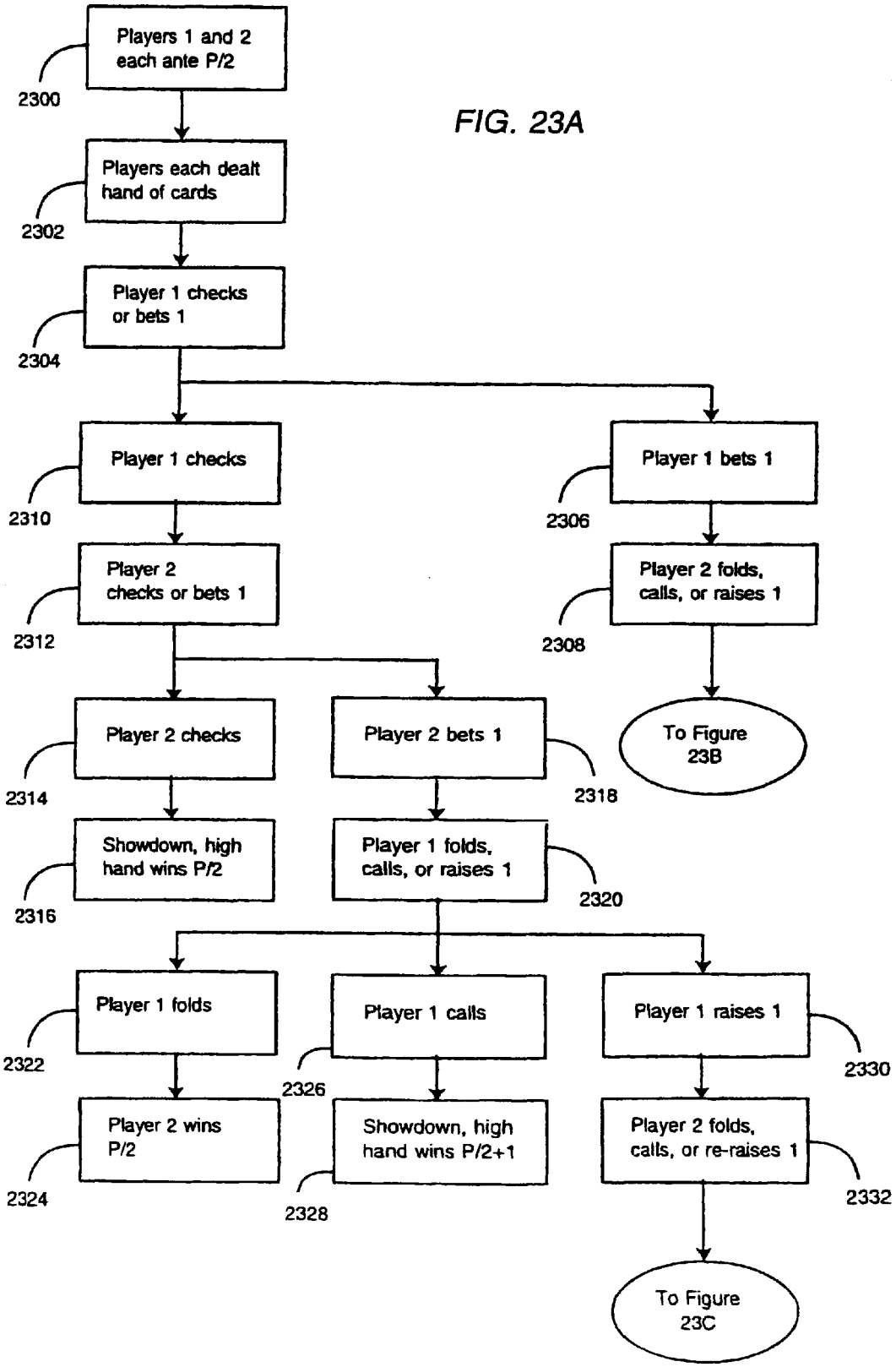
FIGS. 23A to 23C comprise a flow chart illustrating a sequence of events in a two-player, one round game with check-raising.

As shown in FIG. 23A, the game begins with each player paying an ante of P/2 at step 2300. Each player is dealt a hand of cards at step 2302. At step 2304, P1 checks or bets one. If P1 bets, the game continues to step 2306. At step 2308, P2 folds, calls or raises. From step 2308, the flowchart continues to FIG. 23B.

Figure 23B:
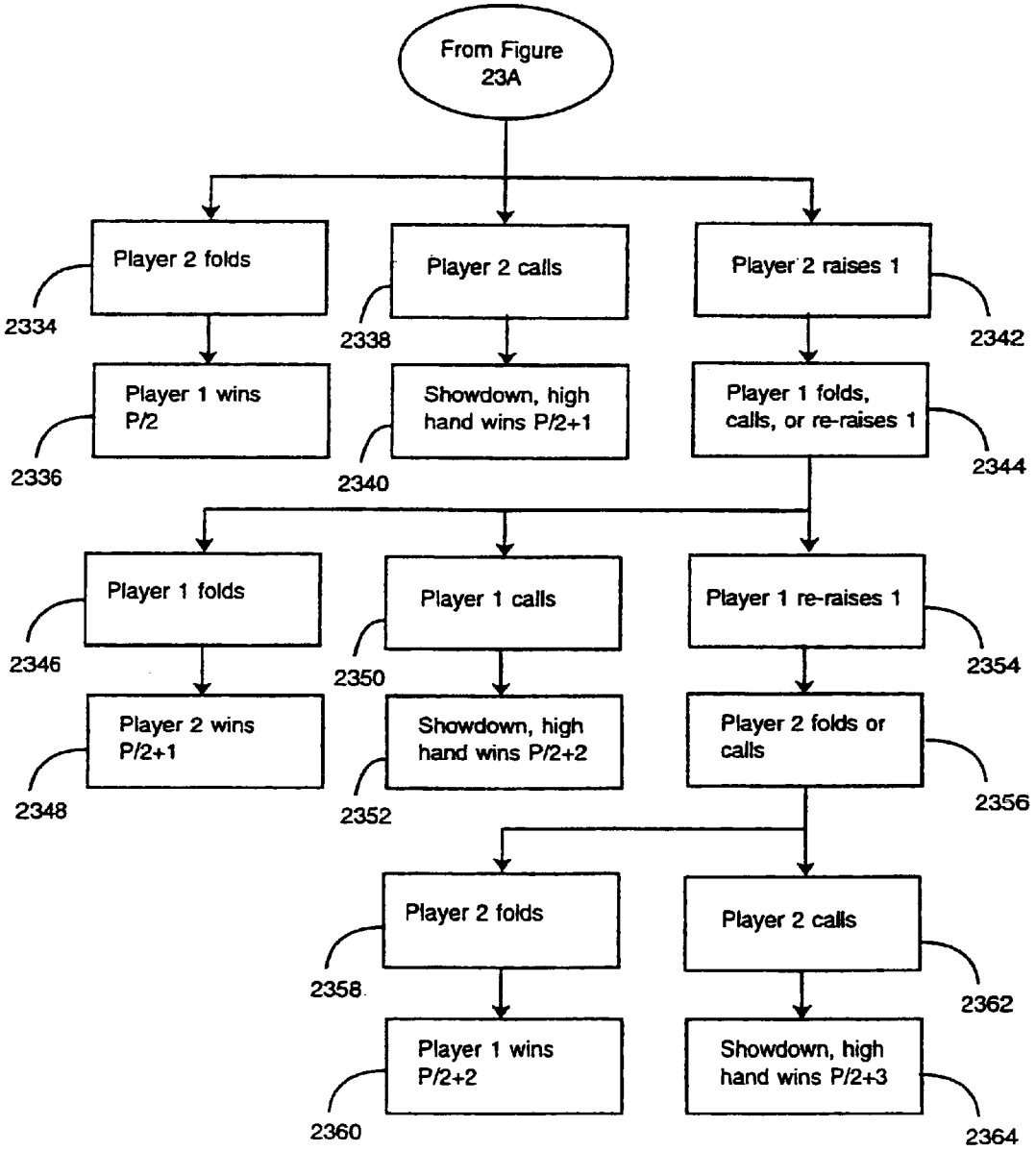
Figure 23C:
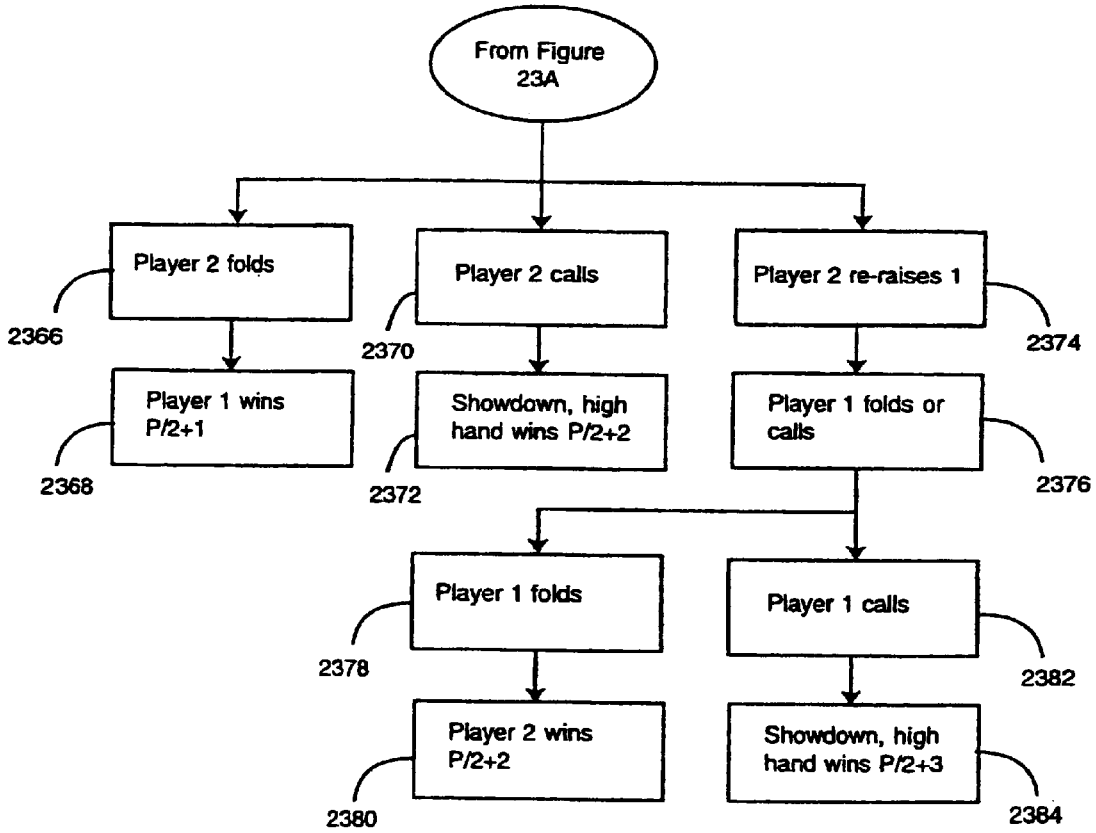

If P2 folds at step 2308 in FIG. 23A, the game continues to step 2334 in FIG. 23B, and P1 wins P/2 at step 2336. If P2 calls at step 2308, the game continues to step 2338, and there is a showdown at step 2340. At step 2340, the player with the highest hand wins P/2+1.

If P2 raises at step 2308, the game continues to step 2342. At step 2344, P1 folds, calls, or reraises by one. If P1 folds at step 2344, the game continues to step 2346 and P2 wins P/2+1 at step 2348. If P1 calls at step 2344, the game continues to step 2350, and there is a showdown at step 2352. At step 2352, the player with the highest hand wins P/2+2.

If P1 reraises at step 2344, the game continues to step 2354. At step 2356, P2 folds or calls. If P2 folds at step 2356, the game continues to step 2358 and P1 wins P/2+2 at step 2360. If P2 calls at step 2356, the game continues to step 2362 and there is a showdown at step 2364. At step 2364, the player with the highest hand wins P/2+3.

Referring to FIG. 23A, if P1 checks (passes) at step 2304, the game continues to step 2310. At step 2312, P2 checks (passes) or bets 1. If P2 checks at step 2312, the game continues to step 2314, and there is a showdown at step 2316. If P2 bets at step 2312, the game continues to step 2318. At step 2320, P1 folds, calls, or raises one.

If P1 folds at step 2320, the game continues to step 2322 and P2 wins P/2 at step 2324. If P1 calls at step 2320, the game continues to step 2326 and there is a showdown at step 2328. At step 2328, the player with the highest hand wins P/2+1. If P1 raises at step 2320 (this is the allowed check-raise), the game continues to step 2330. At step 2332, P2 folds, calls, or reraises one. From step 2332, the flowchart continues in FIG. 23C.

If P2 folds at step 2332 of FIG. 23A, the game continues to step 2366 of FIG. 23C, and P1 wins P/2+1 at step 2368. If P2 calls at step 2332, the game continues to step 2370 and there is a showdown at step 2372. At step 2372 the player with the highest hand wins P/2+2. If P2 reraises at step 2332, the game continues to step 2374. At step 2376, P1 folds or calls.

If P1 folds at step 2376, the game continues to step 2378, and P2 wins P/2+2 at step 2380. If P1 calls at step 2376, the game continues to step 2382, and there is a showdown at step 2384. At step 2384, the player with the highest hand wins P/2+3.

Resolutions for the game of FIGS. 23A–C occur at steps 2316, 2324, 2328, 2336, 2340, 2348, 2352, 2360, 2364, 2368, 2372, 2380 and 2384. Of these resolution steps, the first nine, shown in FIGS. 23A and 23B (2316, 2324, 2328, 2336, 2340, 2348, 2352, 2360, and 2364), are the same as the resolution steps for the game of FIGS. 10A–B. The remaining four, shown in FIG. 23C (2368, 2372, 2380, and 2384), are new resolution steps that result from allowing check-raising. The outcomes at the 13 resolution steps for the game of FIGS. 23A–C, and the action sequences for each player leading to the resolution step, are shown in Table 11.

TABLE 11

| Action Sequences and Outcomes | | | |
|---|---|---|---|
| Resolution Step | P1 Action Seq. | P2 Action Seq. | Outcome |
| By folding | | | |
| 2324 | pass-fold | bet | P2 wins P/2 |
| 2336 | bet | fold | P1 wins P/2 |
| 2348 | bet-fold | raise | P2 wins P/2 + 1 |
| 2360 | bet-reraise | raise-fold | P1 wins P/2 + 2 |
| 2368 | pass-raise | bet-fold | P1 wins P/2 + 1 |
| 2380 | pass-raise-fold | bet-reraise | P2 wins P/2 + 2 |
| By showdown | | | |
| 2316 | pass | pass | High hand wins P/2 |
| 2328 | pass-call | bet | High hand wins P12 + 1 |
| 2340 | bet | call | High hand wins P/2 + 1 |
| 2352 | bet-call | raise | High hand wins P/2 + 2 |
| 2364 | bet-reraise | raise-call | High hand wins P/2 + 3 |

TABLE 11-continued

| Action Sequences and Outcomes | | | |
|---|---|---|---|
| Resolution Step | P1 Action Seq. | P2 Action Seq. | Outcome |
| 2372 | pass-raise | bet-call | High hand wins P/2 + 2 |
| 2384 | pass-raise-call | bet-reraise | High hand wins P/2 + 3 |

Figure 24:
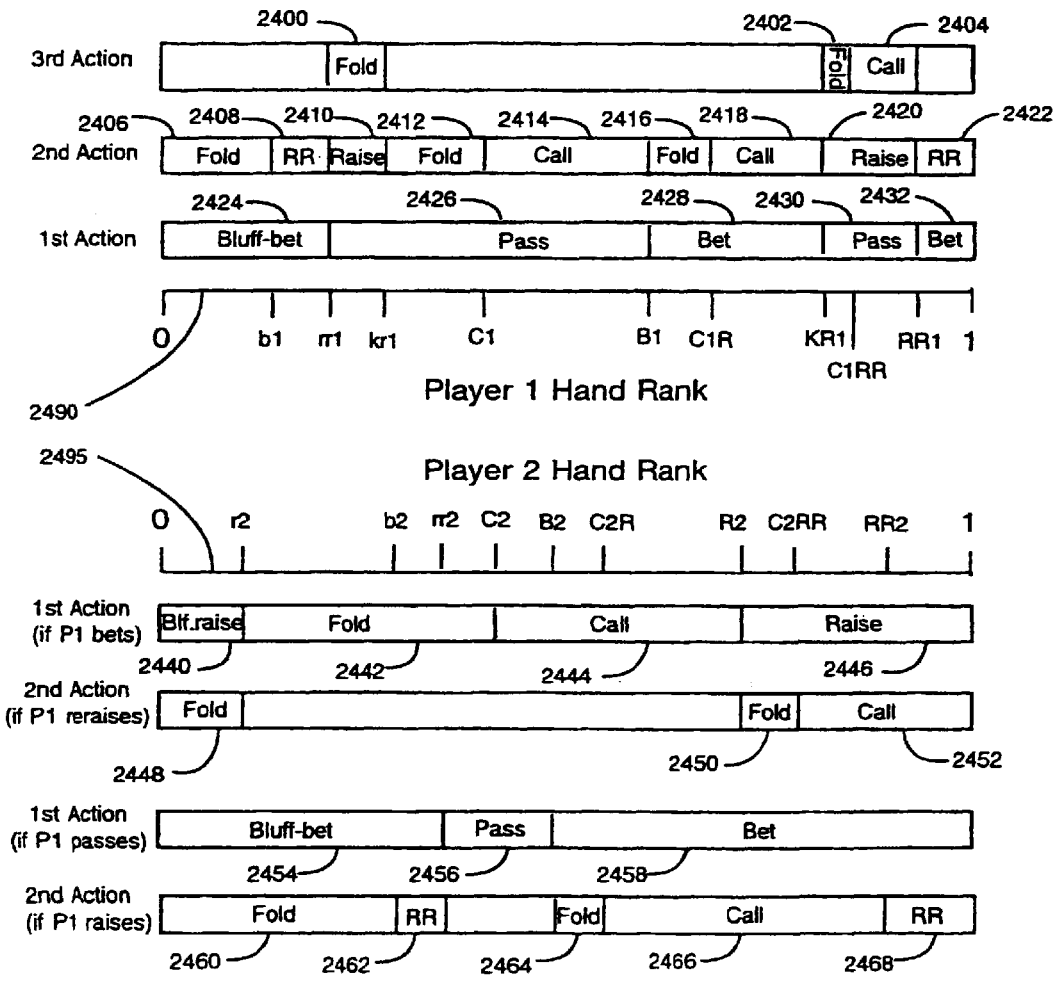
FIG. 24 illustrates action sequences corresponding to different hand ranks in one embodiment of the invention.

FIG. 24 shows action sequence triggering variables assigned to P1 and P2 for the game of FIG. 23 in one embodiment of the invention.

As shown in FIG. 24, the variables assigned to P1 are b1, rr1, kr1, C1, B1, C1R, KR1, C1RR and RR1. The variables assigned to P2 are r2, b2, rr2, C2, B2, C2R, R2, C2RR and RR2. The relative order of these variables as used in the embodiment of FIG. 24 is:

$$0<r2<b1<rr1<kr1<b2<rr2<C1<=C2<B2<C2R<B1<C1R<R2<C2RR<KR1<C1RR<RR2<RR1<1$$

These variables define the intervals of P1's and P2's hand strength axes 2490 and 2495 applicable to each of P1's and P2's action sequences, respectively. Because the variables are initially located at arbitrary locations along axes 2490 and 2495 (as long as the assigned relative order is followed), the actual values of the variables and the resultant sizes of the intervals as determined according to the invention may differ from those shown in FIG. 24.

As shown in Table 11, P1's possible action choices are pass, pass-fold, pass-call, pass-raise, pass-raise-fold, pass-raise-call, bet, bet-fold, bet-call, and bet-reraise. As shown in FIG. 24, the hands with which P1 passes are hands 2426 (between rr1 and B1) and 2430 (between KR1 and RR1). The hands with which P1 pass-folds are hands 2412 (between kr1 and C1). The hands with which P1 pass-calls are hands 2414 (between C1 and B1). The hands with which P1 pass-raises (check raises) are hands 2410 (bluff-raise, between rr1 and kr1) and 2420 (between KR1 and RR1). The hands with which P1 pass-raise-folds are hands 2400 (P1's bluff-raise hands, between rr1 and kr1) and 2402 (between KR1 and C1RR). The hands with which P1 pass-raise-calls are hands 2404 (between C1RR and RR1). The hands with which P1 bets are hands 2424 (bluff bet, between 0 and rr1), 2428 (between B1 and KR1), and 2432 (between RR1 and 1). The hands with which P1 bet-folds are hands 2406 (between 0 and b1) and 2416 (between B1 and C1R). The hands with which P1 bet-calls are hands 2418 (between C1R and KR1). The hands with which P1 bet-reraises are hands 2408 (bluff reraise, between b1 and rr1) and 2422 (between RR1 and 1).

As shown in Table 11, P2's possible action choices are fold, pass, call, bet, raise, bet-fold, bet-call, bet-reraise, raise-fold and raise-call. As shown in FIG. 24, the hands with which P2 folds are hands 2442 (between r2 and C2). The hands with which P2 passes are hands 2456 (between rr2 and B2). The hands with which P2 calls are hands 2444 (between C2 and R2). The hands with which P2 bets are hands 2454 (bluff-bet, between 0 and rr2) and 2458 (between B2 and 1). The hands with which P2 raises are hands 2440 (bluff-raise, between 0 and r2) and 2446 (between R2 and 1). The hands with which P2 bet-folds are hands 2460 (between 0 and b2) and 2464 (between B2 and C2R). The hands with which P2 bet-calls are hands 2466 (between C2R and RR2). The hands with which P2 bet-reraises are hands 2462 (bluff-reraise, between b2 and rr2) and 2468 (between RR2 and 1). The hands with which P2 raise-folds are hands 2448 (P2's bluff-raise hands, between 0 and r2) and 2450 (between R2 and C2RR). The hands with which P2 raise-calls are hands 2452 between C2RR and 1.

Figure 25:
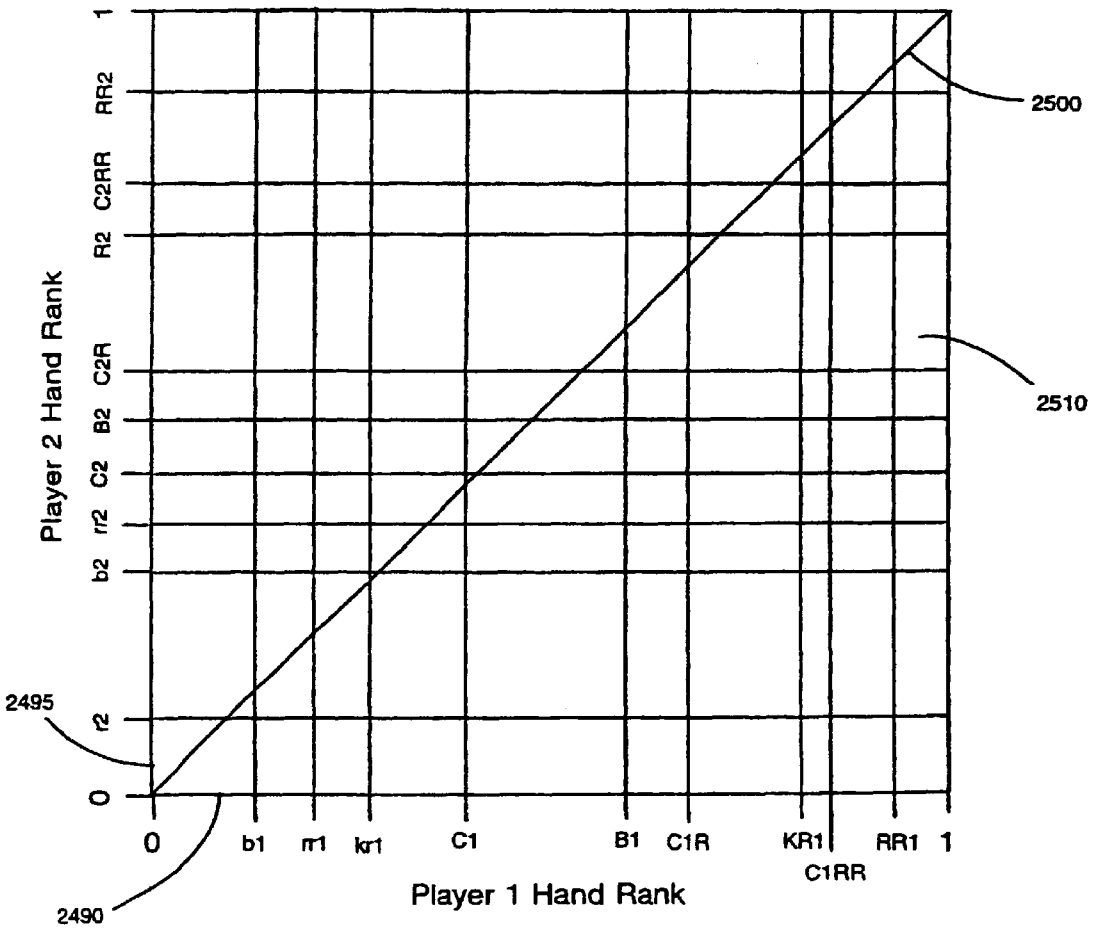
FIG. 25 is an example of a two-dimensional model of the present invention.

FIG. 25 shows a basic model constructed according to the invention using P1's and P2's hand strength axes 2490 and 2495, respectively. The model represents all possible P1 and P2 hand combinations for the game of FIG. 23. In FIG. 25, the model is divided into a plurality of subregions 2510 by dividing line 2500 and lines extending perpendicularly from each variable location on axes 2490 and 2495, respectively.

Figure 26:
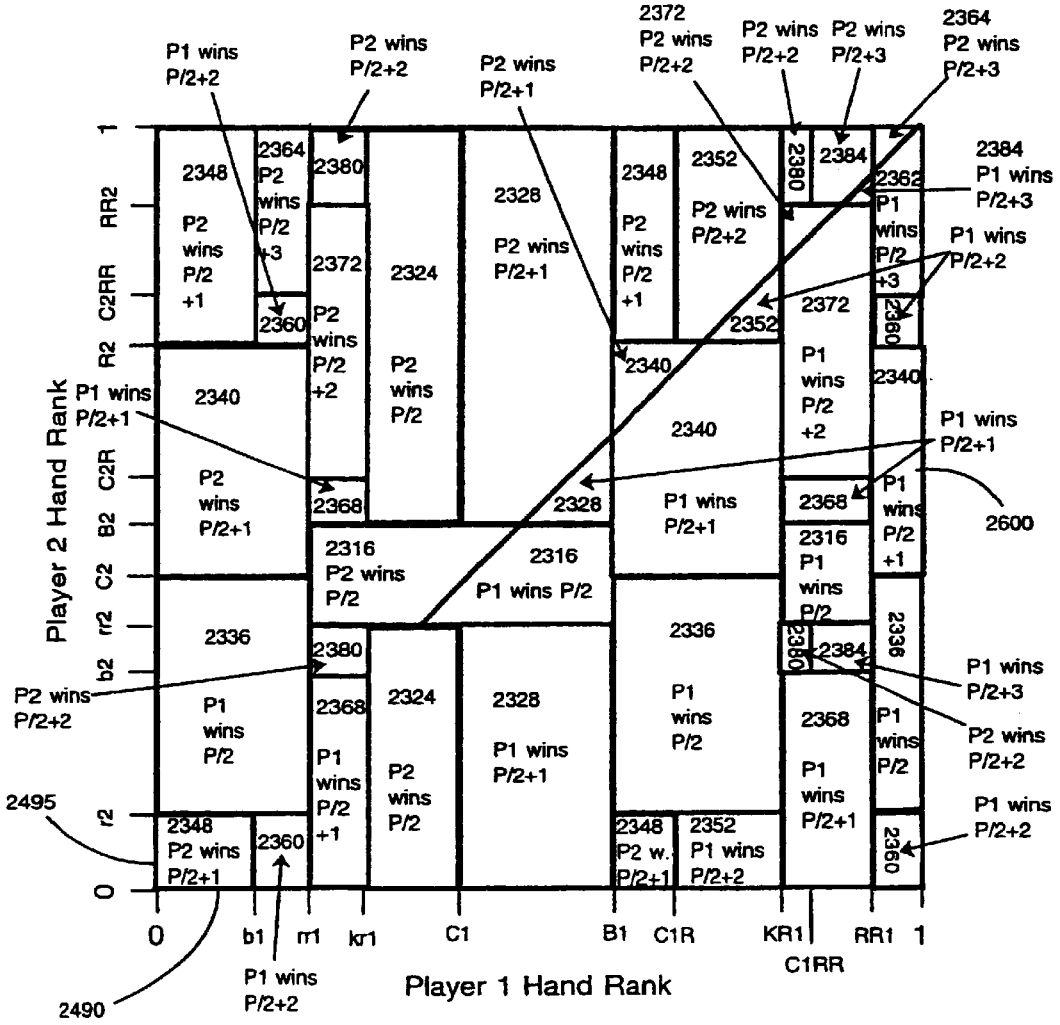
FIG. 26 is an example of a two-dimensional model of the present invention.

Using Table 11 and FIG. 24, the subregions of FIG. 25 that correspond to each of the resolution steps of Table 11 are identified, for example in the manner described with respect to FIGS. 14–22. FIG. 26 shows the resulting regions, and the outcomes for each region, that correspond to each of the resolution steps listed in Table 11. The resolution step number corresponding to a region and the outcome for the region are indicated in each region shown in FIG. 26. For example, region 2600 is marked "2340 P1 wins P/2+1," indicating that the region corresponds to games resolved at resolution step 2340 of FIG. 23 with an outcome that P1 wins P/2+1.

According to the invention, the model of FIG. 26 is used to generate an expression for an expected return to a player (for example P1) by taking the sum of the products of the area of each region and the return to that player for games in that region. For example, the product of the area of subregion 2600 and the return to player P1 for games in region 2600 is:

$$E1_{2600} = \left(\frac{P}{2} + 1\right)[(1 - RR1)(R2 - C2)]$$

Alternatively, instead of taking the product of area and return for each region, regions having the same return for a player may be combined into larger regions. The expected return may then be calculated by taking the sum of the products of the areas and returns for such combined regions.

The resulting expected return to P1 according to the model of FIG. 25 may be written as follows:

$$\begin{aligned} E1 = {} & B2^2 + C1 - B2C1 + C1R + C1RR + 5b2C1RR - C2 - \\ & C2RR - 2kr1 + 3b2kr1 - B2kr1 + 3C2Rkr1 - 3b2KR1 + \\ & B2KR1 - C2KR1 + C2RKR1 + b2C1RRP + b2kr1P - \\ & B2kr1P + C2Rkr1P - b2KR1P + 2r2 - 3C1Rr2 + \\ & 2KR1r2 - C1RPr2 - R2 - C1RR2 - KR1R2 + R2^2 - \\ & b1(-2 + C2RR(5 + P) + (3 + P)r2 - 3R2 - PR2) - rr1 - \\ & 3b2rr1 + B2rr1 + C2rr1 - 3C2Rrr1 + 5C2RRrr1 - b2rr1P + \\ & B2rr1P + C2rr1P - C2Rrr1P + C2RRrr1P + 2r2rr1 - 3R2rr1 - \\ & R2rr1P - 2b2RR1 - B2RR1 + C2RR1 - C2RRRR1 - 2r2RR1 + \\ & R2RR1 - C1rr2 - 5C1RRrr2 - 2kr1rr2 + 2KR1rr2 - C1rr2P - \\ & C1RRrr2P + KR1rr2P + 2rr1rr2 + 3RR1rr2 + \frac{rr2^2P}{2} + \\ & B1(-B2 + C2 + r2 + r2P + rr2) - C1RRRR2 - RR1RR2 + RR2^2 \end{aligned} \tag{20}$$

According to the method of the invention, the partial derivatives of equation (20) with respect to each variable (except P) are taken and set equal to zero:

$$\frac{\partial E1}{\partial b1} = 2 - C2RR(5 + P) - (3 + P)r2 + 3R2 + R2P = 0 \tag{21}$$

$$\frac{\partial E1}{\partial rr1} = -1 + B2 + C2 - 3C2R + 5C2RR + B2P + C2P - C2RP + C2RRP - b2(3 + P) + 2r2 - 3R2 - R2P + 2rr2 = 0 \tag{22}$$

$$\frac{\partial E1}{\partial kr1} = -2 - B2 + 3C2R - B2P + C2RP + b2(3 + P) - 2rr2 = 0 \tag{23}$$

$$\frac{\partial E1}{\partial C1} = 1 - B2 - rr2 - rr2P = 0 \tag{24}$$

$$\frac{\partial E1}{\partial B1} = -B2 + C2 + r2 + r2P + rr2 = 0 \tag{25}$$

$$\frac{\partial E1}{\partial C1R} = 1 - (3 + P)r2 - R2 = 0 \tag{26}$$

$$\frac{\partial E1}{\partial KR1} = B2 - C2 + C2R - b(3 + P) + 2r2 - R2 + 2rr2 + rr2P = 0 \tag{27}$$

$$\frac{\partial E1}{\partial C1RR} = 1 + b2(5 + P) - (5 + P)rr2 - RR2 = 0 \tag{28}$$

$$\frac{\partial E1}{\partial RR1} = -2b2 - B2 + C2 - C2R + C2RR - 2r2 + R2 + 3rr2 - RR2 = 0 \tag{29}$$

$$\frac{\partial E1}{\partial r2} = 2 + B1 - 3C1R + 2KR1 + B1P - C1RP - b1(3 + P) + 2rr1 - 2RR1 = 0 \tag{30}$$

$$\frac{\partial E1}{\partial b2} = -3KR1P + kr1(3 + P) + C1RR(5 + P) - 3rr1 - rr1P - 2RR1 = 0 \tag{31}$$

$$\frac{\partial E1}{\partial rr2} = B1 - 5C1RR - 2kr1 + 2KR1 - C1RRP + KR1P - C1(1 + P) + 2rr1 + 3RR1 + rr2P = 0 \tag{32}$$

$$\frac{\partial E1}{\partial C2} = -1 + B1 - KR1 + rr1 + rr1P + RR1 = 0 \tag{33}$$

$$\frac{\partial E1}{\partial B2} = -B1 + 2B2 - C1 - kr1 + KR1 - kr1P + rr1 + rr1P - RR1 = 0 \tag{34}$$

$$\frac{\partial E1}{\partial C2R} = KR1 + kr1(3 + P) - 3rr1 - rr1P - RR1 = 0 \tag{35}$$

$$\frac{\partial E1}{\partial R2} = -1 - C1R - KR1 + b1(3 + P) + 2R2 - 3rr1 - rr1P + RR1 = 0 \tag{36}$$

$$\frac{\partial E1}{\partial C2RR} = -1 - b1(5 + P) + (5 + P)rr1 + RR1 = 0 \tag{37}$$

$$\frac{\partial E1}{\partial RR2} = -C1RR - RR1 + 2RR2 = 0 \tag{38}$$

For any particular value of P, equations (21)–(38) are solved simultaneously (according to step 965 of FIG. 9) to obtain values for the sequence triggering variables. The resulting action sequence triggering values may be mapped to corresponding actual card hands (according to step 975 of FIG. 9), thereby generating card playing strategies by identifying subsets of hands for each player with which to play the different possible action sequences for the game of FIGS. 23A–C.

Pot Limit Games

The example games described so far have been limit bet games, specifically, games in which the limit for each bet has been a bet of one unit. The invention can be used with limit bet games having other limits, for pot limit games, and for other betting limit games. The betting limits are taken into account when determining the outcomes of each resolution step of a game according to the method of the invention.

Figure 27:
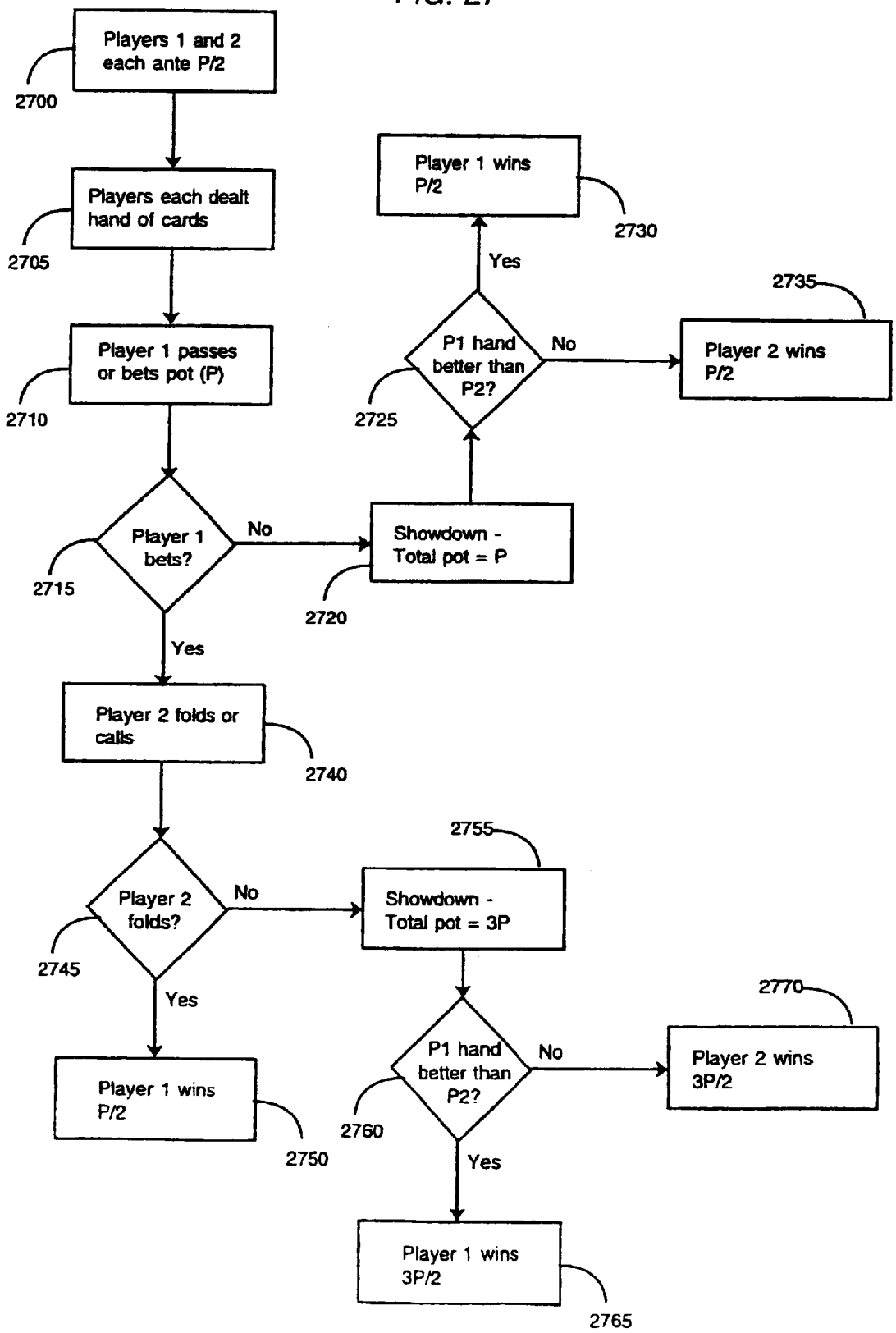
FIG. 27 is a flow chart illustrating a sequence of events in a two-player, one round game without raising with pot-limit betting.

For example, FIG. 27 shows the flowchart of the game of FIG. 6 modified for a pot limit game. The flowchart steps are the same as in the game of FIG. 6. However, the size of the pot at certain resolution steps, and the resulting returns to the players, change as the result of having a pot limit instead of a fixed, one-unit betting limit. In the game of FIG. 6, resolution steps occur when P2 folds at step 650 and when there are showdowns at steps 620 and 655. The returns to the winning player at these steps is P/2, P/2, and P/2+1, respectively. The corresponding resolution steps in FIG. 27 are steps 2750, 2720 and 2755, respectively. At steps 2750 and 2720, the returns to the winning player are the same as at steps 650 and 620, namely P/2. However, at resolution step 2755, because of the different betting limit, the pot has a different value (3P vs. P+2), resulting in a different return to the winning player (3P/2 vs. P/2+1).

An expression for the expected return to P1 from the game of FIG. 27 can be generated according to the invention by replacing the return to a winning player at step 655 (P/2+1) in equation (0) (an expression for the expected return to P1 from the game of FIG. 6) with the return to a winning player at resolution step 2755 (3P/2) for the game of FIG. 27:

$$E1 = \frac{P}{2}\left[\left(\frac{b1^2}{2}\right) + \left(B1C2 - \frac{b1^2}{2} - \frac{C2^2}{2}\right) + (C2 - B1C2) + \left(\frac{B1^2}{2} - B1C2 + \frac{C2^2}{2}\right) + \left(b1C2 - \frac{b1^2}{2}\right) - \left(\frac{C2^2}{2} - b1C2 + \frac{b1^2}{2}\right) - \left(-\frac{B1^2}{2} + B1 - b1 + b1C2 - \frac{C2^2}{2}\right)\right] + \left(\frac{3P}{2}\right)\left[\left(\frac{1}{2} - C2 + B1C2 - \frac{B1^2}{2}\right) - (b1 - b1C2) - \left(\frac{1}{2} - B1 + \frac{B1^2}{2}\right)\right]$$

Equation (39) can be simplified and rewritten as:

$$E1 = P\left(-C2 + B1C2 - B1^2 - \frac{b1^2}{2} + 2b1C2 + B1 - b1\right) \tag{40}$$

Taking the partial derivatives of equation (40) with respect to b1, B1 and C2 and setting equal to zero according to the invention yields the following equations:

$$\frac{\partial E1}{\partial b1} = P(-b1 + 2C2 - 1) = 0 \tag{41}$$

$$\frac{\partial E1}{\partial B1} = P(C2 - 2B1 + 1) = 0 \tag{42}$$

$$\frac{\partial E1}{\partial C2} = P(-1 + B1 + 2b1) = 0 \tag{43}$$

Solving equations (41)–(43) simultaneously produces the following values:

$$b1 = \frac{1}{9}$$

$$B1 = \frac{7}{9}$$

-continued $$C2 = \frac{5}{9}$$

The values of b1, B1 and C2 generated according to the present invention in the pot-limit case of the game of FIG. 6 are therefore fixed values, independent of P (as opposed to the limit-betting game of FIG. 6, in which the values of b1, B1 and C2 are dependent on P, as indicated in equations (5), (6), and (7)).

Applying the Invention to Discrete Hand Distributions

The method of the present invention can be used to generate card playing strategies by generating values for action sequence triggering variables such as those shown in FIG. 12. To apply these strategies to a game, a player determines the rank of the hand of cards that the player was dealt, finds the action sequence interval that corresponds to that rank for that player, and follows the action sequence that corresponds to that interval.

Figure 28:
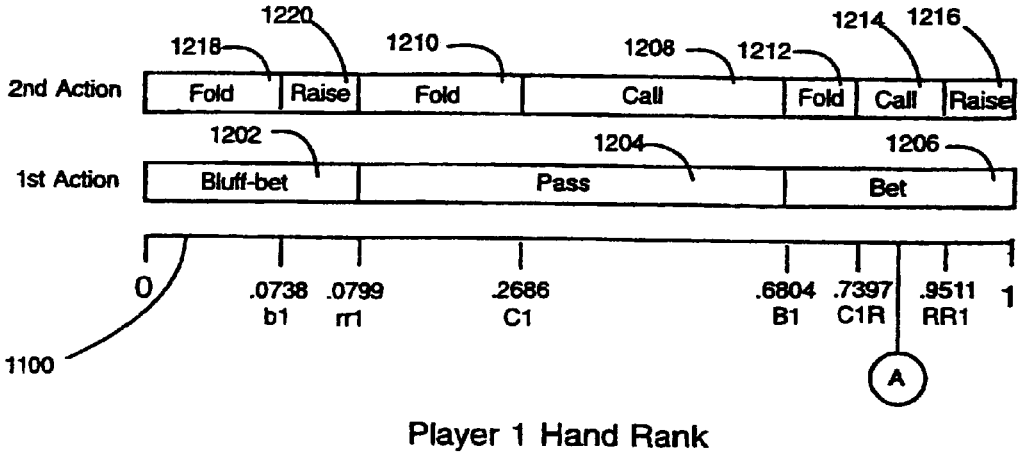
FIG. 28 illustrates action sequences corresponding to different hand ranks in one embodiment of the invention.

For example, FIG. 28 shows P1's hand rank axis 1100 from FIG. 12 showing the values obtained for the action sequence triggering variables for the game of FIGS. 10A–B for P=3. For example, if P1 is dealt a hand whose rank is 0.83, to apply the strategies generated by the present invention, P1 compares its hand rank to the action sequences triggering variables shown in FIG. 12. P1's hand rank, 0.83, falls in interval 1214 between C1R (0.7297) and RR1 (0.9511). The strategy indicated by FIG. 12 is for P1 follow a "bet-call" action sequence: i.e., P1 should bet, and call if raised by P2.

An action sequence triggering variable generated according to the invention indicates a hand that forms a dividing line between two action sequences. Hands of rank lower than the action sequence triggering variable trigger one action sequence, hands of higher rank trigger a second action sequence. For the hand that has the same rank as the value of the variable, it does not matter which action sequence is followed. However, in certain embodiments, one or the other of the two action sequences is deemed to apply. For example, variable C1 in FIG. 28 indicates the hand that forms the dividing line between a "pass-fold" action sequence and a "pass-call" action sequence. Accordingly, hands having a ranking greater than C1 follow a "pass-call" action sequence while hands having a lower ranking than C1 follow a "pass-fold" action sequence. For the game represented by FIG. 12, C1 was defined as the lowest hand with which P1 will pass and then call if raised. Accordingly, in the embodiment of FIG. 12, a hand having a ranking equal to C1 will follow a "pass-call" action sequence.

In actual card games, the rank of a hand of cards within a player's cumulative hand rank distribution is not immediately discernible from the faces of the cards themselves. Accordingly, in one embodiment of the invention, triggering sequence values are mapped to corresponding actual hands. For example, action sequence triggering variable B1 of the embodiment of Figure may be mapped to a hand containing a full-house, aces over threes. The strategy may then be applied by a player by comparing the cards in a hand directly to the hands corresponding to the action sequence triggering variables.

The hand corresponding to a action sequence triggering variable is determined by identifying a hand whose ranking in the applicable player's cumulative hand rank distribution is equal to or approximately equal to the numerical value of the action sequence triggering variable. Hands of cards dealt from an actual deck of cards do not result in continuous cumulative hand rank distributions, but in discrete distributions. Thus, there is not a hand that corresponds to every rank between 0 and 1. Accordingly, in a game of cards, there often is no hand whose rank corresponds exactly to an action sequence triggering variable value. In this case, in one embodiment, the card having the next highest or next lowest rank is selected to correspond to an action sequence triggering variable. Another embodiment of the present invention uses a novel interpolation technique to simulate a hand that falls exactly on a action sequence triggering value where no hand having the precise value of the variable exists.

Figure 29:
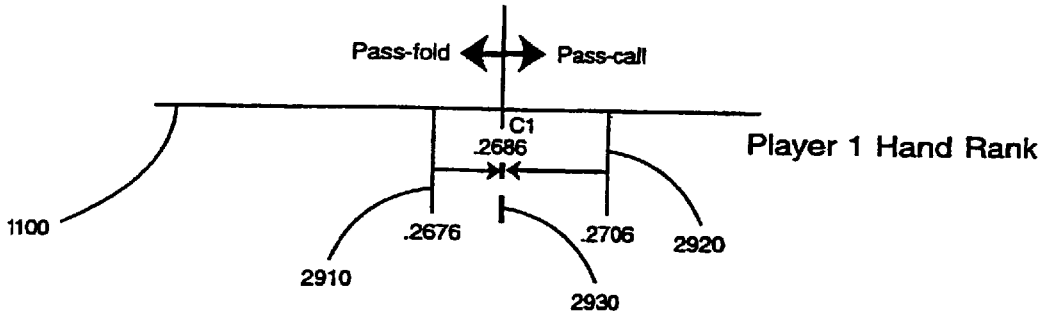
FIG. 29 illustrates an interpolation method used in one embodiment of the invention.

FIG. 29 shows the portion of P13 s hand rank axis 1100 of FIG. 28 adjacent to variable C1 for a game with discrete card hand distributions. FIG. 29 shows the two hands, 2910 and 2920, nearest to C1. As shown in FIG. 29, C1 has a value of 0.2686, hand 2910 has a rank of 0.2676, and hand 2920 has a rank of 0.2706. The difference "a" between action sequence triggering variable C1 and the rank of the first hand immediately below variable C1 (hand 2910) is 0.2686−0.2676=0.0010. The difference "b" between the rank of the first hand immediately above variable C1 (hand 2920) and variable C1 is 0.2706−0.2686−0.0020.

According to this embodiment, if a triggering variable is defined as the lowest hand rank with which a certain action sequence is followed (such as C1 which is defined as the lowest hand rank with which P1 pass-calls), if no hand rank falls exactly on the triggering variable, the hand with the first hand rank below an action triggering variable value is assigned to follow the action sequence for the interval above the triggering variable $$\frac{b}{a+b}$$

of the time. Similarly, if a triggering variable is defined as the highest hand rank with which a certain action sequence is followed (such as b2 which is defined as the highest hand rank with which P2 bluff-bets), if no hand rank falls exactly on the triggering variable, the hand with the first hand rank above an action triggering variable value is assigned to follow the action sequence for the interval below the triggering variable $$\frac{a}{a+b}$$

of the time. The result is the creation of a "virtual hand" located at approximately the triggering variable.

For example, in FIG. 29, interval 1210 below C1 corresponds to a "pass-fold" action sequence, while interval 1208 above C1, which corresponds to a "pass-call" sequence. C1 is defined as the lowest hand with which P1 pass-calls.

$$\frac{b}{a+b} = \frac{0.002}{0.001+0.002} = \frac{2}{3}.$$

Accordingly, in this embodiment of the invention, P1's strategy is to play a "pass-call" action sequence with two-thirds of its 2910 hands, and to play a "pass-fold" sequence with the remainder of P1's 2910 hands. P1's strategy is to always play a "pass-call" sequence with its 2920 hands.

In another embodiment, whenever there is no hand rank that falls precisely on a triggering variable, the hand with the first hand rank below an action triggering variable follows the action sequence for the interval above the triggering variable $$\frac{b}{a+b}$$

of the time and the hand with the first hand rank above an action triggering variable follows the action sequence for the interval below a the triggering variable $$\frac{a}{a+b}$$

of the time.

Computer Implementations of the Invention

Figure 30:
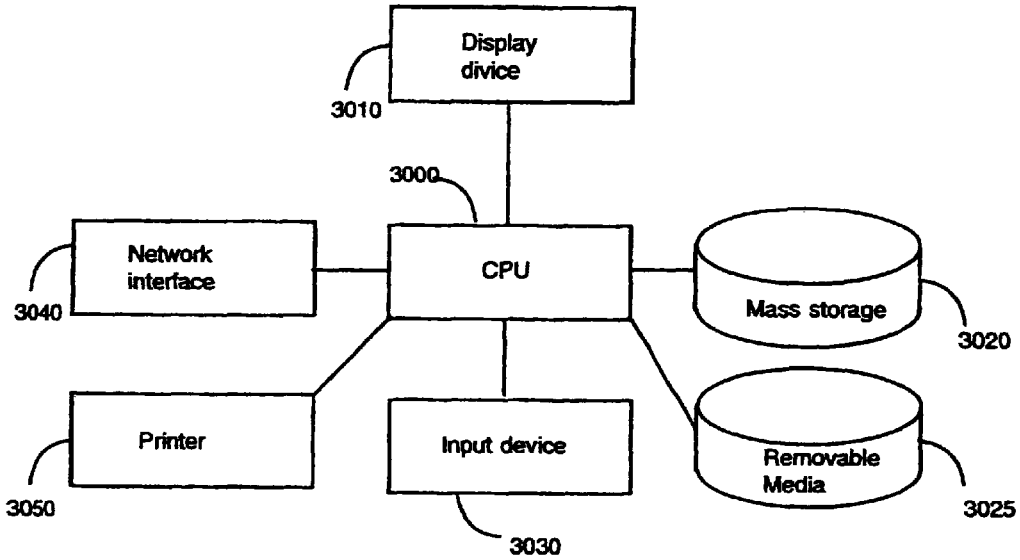
FIG. 30 illustrates an example computer system that may be used to implement an embodiment of the invention.

The invention may be implemented by means of appropriate software on the computer system of FIG. 30 and on any of a variety of other computer systems, including hand-held and arcade computer games and other computer gaming systems. The exemplary computer system shown in FIG. 30 includes a CPU unit 3000 that includes a central processor, main memory, peripheral interfaces, input-output devices, power supply, and associated circuitry and devices; a display device 3010 which may be a cathode ray tube display, LCD display, gas-plasma display, or any other computer display; an input device 3030, which may include a keyboard, mouse, digitizer, or other input device; non-volatile storage 3020, which may include magnetic, re-writable optical, or other mass storage devices; a transportable media drive 3025, which may include magnetic, re-writable optical, or other removable, transportable media, and a printer 3050. The computer system may also include a network interface 3040, which may include a modem, allowing the computer system to communicate with other systems over a communications network such as the Internet. Any of a variety of other configurations of computer systems may also be used. In one embodiment, the computer system comprises an Intel Pentium (tm) CPU and runs the Microsoft Windows 95 (tm) operating environment.

When a computer system executes the processes and process flows described herein, it is an apparatus for generating improved card playing strategies. The processes of the invention may be implemented in any of a variety of computer languages, as are well known in the art, including, without limitation, C, Objective C, C++, Matlab scripts, Mathematica, Axiom, etc.

Figure 31:
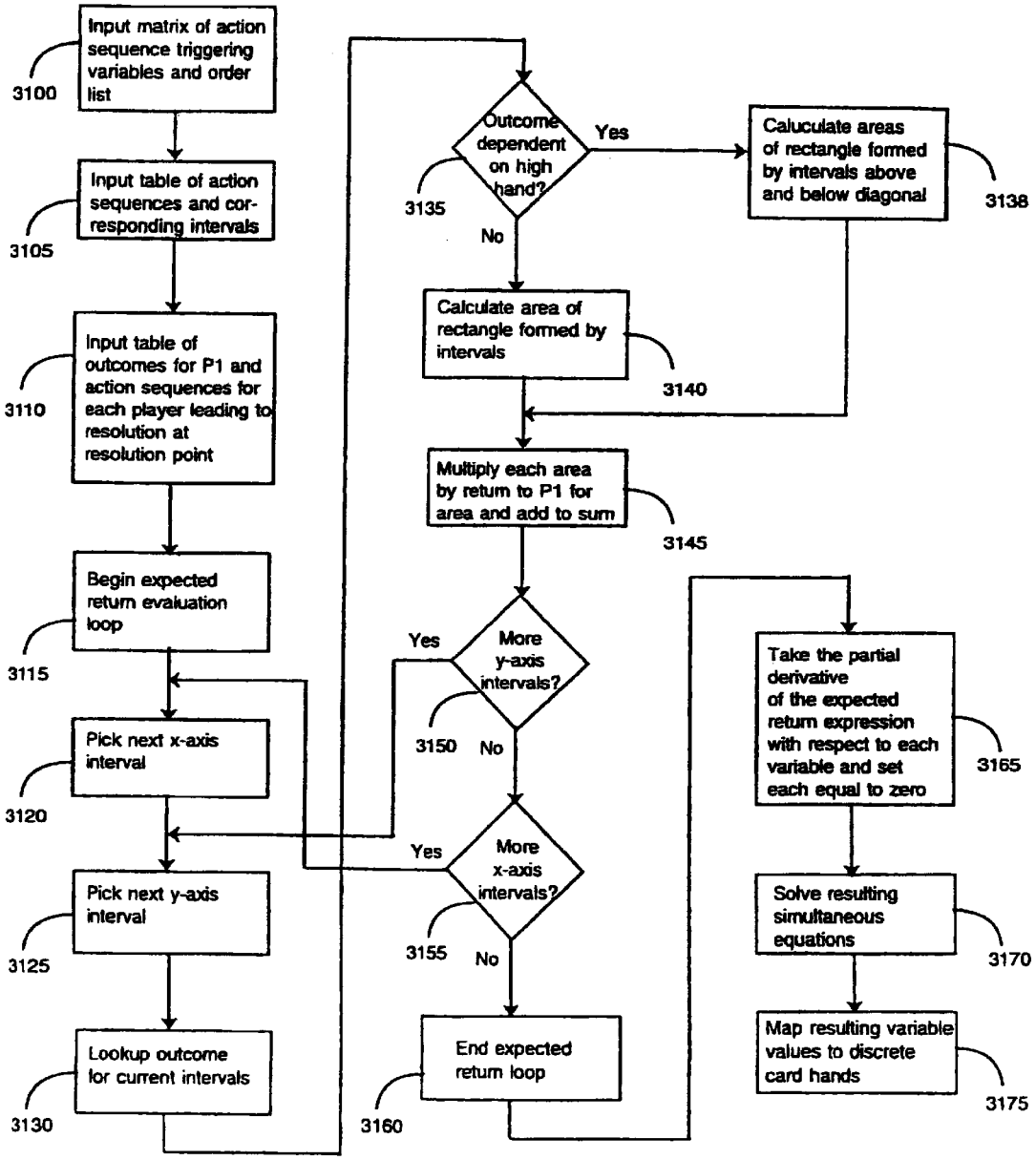
FIG. 31 is a flow chart of one embodiment of a computer implementation of the invention for a two-player game.

FIG. 31 is a flow chart of one embodiment of a computer implementation of the invention for a two-player game. As shown in FIG. 31, the first three steps are input steps in which information for a particular game is input into the system. A matrix of actions sequence triggering variables and a list specifying the relative order of variables is input at step 3100. For a two player game, the matrix consists of two rows: one row of action sequence triggering variables for each of P1 and P2. A lookup table matching action sequences to intervals between action sequence triggering variables is input at step 3105. This lookup table, for example, may contain the information shown in FIG. 12 in table form. A lookup table listing outcomes (for P1) and the respective action sequences for each of P1 and P2 leading to the outcome is input at step 3110. This lookup table, for example, may contain the information in Table 10.

Using the information input in steps 3100,3105, and 3110, the system enters an expected return evaluation loop at block 3115. At step 3120, the next x-axis interval (between action sequence triggering variables for P1) is selected. For example, for the game of FIG. 12, the first x-axis interval is the interval between 0 and b1. The other x-axis intervals are between b1 and rr1, rr1 and C1, C1 and B1, B1 and C1R, C1R and RR1, and RR1 and 1.

At step 3125, the next y-axis interval (between action sequence triggering variables for P2) is selected. For the game of FIG. 12, the first y-axis interval is the interval between 0 and r2. The other y-axis intervals are between r2 and b2, b2 and C2, C2 and B2, B2 and R2, R2 and C2RR, and C2RR and 1.

At step 3130, the outcome for the current intervals is obtained from the lookup tables input at steps 3105 and 3110. The action sequences for P1 and P2 are obtained from the table input at step 3105, and the resulting outcome is obtained from the table input at step 3110. For example, for the combination of the first x-axis interval (between 0 and b1) and the first y-axis interval (between 0 and r2), as shown in FIG. 12, P1's action sequence is "bet-fold" and P2's action sequence is "raise." As shown in Table 10, the resulting outcome is P1 loses P/2+1 (P1's return is −(p/2+1)).

At step 3135 a determination is made as to whether the outcome obtained at step 3130 is dependent on the player having the high hand. If, as in the current interval combination, the outcome does not depend on the high hand, the area of the rectangle formed by the current x-axis and y-axis intervals (i.e. the product of the lengths of the respective intervals) is determined at step 3140. If, however, it is determined at step 3135 that the outcome does depend on the high hand, the area of the rectangle formed by the two intervals respectively above and below the diagonal is determined in step 3138. The areas above and below the diagonal are determined using the relative order of action sequence triggering variables input at step 3100.

At step 3145, the area(s) obtained at steps 3140 or 3138 are multiplied by the return to P1 for each area. Each product so obtained is added to a running sum, which will, when all areas have been evaluated, become an expression for P1's expected return.

At step 3150, a determination is made as to whether there are any remaining y-axis intervals that have not yet been taken into account for the current x-axis interval. If there are more y-axis intervals, execution returns to step 3125. If there are no more y-axis intervals, a determination is made at step 3155 as to whether there are any more x-axis intervals. If yes, execution returns to step 3120. If no, the expected return loop ends at step 3160 and execution proceeds to step 3165.

At step 3165, the partial derivative of the expected return expression generated by the expected return loop is taken with respect to each action sequence triggering variable, and each resulting expression is set equal to zero. The current value for the pot size P is input at step 3170, and the resulting simultaneous equations are solved at step 3175. The resulting action sequence triggering variables are mapped to discrete card hands at step 3180.

Thus, an improved method and apparatus for generating card playing strategies has been described. Although the present invention has been described with respect to certain example embodiments, it will be apparent to those skilled in the art that the present invention is not limited to these specific embodiments. Further, although the operation of certain embodiments has been described in detail using specific software programs and certain detailed process steps, different software may be used, and some of the steps may be omitted or other similar steps may be substituted, without departing from the scope of the invention. Other embodiments incorporating the inventive features of the present invention will be apparent to those skilled in the art.

What is claimed is:

1. In a computer system, a method for generating card playing strategies for a game of cards comprising at least one round of betting comprising the steps of:

determining possible action sequences for a round of said game for each player of said game;

determining possible outcomes for said round of said game resulting from said action sequences;

assigning variables representing dividing points between intervals of a card hand strength hierarchy for each player, each of said intervals corresponding to a subset of hands from said player's card hand strength hierarchy with which said player undertakes a particular action sequence;

constructing an expression for an expected return to a player for said game using said variables;

deriving expressions for said variables that maximize said expected return;

evaluating said expressions to obtain values for said variables;

identifying endpoints of said intervals of said card hand strength hierarchies of said players using said values.

2. The method of claim 1 wherein said step of deriving expressions for said variables comprises the step of:

generating a plurality of simultaneous equations by taking a partial derivative of said expected return expression with respect to each of said variables and setting said expected return expression equal to zero.

3. The method of claim 2 wherein said step of evaluating said expressions to obtain values for said variables comprises the step of:

solving said simultaneous equations to obtain values for said variables.

4. The method of claim 1 wherein said step of constructing said expected return expression comprises the steps of:

constructing a multidimensional model comprising an axis corresponding to each of said player's hand strength hierarchy;

dividing said model into portions representing said possible outcomes for said round of said game;

determining sizes of said portions in terms of said variables;

constructing said expected return expression from a sum of products of said outcomes and said sizes for said portions.

5. The method of claim 1 wherein said step of assigning variables comprises the steps of:

assigning a first variable to a dividing point between an interval in which said second player follows a raise-fold action sequence and an interval in which said second player follows a fold action sequence;

assigning a second variable to a dividing point between an interval in which said first player follows a bet-fold action sequence and an interval in which said first player follows a bet-reraise action sequence;

assigning a third variable to a dividing point between an interval in which said first player follows a bet-reraise action sequence and an interval in which said first player follows a pass-fold action sequence;

assigning a fourth variable to a dividing point between an interval in which said second player follows a bet action sequence and an interval in which said second player follows a pass action sequence;

assigning a fifth variable to a dividing point between an interval in which said second player follows a fold action sequence and an interval in which said second player follows a call action sequence;

assigning a sixth variable to a dividing point between an interval in which said first player follows a pass-fold action sequence and an interval in which said first player follows a pass-call action sequence;

assigning a seventh variable to a dividing point between an interval in which said second player follows a pass action sequence and an interval in which said second player follows a bet action sequence;

assigning an eighth variable to a dividing point between an interval in which said first player follows a pass-call action sequence and an interval in which said first player follows a bet-fold action sequence;

assigning a ninth variable to a dividing point between an interval in which said first player follows a bet-fold action sequence and an interval in which said first player follows a bet-call action sequence;

assigning a tenth variable to a dividing point between an interval in which said second player follows a call action sequence and an interval in which said second player follows a raise-fold action sequence;

assigning an eleventh variable to a dividing point between an interval in which said second player follows a raise-fold action sequence and an interval in which said second player follows a raise-call action sequence;

assigning a twelfth variable to a dividing point between an interval in which said first player follows a bet-call action sequence and an interval in which said first player follows a bet-reraise action sequence.

6. The method of claim 5 wherein said variables are assigned a relative order such that:

said first variable is less than said second variable;

said second variable is less than said third variable;

said third variable is less than said fourth variable;

said fourth variable is less than said fifth variable;

said fifth variable is less than or equal to said sixth variable;

said sixth variable is less than said seven th variable;

said seventh variable is less than said eighth variable;

said eighth variable is less than said ninth variable;

said ninth variable is less than said tenth variable;

said tenth variable is less than said eleventh variable;

said eleventh variable is less than said twelfth variable.

7. The method of claim 1 wherein step of assigning variables comprises the steps of:

assigning a first variable to a dividing point between an interval in which said second player follows a raise-fold action sequence and an interval in which said second player follows a fold action sequence;

assigning a second variable to a dividing point between an interval in which said first player follows a bet-fold action sequence and an interval in which said first player follows a bet-reraise action sequence;

assigning a third variable to a dividing point between an interval in which said first player follows a bet-reraise action sequence and an interval in which said first player follows a pass-raise-fold action sequence;

assigning a fourth variable to a dividing point between an interval in which said first player follows a pass-raise-fold action sequence and an interval in which said first player follows a pass-fold action sequence;

assigning a fifth variable to a dividing point between an interval in which said second player follows a bet-fold action sequence and an interval in which said second player follows a bet-reraise action sequence;

assigning a sixth variable to a dividing point between an interval in which said second player follows a bet-reraise action sequence and an interval in which said second player follows a pass action sequence;

assigning a seventh variable to a dividing point between an interval in which said first player follows a pass-fold action sequence and an interval in which said first player follows a pass-call action sequence;

assigning an eighth variable to a dividing point between an interval in which said second player follows a fold action sequence and an interval in which said second player follows a call action sequence;

assigning a ninth variable to a dividing point between an interval in which said second player follows a pass action sequence and an interval in which said second player follows a bet-fold action sequence;

assigning a tenth variable to a dividing point between an interval in which said second player follows a bet-fold action sequence and an interval in which said second player follows a bet-call action sequence;

assigning an eleventh variable to a dividing point between an interval in which said first player follows a pass-call action sequence and an interval in which said first player follows a bet-fold action sequence;

assigning a twelfth variable to a dividing point between an interval in which said first player follows a bet-fold action sequence and an interval in which said first player follows a bet-call action sequence;

assigning a thirteenth variable to a dividing point between an interval in which said second player follows a call action sequence and an interval in which said second player follows a raise-fold action sequence;

assigning a fourteenth variable to a dividing point between an interval in which said second player follows a raise-fold action sequence and an interval in which said second player follows a raise-call action sequence;

assigning a fifteenth variable to a dividing point between an interval in which said first player follows a bet-call action sequence and an interval in which said first player follows a pass-raise-fold action sequence;

assigning a sixteenth variable to a dividing point between an interval in which said first player follows a pass-raise-fold action sequence and an interval in which said first player follows a pass-raise-call action sequence;

assigning a seventeenth variable to a dividing point between an interval in which said second player follows a bet-call action sequence and an interval in which said second player follows a bet-reraise action sequence;

assigning an eighteenth variable to a dividing point between an interval in which said first player follows a pass-raise-call action sequence and an interval in which said first player follows a bet-reraise action sequence.

8. The method of claim 7 wherein said variables are assigned a relative order such that:

said first variable is less than said second variable;

said second variable is less than said third variable;

said third variable is less than said fourth variable;

said fourth variable is less than said fifth variable;

said fifth variable is less than said sixth variable;

said sixth variable is less than said seventh variable;

said seventh variable is less than or equal to said eighth variable;

said eighth variable is less than said ninth variable;

said ninth variable is less than said tenth variable;

said tenth variable is less than said eleventh variable;

said eleventh variable is less than said twelfth variable;

said twelfth variable is less than said thirteenth variable;

said thirteenth variable is less than said fourteenth variable;

said fourteenth variable is less than said fifteenth variable;

said fifteenth variable is less than said sixteenth variable;

said seventeenth variable is less than said eighteenth variable.

9. A method for generating card playing strategies for a game of cards comprising at least one round of betting comprising the steps of:

determining possible action sequences for a round of said game for each player of said game;

determining possible outcomes for said round of said game resulting from said action sequences;

assigning variables representing dividing points between intervals of a card hand strength hierarchy for each player, each of said intervals corresponding to a subset of hands from said player's card hand strength hierarchy with which said player undertakes a particular action sequence;

constructing an expression for an expected return to a player for said game using said variables;

generating a plurality of simultaneous equations by taking a partial derivative of said expected return expression with respect to each of said variables and setting said expected return expression equal to zero;

solving said simultaneous equations to obtain values for said variables;

identifying endpoints of said intervals of said card hand strength hierarchies of said players using said values.

10. The method of claim 9 wherein said step of constructing said expected return expression comprises the steps of:

constructing a multidimensional model comprising an axis corresponding to each of said player's hand strength hierarchy;

dividing said model into portions representing said possible outcomes for said round of said game;

determining sizes of said portions in terms of said variables;

constructing said expected return expression from a sum of products of said outcomes and said sizes for said portions.

11. The method of claim 9 wherein said step of assigning variables comprises the steps of:

assigning a first variable to a dividing point between an interval in which said second player follows a raise-fold action sequence and an interval in which said second player follows a fold action sequence;

assigning a second variable to a dividing point between an interval in which said first player follows a bet-fold action sequence and an interval in which said first player follows a bet-reraise action sequence;

assigning a third variable to a dividing point between an interval in which said first player follows a bet-reraise action sequence and an interval in which said first player follows a pass-fold action sequence;

assigning a fourth variable to a dividing point between an interval in which said second player follows a bet action sequence and an interval in which said second player follows a pass action sequence;

assigning a fifth variable to a dividing point between an interval in which said second player follows a fold action sequence and an interval in which said second player follows a call action sequence;

assigning a sixth variable to a dividing point between an interval in which said first player follows a pass-fold action sequence and an interval in which said first player follows a pass-call action sequence;

assigning a seventh variable to a dividing point between an interval in which said second player follows a pass action sequence and an interval in which said second player follows a bet action sequence;

assigning an eighth variable to a dividing point between an interval in which said first player follows a pass-call action sequence and an interval in which said first player follows a bet-fold action sequence;

assigning a ninth variable to a dividing point between an interval in which said first player follows a bet-fold action sequence and an interval in which said first player follows a bet-call action sequence;

assigning a tenth variable to a dividing point between an interval in which said second player follows a call action sequence and an interval in which said second player follows a raise-fold action sequence;

assigning an eleventh variable to a dividing point between an interval in which said second player follows a raise-fold action sequence and an interval in which said second player follows a raise-call action sequence;

assigning a twelfth variable to a dividing point between an interval in which said first player follows a bet-call action sequence and an interval in which said first player follows a bet-reraise action sequence.

12. The method of claim 11 wherein said variables are assigned a relative order such that:

said first variable is less than said second variable;

said second variable is less than said third variable;

said third variable is less than said fourth variable;

said fourth variable is less than said fifth variable;

said fifth variable is less than or equal to said sixth variable;

said sixth variable is less than said seventh variable;

said seventh variable is less than said eighth variable;

said eighth variable is less than said ninth variable;

said ninth variable is less than said tenth variable;

said tenth variable is less than said eleventh variable;

said eleventh variable is less than said twelfth variable.

13. The method of claim 9 wherein said step of assigning variables comprises the steps of:

assigning a first variable to a dividing point between an interval in which said second player follows a raise-fold action sequence and an interval in which said second player follows a fold action sequence;

assigning a second variable to a dividing point between an interval in which said first player follows a bet-fold action sequence and an interval in which said first player follows a bet-reraise action sequence;

assigning a third variable to a dividing point between an interval in which said first player follows a bet-reraise action sequence and an interval in which said first player follows a pass-raise-fold action sequence;

assigning a fourth variable to a dividing point between an interval in which said first player follows a pass-raise-fold action sequence and an interval in which said first player follows a pass-fold action sequence;

assigning a fifth variable to a dividing point between an interval in which said second player follows a bet-fold action sequence and an interval in which said second player follows a bet-reraise action sequence;

assigning a sixth variable to a dividing point between an interval in which said second player follows a bet-reraise action sequence and an interval in which said second player follows a pass action sequence;

assigning a seventh variable to a dividing point between an interval in which said first player follows a pass-fold action sequence and an interval in which said first player follows a pass-call action sequence;

assigning an eighth variable to a dividing point between an interval in which said second player follows a fold action sequence and an interval in which said second player follows a call action sequence;

assigning a ninth variable to a dividing point between an interval in which said second player follows a pass action sequence and an interval in which said second player follows a bet-fold action sequence;

assigning a tenth variable to a dividing point between an interval in which said second player follows a bet-fold action sequence and an interval in which said second player follows a bet-call action sequence;

assigning an eleventh variable to a dividing point between an interval in which said first player follows a pass-call action sequence and an interval in which said first player follows a bet-fold action sequence;

assigning a twelfth variable to a dividing point between an interval in which said first player follows a bet-fold action sequence and an interval in which said first player follows a bet-call action sequence;

assigning a thirteenth variable to a dividing point between an interval in which said second player follows a call action sequence and an interval in which said second player follows a raise-fold action sequence;

assigning a fourteenth variable to a dividing point between an interval in which said second player follows a raise-fold action sequence and an interval in which said second player follows a raise-call action sequence;

assigning a fifteenth variable to a dividing point between an interval in which said first player follows a bet-call action sequence and an interval in which said first player follows a pass-raise-fold action sequence;

assigning a sixteenth variable to a dividing point between an interval in which said first player follows a pass-raise-fold action sequence and an interval in which said first player follows a pass-raise-call action sequence;

assigning a seventeenth variable to a dividing point between an interval in which said second player follows a bet-call action sequence and an interval in which said second player follows a bet-reraise action sequence;

assigning an eighteenth variable to a dividing point between an interval in which said first player follows a pass-raise-call action sequence and an interval in which said first player follows a bet-reraise action sequence.

14. The method of claim 13 wherein said variables are assigned a relative order such that:

said first variable is less than said second variable;

said second variable is less than said third variable;

said third variable is less than said fourth variable;

said fourth variable is less than said fifth variable;

said fifth variable is less than said sixth variable;

said sixth variable is less than said seventh variable;

said seventh variable is less than or equal to said eighth variable;

said eighth variable is less than said ninth variable;

said ninth variable is less than said tenth variable;

said tenth variable is less than said eleventh variable;

said eleventh variable is less than said twelfth variable;

said twelfth variable is less than said thirteenth variable;

said thirteenth variable is less than said fourteenth variable;

said fourteenth variable is less than said fifteenth variable;

said fifteenth variable is less than said sixteenth variable;

said seventeenth variable is less than said eighteenth variable.

15. In a computer system, a method for generating a virtual hand for a card game having a hand strength ranking corresponding to a value of a action sequence triggering variable representing a dividing point between first and second intervals of a card hand strength hierarchy for a player, said first interval corresponding to a subset of hands from said player's card hand strength hierarchy with which said player undertakes a first action sequence, said second interval corresponding to a subset of hands from said player's card hand strength hierarchy with which said player undertakes a second action sequence, wherein said hand strength hierarchy of said player comprises a first hand in said first interval having a hand strength immediately below said value of said variable and a second hand in said second interval having a hand strength immediately above said value of said variable, said method comprising the steps of:

determining a ratio between (i) a difference between said hand strength of said second hand and said value of said variable and (ii) a difference between said hand strength of said second hand and said hand strength of said first hand;

undertaking said second action sequence with a fraction of said first hands equal to said ratio.

16. In a computer system, a method for generating a virtual hand for a card game having a hand strength ranking corresponding to a value of a action sequence triggering variable representing a dividing point between first and second intervals of a card hand strength hierarchy for a player, said first interval corresponding to a subset of hands from said player's card hand strength hierarchy with which said player undertakes a first action sequence, said second interval corresponding to a subset of hands from said player's card hand strength hierarchy with which said player undertakes a second action sequence, wherein said hand strength hierarchy of said player comprises a first hand in said first interval having a hand strength immediately below said value of said variable and a second hand in said second interval having a hand strength immediately above said value of said variable, said method comprising the steps of:

determining a first ratio between (i) a difference between said value of said variable and said hand strength of said first hand and (ii) a difference between said hand strength of said second hand and said hand strength of said first hand;

undertaking said first action sequence with a fraction of second hands equal to said first ratio.

17. The method of claim 16 further comprising the steps of:

determining a second ratio between (i) a difference between said hand strength of said second hand and said value of said variable and (ii) a difference between said hand strength of said second hand and said hand strength of said first hand;

undertaking said second action sequence with a fraction of said first hands equal to said second ratio.

18. An article of manufacture comprising:

a computer usable medium having computer readable program code embodied therein for generating card playing strategies for a game of cards, the computer readable program code in said article of manufacture comprising:

computer readable program code configured to cause said computer to manipulate a plurality of variables representing dividing points between intervals of a card hand strength hierarchy for each player of said game, each of said intervals corresponding to a subset of hands from said player's card hand strength hierarchy with which said player undertakes a particular action sequence;

computer readable program code configured to cause said computer to construct an expression for an expected return to a player for a round of said game using said variables;

computer readable program code configured to cause said computer to derive expressions for said variables that maximize said expected return;

computer readable program code configured to cause said computer to evaluate said expressions to obtain values for said variables.

19. The article of manufacture of claim 18 wherein said computer readable program code configured to cause said computer to derive expressions for said variables that maximize said expected return comprises computer readable program code configured to cause said computer to generate a plurality of simultaneous equations by taking a partial derivative of said expected return expression with respect to each of said variables and setting said expected return expression equal to zero.

20. The article of manufacture of claim 19 wherein said computer readable program code configured to cause said computer to derive expressions for said variables that maximize said expected return comprises computer readable program code configured to cause said computer to solve said simultaneous equations to obtain values for said variables.

21. The article of manufacture of claim 19 wherein said computer readable program code configured to cause said computer to construct an expression for said expected return comprises computer readable program code configured to cause said computer to determine products of an expected return for each of a plurality of outcomes of said round of said game and a probability of the occurrence of said outcome.

22. The article of manufacture of claim 18 wherein said plurality of variables comprise:

a first variable representing a dividing point between an interval in which said second player follows a raise-fold action sequence and an interval in which said second player follows a fold action sequence;

a second variable representing a dividing point between an interval in which said first player follows a bet-fold action sequence and an interval in which said first player follows a bet-reraise action sequence;

a third variable representing a dividing point between an interval in which said first player follows a bet-reraise action sequence and an interval in which said first player follows a pass-fold action sequence;

a fourth variable representing a dividing point between an interval in which said second player follows a bet action sequence and an interval in which said second player follows a pass action sequence;

a fifth variable representing a dividing point between an interval in which said second player follows a fold action sequence and an interval in which said second player follows a call action sequence;

a sixth variable representing a dividing point between an interval in which said first player follows a pass-fold action sequence and an interval in which said first player follows a pass-call action sequence;

a seventh variable representing a dividing point between an interval in which said second player follows a pass action sequence and an interval in which said second player follows a bet action sequence;

an eighth variable representing a dividing point between an interval in which said first player follows a pass-call action sequence and an interval in which said first player follows a bet-fold action sequence;

a ninth variable representing a dividing point between an interval in which said first player follows a bet-fold action sequence and an interval in which said first player follows a bet-call action sequence;

a tenth variable representing a dividing point between an interval in which said second player follows a call action sequence and an interval in which said second player follows a raise-fold action sequence;

an eleventh variable representing a dividing point between an interval in which said second player follows a raise-fold action sequence and an interval in which said second player follows a raise-call action sequence;

a twelfth variable representing a dividing point between an interval in which said first player follows a bet-call action sequence and an interval in which said first player follows a bet-reraise action sequence.

23. The article of manufacture of claim 22 further comprising computer readable code configured to cause said computer to assign a relative order to said variables such that:

said first variable is less than said second variable;

said second variable is less than said third variable;

said third variable is less than said fourth variable;

said fourth variable is less than said fifth variable;

said fifth variable is less than or equal to said sixth variable;

said sixth variable is less than said seventh variable;

said seventh variable is less than said eighth variable;

said eighth variable is less than said ninth variable;

said ninth variable is less than said tenth variable;

said tenth variable is less than said eleventh variable;

said eleventh variable is less than said twelfth variable.

24. The article of manufacture of claim 18 wherein said plurality of variables comprise:

a first variable representing a dividing point between an interval in which said second player follows a raise-fold action sequence and an interval in which said second player follows a fold action sequence;

a second variable representing a dividing point between an interval in which said first player follows a bet-fold action sequence and an interval in which said first player follows a bet-reraise action sequence;

a third variable representing a dividing point between an interval in which said first player follows a bet-reraise action sequence and an interval in which said first player follows a pass-raise-fold action sequence;

a fourth variable representing a dividing point between an interval in which said first player follows a pass-raise-fold action sequence and an interval in which said first player follows a pass-fold action sequence;

a fifth variable representing a dividing point between an interval in which said second player follows a bet-fold action sequence and an interval in which said second player follows a bet-reraise action sequence;

a sixth variable representing a dividing point between an interval in which said second player follows a bet-reraise action sequence and an interval in which said second player follows a pass action sequence;

a seventh variable representing a dividing point between an interval in which said first player follows a pass-fold action sequence and an interval in which said first player follows a pass-call action sequence;

an eighth variable representing a dividing point between an interval in which said second player follows a fold action sequence and an interval in which said second player follows a call action sequence;

a ninth variable representing a dividing point between an interval in which said second player follows a pass action sequence and an interval in which said second player follows a bet-fold action sequence;

a tenth variable representing a dividing point between an interval in which said second player follows a bet-fold action sequence and an interval in which said second player follows a bet-call action sequence;

an eleventh variable representing a dividing point between an interval in which said first player follows a pass-call action sequence and an interval in which said first player follows a bet-fold action sequence;

a twelfth variable representing a dividing point between an interval in which said first player follows a bet-fold action sequence and an interval in which said first player follows a bet-call action sequence;

a thirteenth variable representing a dividing point between an interval in which said second player follows a call action sequence and an interval in which said second player follows a raise-fold action sequence;

a fourteenth variable representing a dividing point between an interval in which said second player follows a raise-fold action sequence and an interval in which said second player follows a raise-call action sequence;

a fifteenth variable representing a dividing point between an interval in which said first player follows a bet-call action sequence and an interval in which said first player follows a pass-raise-fold action sequence;

a sixteenth variable representing a dividing point between an interval in which said first player follows a pass-raise-fold action sequence and an interval in which said first player follows a pass-raise-call action sequence;

a seventeenth variable representing a dividing point between an interval in which said second player follows a bet-call action sequence and an interval in which said second player follows a bet-reraise action sequence;

an eighteenth variable representing a dividing point between an interval in which said first player follows a pass-raise-call action sequence and an interval in which said first player follows a bet-reraise action sequence.

25. The article of manufacture of claim 24 further comprising computer readable code configured to cause said computer to assign a relative order to said variables such that:

said first variable is less than said second variable;

said second variable is less than said third variable;

said third variable is less than said fourth variable;

said fourth variable is less than said fifth variable;

said fifth variable is less than said sixth variable;

said sixth variable is less than said seventh variable;

said seventh variable is less than or equal to said eighth variable;

said eighth variable is less than said ninth variable;

said ninth variable is less than said tenth variable;

said tenth variable is less than said eleventh variable;

said eleventh variable is less than said twelfth variable;

said twelfth variable is less than said thirteenth variable;

said thirteenth variable is less than said fourteenth variable;

said fourteenth variable is less than said fifteenth variable;

said fifteenth variable is less than said sixteenth variable;

said seventeenth variable is less than said eighteenth variable.

26. An article of manufacture comprising:

a computer usable medium having computer readable program code embodied therein for generating card playing strategies for a game of cards, the computer readable program code in said article of manufacture comprising:

computer readable program code configured to cause said computer to manipulate a plurality of variables representing dividing points between intervals of a card hand strength hierarchy for each player of said game, each of said intervals corresponding to a subset of hands from said player's card hand strength hierarchy with which said player undertakes a particular action sequence;

computer readable program code configured to cause said computer to construct an expression for an expected return to a player for a round of said game using said variables comprising computer readable program code configured to cause said computer to determine products of an expected return for each of a plurality of outcomes of said round of said game and a probability of the occurrence of said outcome;

computer readable program code configured to cause said computer to derive expressions for said variables that maximize said expected return comprising computer readable program code configured to cause said computer to generate a plurality of simultaneous equations by taking a partial derivative of said expected return expression with respect to each of said variables and setting said expected return expression equal to zero;

computer readable program code configured to cause said computer to evaluate said expressions to obtain values for said variables comprising computer readable program code configured to cause said computer to solve said simultaneous equations to obtain values for said variables.

27. The article of manufacture of claim 26 wherein said plurality of variables comprise:

a first variable representing a dividing point between an interval in which said second player follows a raise-fold action sequence and an interval in which said second player follows a fold action sequence;

a second variable representing a dividing point between an interval in which said first player follows a bet-fold action sequence and an interval in which said first player follows a bet-reraise action sequence;

a third variable representing a dividing point between an interval in which said first player follows a bet-reraise action sequence and an interval in which said first player follows a pass-fold action sequence;

a fourth variable representing a dividing point between an interval in which said second player follows a bet a action sequence and an interval in which said second player follows a pass action sequence;

a fifth variable representing a dividing point between an interval in which said second player follows a fold action sequence and an interval in which said second player follows a call action sequence;

a sixth variable representing a dividing point between an interval in which said first player follows a pass-fold action sequence and an interval in which said first player follows a pass-call action sequence;

a seventh variable representing a dividing point between an interval in which said second player follows a pass action sequence and an interval in which said second player follows a bet action sequence;

an eighth variable representing a dividing point between an interval in which said first player follows a pass-call action sequence and an interval in which said first player follows a bet-fold action sequence;

a ninth variable representing a dividing point between an interval in which said first player follows a bet-fold action sequence and an interval in which said first player follows a bet-call action sequence;

a tenth variable representing a dividing point between an interval in which said second player follows a call action sequence and an interval in which said second player follows a raise-fold action sequence;

an eleventh variable representing a dividing point between an interval in which said second player follows a raise-fold action sequence and an interval in which said second player follows a raise-call action sequence;

a twelfth variable representing a dividing point between an interval in which said first player follows a bet-call action sequence and an interval in which said first player follows a bet-reraise action sequence.

28. The article of manufacture of claim 27 further comprising computer readable code configured to cause said computer to assign a relative order to said variables such that:

said first variable is less than said second variable;

said second variable is less than said third variable;

said third variable is less than said fourth variable;

said fourth variable is less than said fifth variable;

said fifth variable is less than or equal to said sixth variable;

said sixth variable is less than said seventh variable;

said seventh variable is less than said eighth variable;

said eighth variable is less than said ninth variable;

said ninth variable is less than said tenth variable;

said tenth variable is less than said eleventh variable;

said eleventh variable is less than said twelfth variable.

29. The article of manufacture of claim 26 wherein said plurality of variables comprise:

a first variable representing a dividing point between an interval in which said second player follows a raise-fold action sequence and an interval in which said second player follows a fold action sequence;

a second variable representing a dividing point between an interval in which said first player follows a bet-fold action sequence and an interval in which said first player follows a bet-reraise action sequence;

a third variable representing a dividing point between an interval in which said first player follows a bet-reraise action sequence and an interval in which said first player follows a pass-raise-fold action sequence;

a fourth variable representing a dividing point between an interval in which said first player follows a pass-raise-fold action sequence and an interval in which said first player follows a pass-fold action sequence;

a fifth variable representing a dividing point between an interval in which said second player follows a bet-fold action sequence and an interval in which said second player follows a bet-reraise action sequence;

a sixth variable representing a dividing point between an interval in which said second player follows a bet-reraise action sequence and an interval in which said second player follows a pass action sequence;

a seventh variable representing a dividing point between an interval in which said first player follows a pass-fold action sequence and an interval in which said first player follows a pass-call action sequence;

an eighth variable representing a dividing point between an interval in which said second player follows a fold action sequence and an interval in which said second player follows a call action sequence;

a ninth variable representing a dividing point between an interval in which said second player follows a pass action sequence and an interval in which said second player follows a bet-fold action sequence;

a tenth variable representing a dividing point between an interval in which said second player follows a bet-fold action sequence and an interval in which said second player follows a bet-call action sequence;

an eleventh variable representing a dividing point between an interval in which said first player follows a pass-call action sequence and an interval in which said first player follows a bet-fold action sequence;

a twelfth variable representing a dividing point between an interval in which said first player follows a bet-fold action sequence and an interval in which said first player follows a bet-call action sequence;

a thirteenth variable representing a dividing point between an interval in which said second player follows a call action sequence and an interval in which said second player follows a raise-fold action sequence;

a fourteenth variable representing a dividing point between an interval in which said second player follows a raise-fold action sequence and an interval in which said second player follows a raise-call action sequence;

a fifteenth variable representing a dividing point between an interval in which said first player follows a bet-call action sequence and an interval in which said first player follows a pass-raise-fold action sequence;

a sixteenth variable representing a dividing point between an interval in which said first player follows a pass-raise-fold action sequence and an interval in which said first player follows a pass-raise-call action sequence;

a seventeenth variable representing a dividing point between an interval in which said second player follows a bet-call action sequence and an interval in which said second player follows a bet-reraise action sequence;

an eighteenth variable representing a dividing point between an interval in which said first player follows a pass-raise-call action sequence and an interval in which said first player follows a bet-reraise action sequence.

30. The article of manufacture of claim 29 further comprising computer readable code configured to cause said computer to assign a relative order to said variables such that:

said first variable is less than said second variable;

said second variable is less than said third variable;

said third variable is less than said fourth variable;

said fourth variable is less than said fifth variable;

said fifth variable is less than said sixth variable;

said sixth variable is less than said seventh variable;

said seventh variable is less than or equal to said eighth variable;

said eighth variable is less than said ninth variable;

said ninth variable is less than said tenth variable;

said tenth variable is less than said eleventh variable;

said eleventh variable is less than said twelfth variable;

said twelfth variable is less than said thirteenth variable;

said thirteenth variable is less than said fourteenth variable;

said fourteenth variable is less than said fifteenth variable;

said fifteenth variable is less than said sixteenth variable;

said seventeenth variable is less than said eighteenth variable.

31. An article of manufacture comprising:

a computer usable medium having computer readable program code embodied therein for generating a virtual hand for a card game having a hand strength ranking corresponding to a value of a action sequence triggering variable representing a dividing point between first and second intervals of a card hand strength hierarchy for a player, said first interval corresponding to a subset of hands from said player's card hand strength hierarchy with which said player undertakes a first action sequence, said second interval corresponding to a subset of hands from said player's card hand strength hierarchy with which said player undertakes a second action sequence, wherein said hand strength hierarchy of said player comprises a first hand in said first interval having a hand strength immediately below said value of said variable and a second hand in said second interval having a hand strength immediately above said value of said variable, the computer readable program code in said article of manufacture comprising:

computer readable program code configured to cause said computer to determine a ratio between (i) a difference between said hand strength of said second hand and said value of said variable and (ui) a difference between said hand strength of said second hand and said hand strength of said first hand;

computer readable program code configured to cause said computer to output a value representing a fraction of said first hands equal to said ratio with which to undertake said second action sequence.

32. An article of manufacture comprising:

a computer usable medium having computer readable program code embodied there in for generating a virtual hand for a card game having a hand strength ranking corresponding to a value of a action sequence triggering variable representing a dividing point between first and second intervals of a card hand strength hierarchy for a player, said first interval corresponding to a subset of hands from said player's card hand strength hierarchy with which said player undertakes a first action sequence, said second interval corresponding to a subset of hands from said player's card hand strength hierarchy with which said player undertakes a second action sequence, wherein said hand strength hierarchy of said player comprises a first hand in said first interval having a hand strength immediately below said value of said variable and a second hand in said second interval having a hand strength immediately above said value of said variable, the computer readable program code in s aid article of manufacture comprising:

computer readable program code configured to cause said computer to determine a first ratio between (i) a difference between said value of said variable and said hand strength of said first hand and (ii) a difference between said hand strength of said second hand and said hand strength of said first hand;

computer readable program code configured to cause said computer to output a value representing a fraction of said second hands equal to said first ratio with which to undertake said first action sequence.

33. The article of manufacture of claim 32 further comprising:

computer readable program code configured to cause said computer to determine a second ratio between (i) a difference between said hand strength of said second hand and s aid value of said variable and (ii) a difference between said hand strength of said second hand and said hand strength of said first hand;

computer readable program code configured to cause said computer to output a value representing a fraction of said first hands equal to said second ratio with which to undertake said second action sequence.

* * * * *